US006713243B2

(12) United States Patent
Mikoshiba et al.

(10) Patent No.: US 6,713,243 B2
(45) Date of Patent: Mar. 30, 2004

(54) SILVER HALIDE PHOTOSENSITIVE MATERIAL

(75) Inventors: Hisashi Mikoshiba, Kanagawa (JP); Hiroyuki Yoneyama, Kanagawa (JP); Naoto Matsuda, Kanagawa (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/813,975

(22) Filed: Mar. 22, 2001

(65) Prior Publication Data

US 2002/0058213 A1 May 16, 2002

(30) Foreign Application Priority Data

| | | |
|---|---|---|
| Mar. 31, 2000 | (JP) | 2000-098614 |
| Mar. 31, 2000 | (JP) | 2000-098719 |
| Mar. 31, 2000 | (JP) | 2000-098841 |
| Mar. 31, 2000 | (JP) | 2000-098953 |

(51) Int. Cl.[7] ..... G03C 1/38
(52) U.S. Cl. ..... 430/546; 430/570; 430/630
(58) Field of Search ..... 430/546, 570, 430/630

(56) References Cited

U.S. PATENT DOCUMENTS

| | | | | |
|---|---|---|---|---|
| 4,555,470 A | | 11/1985 | Sakaguchi et al. | |
| 5,192,651 A | | 3/1993 | Tsukahara et al. | |
| 5,200,303 A | | 4/1993 | Takahashi et al. | |
| 5,200,304 A | | 4/1993 | Yoneyama et al. | |
| 6,054,258 A | * | 4/2000 | Merkel et al. | 430/546 |
| 6,107,017 A | * | 8/2000 | Merkel et al. | 430/546 |
| 6,221,571 B1 | * | 4/2001 | Zengerle et al. | 430/546 |

FOREIGN PATENT DOCUMENTS

| | | |
|---|---|---|
| EP | A1969320 | 1/2000 |
| EP | A1969321 | 1/2000 |
| JP | A1101543 | 4/1989 |
| JP | 277060 | 3/1990 |
| JP | 4146433 | 5/1992 |

* cited by examiner

*Primary Examiner*—Janet Baxter
*Assistant Examiner*—Amanda C. Walke
(74) *Attorney, Agent, or Firm*—Birch, Stewart, Kolasch & Birch, LLP

(57) ABSTRACT

A silver halide photosensitive material in which a noncoloring compound is used as a high-boiling-point organic solvent for dissolving components of the silver halide photosensitive material that have low solubility in water. Preferably, the silver halide photosensitive material has a hydrophilic colloid layer containing a hydrophilic polymer and the noncoloring compound is contained in the hydrophilic colloid layer. The silver halide photosensitive material produces durable colored images, reduces the formation of stains, improves storability, alleviates fogging and soft-toning of emulsion during storage, inhibits migration of a dispersion medium, is inexpensive, and is produced from materials that cause little damage to the environment.

25 Claims, No Drawings

SILVER HALIDE PHOTOSENSITIVE MATERIAL

BACKGROUND OF THE INVENTION

1. Field of the Invention

The present invention relates to a silver halide photosensitive containing a high-boiling-point organic solvent which is excellent in such properties as solubility, dispersibility, and dispersion stability. More specifically, the present invention relates to a silver halide photosensitive material in which deterioration of color developability after storage and deterioration of storability of emulsions or latent images are alleviated.

Heretofore, a compound which is photographically useful and has low solubility in water was is incorporated into a hydrophilic colloid layer by being dissolved in a suitable oil droplet-forming agent, i.e., a high-boiling-point organic solvent, and thereafter being dispersed in a solution of a hydrophilic organo-colloid such as gelatin in the presence of a surfactant.

2. Description of the Related Art

A silver halide photosensitive material normally comprises a support having thereon a photosensitive layer and a non-photosensitive layer containing a photographically useful compound. In order to incorporate a compound which is photographically useful and has low solubility in water into the photosensitive layer and/or non-photosensitive layer, a process hitherto practiced comprises the steps of dissolving the photographically useful compound in a suitable oil droplet-forming agent, i.e., a high-boiling-point organic solvent, dispersing the solution containing the compound in a solution of a hydrophilic organo-colloid such as gelatin in the presence of a surfactant, and coating the dispersion on a support so that a hydrophilic organo-colloid layer containing the photographically useful compound is formed.

Since the high-boiling-point organic solvent, which is used for the formation of the hydrophilic organo-colloid layer, is used as a solvent for a hydrophobic compound in the formation of a constituent layer of a silver halide photosensitive material, and since the high-boiling-point organic solvent remains in the constituent layer after formation thereof, the high-boiling-point organic solvent is required to exhibit a wide range of performances as indicated below. That is, the high-boiling-point organic solvent has excellent capability to dissolve a photographically useful compound, as well as affinity for, dispersibility in, and dispersion stability in gelatin; the high-boiling-point organic solvent does not decrease the reactivity of the photographically useful compound (e.g., color developability of a coupler or redox reactivity of a redox compound such as a color mixing preventive); the high-boiling-point organic solvent can control the hue to be formed by a color-forming reaction to an optimum; the high-boiling-point organic solvent itself has excellent chemical stability; the high-boiling-point organic solvent does not accelerate decomposition of the photographically useful compound to be dispersed or yellowing of a white background due to decomposition; the high-boiling-point organic solvent does not accelerate fading of the dye to be formed due to light, heat, moisture, or atmosphere; the high-boiling-point organic solvent does not accelerate occurrence of colored stains which are caused by processing components remaining in the photosensitive material after processing; the high-boiling-point organic solvent does not adversely affect the storability of emulsions and latent images; and the high-boiling-point organic solvent is inexpensive and can be easily obtained.

Heretofore, phthalic ester was widely known as a high-boiling-point organic solvent for a silver halide photosensitive material. However, high-boiling-point organic solvents based on phthalic ester presented problems due to migration of the high-boiling-point organic solvent in the photosensitive material during storage.

The migration during storage can be inhibited by increasing of the molecular weight of the phthalic ester or by enhancement of hydrophobicity of the phthalic ester. But the high-boiling-point organic solvent having a larger molecular weight brings about the problem that reactivity of the photographically useful compound, for example color developability of a coupler, is reduced. Therefore, it has been difficult to attain inhibition of diffusion and preservation of reactivity at the same time.

Meanwhile, for further improvement of performances, development of new high-boiling-point organic solvents has been made. An example of such compounds is a compound having a plurality of ester linkages such as a dibenzoate. Examples of such compounds include the compounds described in, for example, Japanese Patent Application Laid-Open (JP-A) Nos. 1-101543, 2-43541, 2-77060, 3-191345, 3-192347, 4-146433, and 59-83154, and European Patent No. 969320. However, these compounds do not necessarily satisfy the requirements described above. In addition there is still, a need for attainment of the inhibition of the diffusion and the preservation of reactivity of the photographically useful compound.

At the same time, the development of a high-boiling-point organic solvent that causes little damage to the environment and can replace a phthalic ester has been desired.

SUMMARY OF THE INVENTION

A first object of the present invention is to provide a silver halide photosensitive material which uses a high-boiling-point organic solvent capable of sufficiently dissolving a compound having low solubility in water and providing excellent dispersibility and dispersion stability of the compound and which produces durable colored images and reduces the formation of colored stains. A second object of the present invention is to provide a silver halide photosensitive material in which the fogging and soft-toning of the emulsion during storage are alleviated. A third object of the present invention is to provide a silver halide photosensitive material in which the storability of latent images is improved. A fourth object of the present invention is to provide a silver halide photosensitive material in which undesirable effects that may be caused by the migration of a dispersing medium are inhibited. A fifth object of the present invention is to provide a silver halide photosensitive material in which problems due to conventional high-boiling-point organic solvents can be solved using an inexpensive high-boiling-point organic solvent. A sixth object of the present invention is to provide a silver halide photosensitive material in which the starting materials to be used for the manufacture cause little damage to the environment.

After close studies of a dibenzoate-based compounds and triester-based compounds, the present inventors have found that a compound having a specific structure enables the realization of the above-mentioned inhibition of the diffusion and the preservation of reactivity at the same time and satisfies all the requirements for a high-boiling-point organic solvent of a silver halide photosensitive material. Based on this finding, the inventors have achieved the present invention.

The problem described above can be solved by a silver halide photosensitive material containing at least one noncoloring compound represented by any one of the following general formulae (a) to (d):

General formula (a)

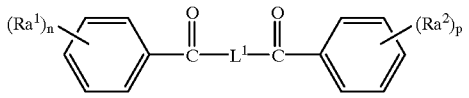

[In the general formula (a), $Ra^1$ and $Ra^2$ each independently represents an unsubstituted alkyl group having 1 to 10 carbon atoms. $L^1$ represents a group represented by the following general formula (a2) or (a3). n and p each independently represents an integer of 1 to 5. Where $L^1$ is a group represented by the general formula (a3), the total number of carbon atoms of $Ra^1$, $Ra^2$, $Ra^7$, and $Ra^8$ is 5 or greater.]

General formula (a2)

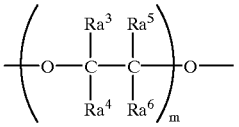

[In the general formula (a2), $Ra^3$, $Ra^4$, $Ra^5$, and $Ra^6$ each independently represents a hydrogen atom or an unsubstituted alkyl group having 1 to 10 carbon atoms and m represents an integer of 2 to 4. $Ra^3$, $Ra^4$, $Ra^5$, and $Ra^6$ may be the same as or different from each other. If m is 2 or greater, the total number of carbon atoms of $Ra^1$, $Ra^2$, $Ra^3$, $Ra^4$, $Ra^5$, and $Ra^6$ is 5 or greater.]

General formula (a3)

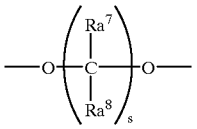

[In the general formula (a3), $Ra^7$ and $Ra^8$ each independently represents a hydrogen atom or an unsubstituted alkyl group having 1 to 10 carbon atoms and s represents an integer of 2 to 8. $Ra^7$ and $Ra^8$ may be the same as or different from each other.]

General formula (b)

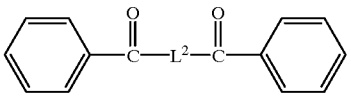

[In the general formula (b), $L^2$ represents a group represented by the following formula (b2), (b3), or (b4)]

General formula (b2)

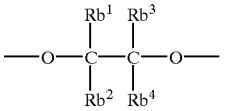

General formula (b3)

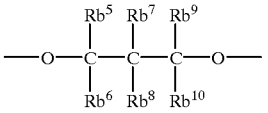

General formula (b4)

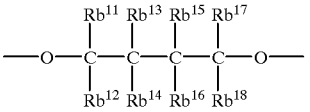

[In the general formula (b2), $Rb^1$, $Rb^2$, $Rb^3$, and $Rb^4$ each independently represents a hydrogen atom or an unsubstituted alkyl group having 1 to 10 carbon atoms with the proviso that the total number of carbon atoms of $Rb^1$, $Rb^2$, $Rb^3$, and $Rb^4$ is 5 or greater. In the general formula (b3), $Rb^5$, $Rb^6$, $Rb^7$, $Rb^8$, $Rb^9$, and $Rb^{10}$ each independently represents a hydrogen atom or an unsubstituted alkyl group having 1 to 10 carbon atoms with the proviso that the total number of carbon atoms of $Rb^5$, $Rb^6$, $Rb^7$, $Rb^8$, $Rb^9$, and $Rb^{10}$ is 6 or greater. In the general formula (b4), $Rb_{11}$, $Rb^{12}$, $Rb^{13}$, $Rb^{14}$, $Rb^{15}$, $Rb^{16}$, $Rb^{17}$, and $Rb^{18}$ each independently represents a hydrogen atom or an unsubstituted alkyl group having 1 to 10 carbon atoms with the proviso that the total number of carbon atoms of $Rb^{11}$, $Rb^{12}$, $Rb^{13}$, $Rb^{14}$, $Rb^{15}$, $Rb^{16}$, $Rb^{17}$ and $Rb^{18}$ is 2 or greater.]

General formula (c)

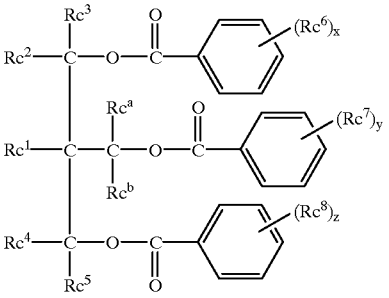

[In the general formula (c), $Rc^1$ represents a hydrogen atom or an unsubstituted alkyl group having 1 to 10 carbon atoms. $Rc^a$, $Rc^b$, $Rc^2$, $Rc^3$, $Rc^4$, $Rc^5$, $Rc^6$, $Rc^7$, and $Rc^8$ each independently represents a hydrogen atom or an unsubstituted alkyl group having 1 to 10 carbon atoms. x, y, and z each independently represents an integer of 0 to 5. If one or more of x, y, and z are 2 or greater, the $Rc^6$s, the $Rc^7$s, and the $Rc^8$s may be the same as or different from each other, with the proviso that the total number of carbon atoms of $Rc^a$, $Rc^b$, $Rc^1$, $Rc^2$, $Rc^3$, $Rc^4$, $Rc^5$, $Rc^6$, $Rc^7$, and $Rc^8$ is 3 or greater.]

General formula (d)

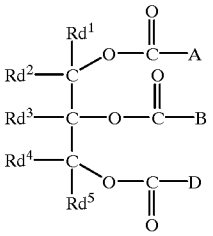

[In the general formula (d), A, B, and D each independently represents an unsubstituted alkyl group having 1 to 10 carbon atoms or a group represented by the following general formula (d2). $Rd^1$, $Rd^2$, $Rd^3$, $Rd^4$, and $Rd^5$ each independently represents a hydrogen atom or an unsubstituted alkyl group having 1 to 10 carbon atoms.]

General formula (d2)

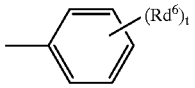

[In the general formula (d2), $Rd^6$ represents an unsubstituted alkyl group having 1 to 10 carbon atoms. t represents an integer of 0 to 5. If t is 2 or greater, the $Rd^6$s may be the same as or different from each other, with the proviso that, in the formulae (d) and (d2), at least one of $Rd^1$, $Rd^2$, $Rd^3$, $Rd^4$, $Rd^5$, and $Rd^6$ is an unsubstituted alkyl group having 1 to 10 carbon atoms and that at least two of A, B, and D are each a group represented by the general formula (d2). If A, B, and D are each a group represented by the general formula (d2) and all of t are 0, the total number of carbon atoms of $Rd^1$, $Rd^2$, $Rd^3$, $Rd^4$, and $Rd^5$ is 3 or greater.]

The noncoloring compound represented by any one of the formulae (a) to (d) is a good solvent for a photographically useful compound containing a hydrophobic organic material and exhibits an excellent dispersibility and dispersion stability in a binder such as gelatin capable of forming a colloid layer. Further, by contrast with a high-boiling-point organic solvent conventionally used in the preparation of a silver halide photosensitive material, the noncoloring compound described above can alleviate the decomposition of a photographically useful compound and the reduction in activity of a coupler contained in the photographically useful compound, and exhibits nondiffusiveness. Accordingly, the use of the noncoloring compound represented by any one of the formulae (a) to (d) makes it possible to provide a silver halide photosensitive material free from problems of formation of fogging and the like even after storage for a long time and capable of forming superior images.

DESCRIPTION OF THE PREFERRED EMBODIMENTS

According to the present embodiment of a silver halide photosensitive material, at least one noncoloring compound represented by any one of the following formulae (a) to (d) is used as a high-boiling-point organic solvent for dissolving components which constitute the silver halide photosensitive material and have low solubility in water.

The formulae (a) to (d) are explained in detail below. First, the formula (a) is explained.

General formula (a)

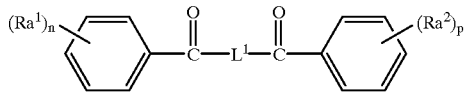

In the general formula (a), $Ra^1$ and $Ra^2$ each independently represents an unsubstituted alkyl group having 1 to 10 carbon atoms. The unsubstituted alkyl group having 1 to 10 carbon atoms may be a branched or straight-chain alkyl group. Examples of the alkyl group include such groups as methyl, ethyl, n-propyl, isopropyl, n-butyl, s-butyl, t-butyl, n-pentyl, isopentyl, n-hexyl, n-heptyl, n-octyl, n-nonyl, n-decyl, and 2-ethylhexyl.

Among these groups, preferably $Ra^1$ and $Ra^2$ are each an unsubstituted alkyl group having 1 to 5 carbon atoms and more preferably an unsubstituted alkyl group having 1 to 3 carbon atoms. Preferably $Ra^1$ and $Ra^2$ are the same as each other.

n and p each independently represents an integer of 1 to 5. If n is 2 to 5, the plural of $Ra^1$ may be the same as or different from each other, and, if p is 2 to 5, the plural of $Ra^2$ may be the same as or different from each other. Preferably n and p are equal to each other, more preferably n and p are each 1 or 2, and most preferably n and p are each 1.

As to substitution positions of $Ra^1$ and $Ra^2$ on benzene rings, although the position may be any of an o-, m-, or p-position relative to a carbonyl group, the substitution positions are preferably the same for $Ra^1$ and $Ra^2$.

$L^1$ represents a group represented by the following general formula (a2) or (a3).

General formula (a2)

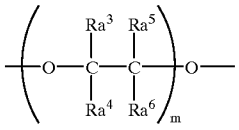

General formula (a3)

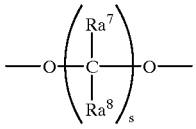

In the general formula (a2), $Ra^3$, $Ra^4$, $Ra^5$, and $Ra^6$ each independently represents a hydrogen atom or an unsubstituted alkyl group having 1 to 10 carbon atoms. Examples of the unsubstituted alkyl group having 1 to 10 carbon atoms include the groups listed in the explanation of $Ra^1$ and $Ra^2$. Among these groups, preferably $Ra^3$, $Ra^4$, $Ra^5$, and $Ra^6$ are each a hydrogen atom or an unsubstituted alkyl group having 1 to 4 carbon atoms, more preferably a hydrogen atom, a methyl group, an ethyl group, an isopropyl group, or an n-propyl group, and most preferably a hydrogen atom.

m represents an integer of 2 to 4. Accordingly, two or more of each of $Ra^3$ to $Ra^6$ are present. The plural of $Ra^3$, $Ra^4$, $Ra^5$, and $Ra^6$ may be the same as or different from each other. Preferably $Ra^3$, $Ra^4$, $Ra^5$, and $Ra^6$ are the same as each other. m is preferably 2 or 3 and most preferably 2.

If m is 2, the total number of carbon atoms of $Ra^1$, $Ra^2$, $Ra^3$, $Ra^4$, $Ra^5$, and $Ra^6$ is 5 or greater (preferably 5 to 20).

Preferably the total number of carbon atoms of $Ra^1$, $Ra^2$, $Ra^3$, $Ra^4$, $Ra^5$, and $Ra^6$ is 6 or greater (preferably 6 to 10).

In the general formula (a3), $Ra^7$ and $Ra^8$ each independently represents a hydrogen atom or an unsubstituted alkyl group having 1 to 10 carbon atoms. Examples of the unsubstituted alkyl group having 1 to 10 carbon atoms include the groups listed in the explanation of $Ra^1$ and $Ra^2$. Among these groups, preferably $Ra^7$ and $Ra^8$ are each a hydrogen atom or an unsubstituted alkyl group having 1 to 4 carbon atoms, more preferably a hydrogen atom, amethyl group, an ethyl group, an isopropyl group, or an n-propyl group, and most preferably a hydrogen atom.

s represents an integer of 2 to 8. Accordingly, two or more of each of $Ra^7$ and $Ra^8$ are present. $Ra^7$ and $Ra^8$ may be the same as or different from each other. If s is 5, preferably at least one of the five $Ra^7$s and at least one of the five $Ra^8$s are each an unsubstituted alkyl group having 1 to 10 carbon atoms. Preferably s is 2 to 4.

If $L^1$ is a group represented by the general formula (a3), the total number of carbon atoms of $Ra^1$, $Ra^2$, $Ra^7$, and $Ra^8$ is 5 or greater (preferably 5 to 20). Preferably the total number of carbon atoms is 7 or greater (preferably 7 to 10). Most preferably the total number of carbon atoms is 9 or greater (preferably 9 to 10).

Preferably the structure of the compound represented by the general formula (a) is as follows.

That is, $Ra^1$ and $Ra^2$ each represents the same unsubstituted alkyl group having 1 to 3 carbon atoms. n and p are equal to each other and are each 1 or 2. $L^1$ has the structure represented by the general formula (a2) or (a3). $Ra^3$, $Ra^4$, $Ra^5$, and $Ra^6$ are each a hydrogen atom or an unsubstituted alkyl group having 1 to 4 carbon atoms. m is 2 or 3. If m is 2, the total number of carbon atoms of $Ra^1$, $Ra^2$, $Ra^3$, $Ra^4$, $Ra^5$, and $Ra^6$ is 5 or greater (preferably 5 to 20). $Ra^7$ and $Ra^8$ are each a hydrogen atom or an unsubstituted alkyl group having 1 to 4 carbon atoms. s is 1,2,3 or 4.

More preferably the structure of the compound represented by the general formula (a) is as follows.

That is, $Ra^1$ and $Ra^2$ each represents the same group selected from a methyl group, an ethyl group, an isopropyl group, and an n-propyl group. n and p are equal to each other and are each 1. $L^1$ has the structure represented by the general formula (a2) or (a3). $Ra^3$, $Ra^4$, $Ra^5$, and $Ra^6$ are each independently a hydrogen atom or alternatively a methyl group, an ethyl group, an isopropyl group, or an n-propyl group. m is 2 or 3. If m is 2, the total number of carbon atoms of $Ra^1$, $Ra^2$, $Ra^3$, $Ra^4$, $Ra^5$, and $Ra^6$ is 5 or greater (preferably 5 to 20). $Ra^7$ and $Ra^8$ are each a hydrogen atom or alternatively a methyl group, an ethyl group, an isopropyl group, or an n-propyl group. s is 2 or 4.

The molecular weight of the noncoloring compound represented by the general formula (a) is preferably 800 or less, more preferably 700 or less, further more preferably 600 or less, and most preferably 500 or less. The lower limit of the molecular weight is preferably 380 or more, more preferably 400 or more, and most preferably 420 or more. Particularly, if the molecular weight is specified by upper and lower limits, the molecular weight is preferably 380 to 800, more preferably 400 to 700, further more preferably 420 to 600, and most preferably 420 to 500.

Specific examples (i.e., exemplary compounds a-1 to a-33) of the noncoloring compound represented by the general formula (a) are given below. However, it should be noted that the present invention is not limited to these examples.

a-1

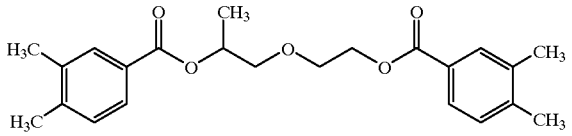

a-2

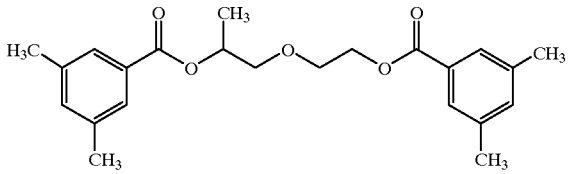

a-3

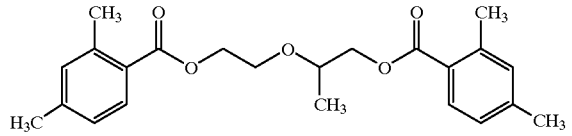

a-4

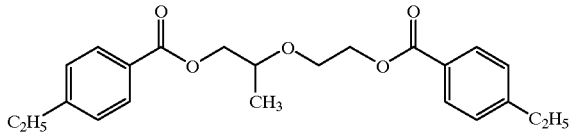

a-5

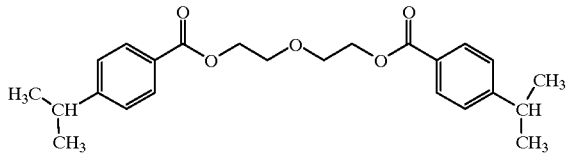

a-6

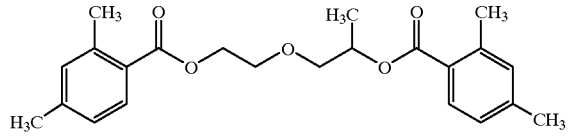

a-7

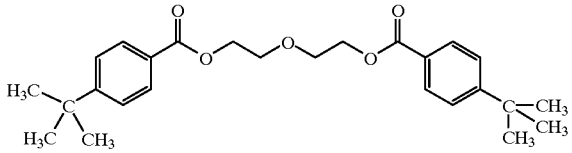

a-8

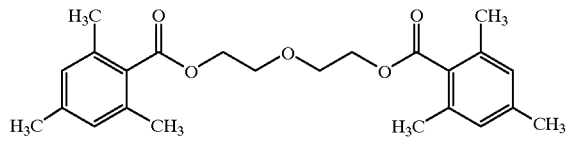

a-9

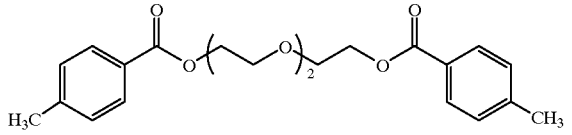

a-10

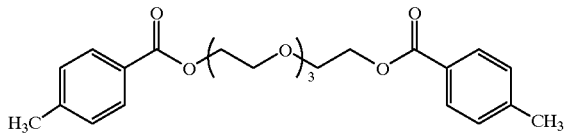

-continued
a-11
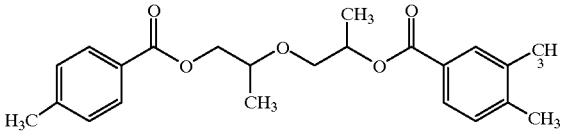
a-12
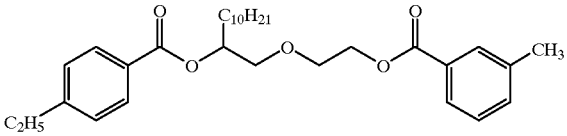
a-13
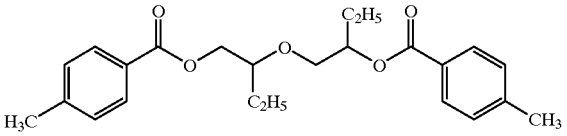
a-14
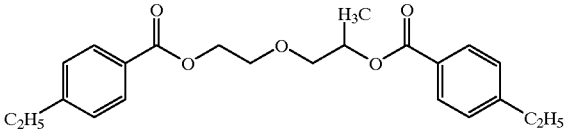
a-15
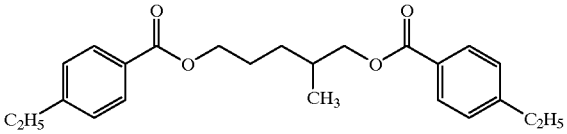
a-16
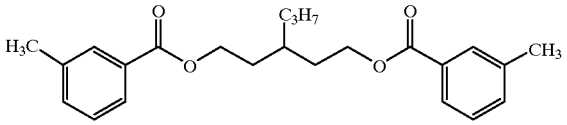
a-17
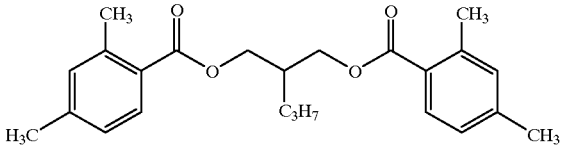
a-18
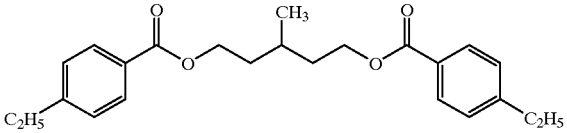
a-19
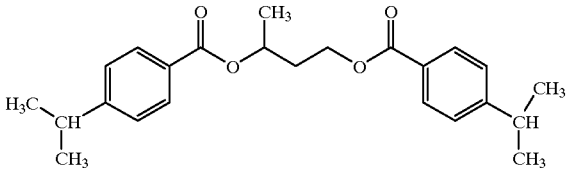
a-20
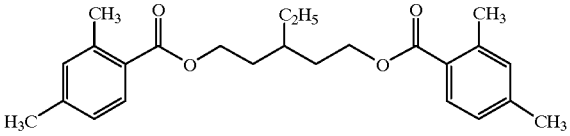
-continued
a-21
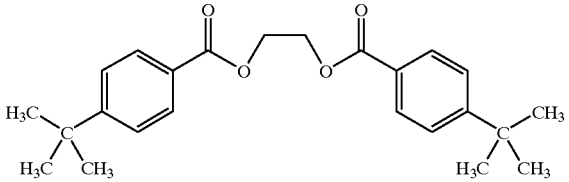
a-22
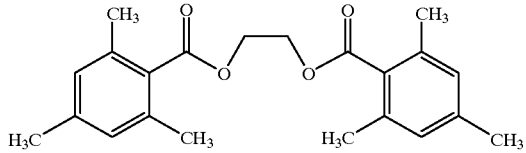
a-23
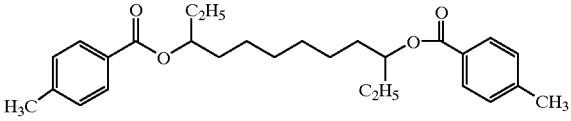
a-24
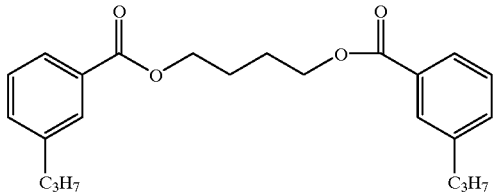
a-25
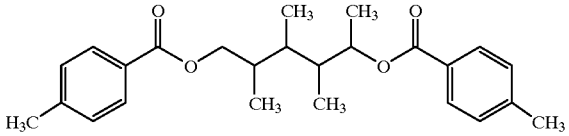
a-26
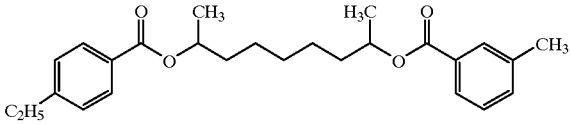
a-27
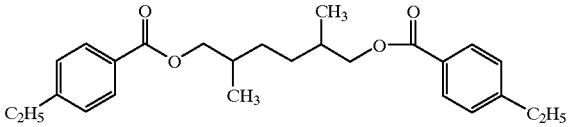
a-28
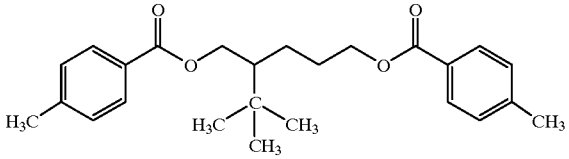
a-29
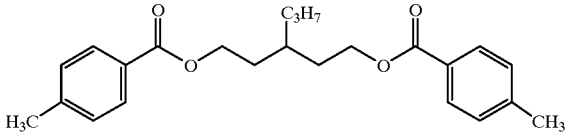

-continued a-30

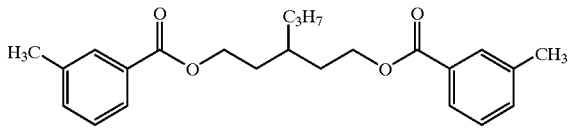

a-31

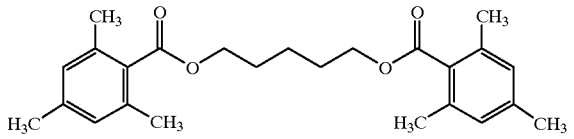

a-32

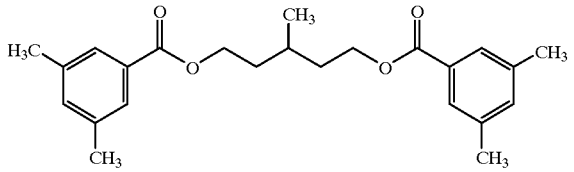

a-33

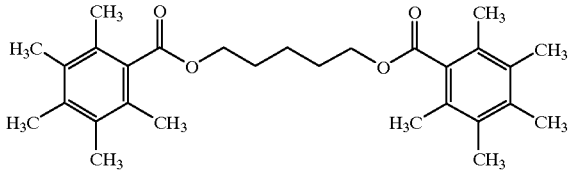

Next, a method of synthesizing the noncoloring compound represented by the general formula (a) is described. The compound can be easily synthesized according to a conventionally known ester synthesis method indicated below.

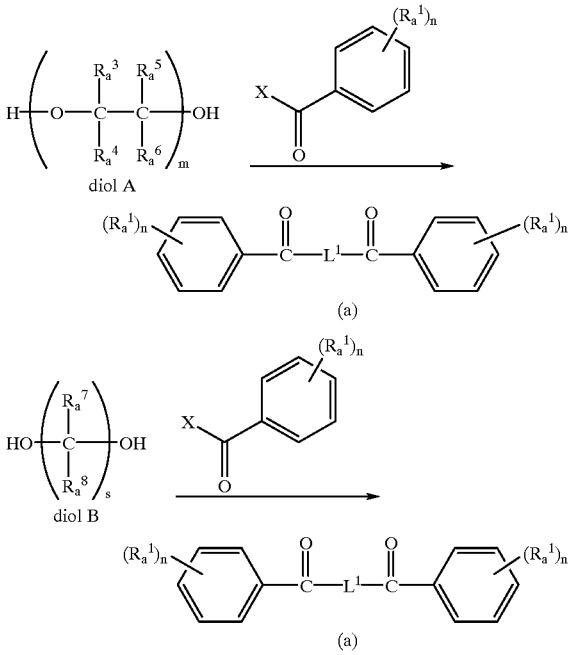

The compound represented by the general formula (a) can be synthesized by a reaction between a corresponding diol A or B and a benzoic acid derivative. $Ra^1$, $Ra^2$, $Ra^3$, $Ra^4$, $Ra^5$, $Ra^6$, $Ra^7$, $Ra^8$, m, s, and n in the formulae described above have the same respective meanings as in the general formula (a). $L^1$ is a group obtained by removing hydrogen atoms from a diol which is a corresponding starting material in the reaction scheme. X is a hydroxyl group, a halogen atom, or a group known as a leaving group in the field of organic synthesis. If Xis ahydroxyl group, it is preferable that an acid catalyst is used and water that becomes a byproduct is removed to the outside of the reaction system by azeotropy or the like. If X is a halogen atom, it is preferable that a base in an amount of one equivalent ore more for each ester bond is used.

In the reactions described above, a single benzoic acid derivative is used. However, if the esterification is carried out successively or two kinds of benzoic acid derivatives are used, an asymmetric ester can be synthesized.

Next, the general formula (b) is explained.

General formula (b)

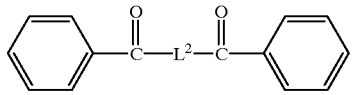

In the general formula (b), $L^2$ represents a group represented by the following general formula (b2), (b3), or (b4).

General formula (b2)

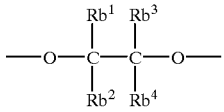

In the general formula (b2), $Rb^1$, $Rb^2$, $Rb^3$, and $Rb^4$ each independently represents a hydrogen atom or an unsubstituted alkyl group having 1 to 10 carbon atoms. The unsubstituted alkyl group having 1 to 10 carbon atoms may be a branched or straight-chain alkyl group. Examples of the alkyl group include such groups as methyl, ethyl, n-propyl, isopropyl, n-butyl, s-butyl, t-butyl, n-pentyl, isopentyl, n-hexyl, n-heptyl, n-octyl, n-nonyl, n-decyl, and 2-ethylhexyl. Preferably $Rb^1$, $Rb^2$, $Rb^3$, and $Rb^4$ are each a hydrogen atom or an unsubstituted alkyl group having 1 to 5 carbon atoms. More preferably $Rb^1$, $Rb^2$, $Rb^3$, and $Rb^4$ are each a hydrogen atom or an unsubstituted alkyl group having 1 to 3 carbon atoms. Particularly preferably $Rb^1$, $Rb^2$, $Rb^3$, and $Rb^4$ are each a hydrogen atom, a methyl group, an ethyl group, an isopropyl group, or an n-propyl group. The total number of carbon atoms of $Rb^1$, $Rb^2$, $Rb^3$, and $Rb^4$ is 5 or greater (preferably 5 to 20). Preferably the total number of carbon atoms is 6 or greater (preferably 6 to 10). Most preferably the total number of carbon atoms is 8 or greater (preferably 8 to 10).

General formula (b3)

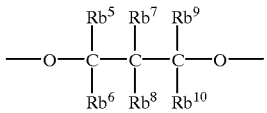

In the general formula (b3), $Rb^5$, $Rb^6$, $Rb^7$, $Rb^8$, $Rb^9$, and $Rb^{10}$ each independently represents a hydrogen atom or an unsubstituted alkyl group having 1 to 10 carbon atoms. Examples of the unsubstituted alkyl group include those listed in the explanation of $Rb^1$, $Rb^2$, $Rb^3$, and $Rb^4$. Preferably $Rb^5$, $Rb^6$, $Rb^7$, $Rb^8$, $Rb^9$, and $Rb^{10}$ are each a hydrogen atom or an unsubstituted alkyl group having 1 to 5 carbon atoms. More preferably $Rb^5$, $Rb^6$, $Rb^7$, $Rb^8$, $Rb^9$, and $Rb^{10}$ are each a hydrogen atom or an unsubstituted alkyl group having 1 to 3 carbon atoms. Particularly preferably $Rb^5$, $Rb^6$, $Rb^7$, $Rb^8$, $Rb^9$, and $Rb^{10}$ are each a hydrogen atom, a methyl group, an ethyl group, an isopropyl group, or an n-propyl group. The total number of carbon atoms of $Rb^5$, $Rb^6$, $Rb^7$, $Rb^8$, $Rb^9$, and $Rb^{10}$ is 6 or greater (preferably 6 to 20). Preferably the total number of carbon atoms is 7 or greater (preferably 7 to 10). Most preferably the total number of carbon atoms is 8 or greater (preferably 8 to 10).

General formula (b4)

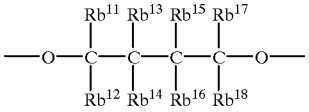

In the general formula (b4), $Rb^{11}$, $Rb^{12}$, $Rb^{13}$, $Rb^{14}$, $Rb^{15}$, $Rb^{16}$, $Rb^{17}$, and $Rb^{18}$ each independently represents a hydrogen atom or an unsubstituted alkyl group having 1 to 10 carbon atoms. Examples of the unsubstituted alkyl group include those listed in the explanation of $Rb^1$, $Rb^2$, $Rb^3$, and $Rb^4$. Preferably $Rb^{11}$, $Rb^{12}$ $Rb^{13}$, $Rb^{14}$, $Rb^{15}$, $Rb^{16}$, $Rb^{17}$, and $Rb^{18}$ are each a hydrogen atom or an unsubstituted alkyl group having 1 to 5 carbon atoms. More preferably $Rb^{11}$, $Rb^{12}$, $Rb^{13}$, $Rb^{14}$, $Rb^{15}$, $Rb^{16}$, $Rb^{17}$, and $Rb^{18}$ are each a hydrogen atom or an unsubstituted alkyl group having 1 to 3 carbon atoms. Particularly preferably $Rb^{11}$, $Rb^{12}$, $Rb^{13}$, $Rb^{14}$, $Rb^{15}$, $Rb^{16}$, $Rb^{17}$, and $Rb^{18}$ are each a hydrogen atom, a methyl group, an ethyl group, an isopropyl group, or an n-propyl group. The total number of carbon atoms of $Rb^{11}$, $Rb^{12}$, $Rb^{13}$, $Rb^{14}$, $Rb^{15}$, $Rb^{16}$, $Rb^{17}$, and $Rb^{18}$ is 2 or greater (preferably 2 to 20). Preferably the total number of carbon atoms is 3 or greater (preferably 3 to 10). Most preferably the total number of carbon atoms is 4 or greater (preferably 4 to 10).

The noncoloring compound represented by the general formula (b) does not form a dye by a coupling reaction with the oxidized form of a developing agent and therefore is a noncoloring compound. Accordingly, this noncoloring compound does not have a coupler residue in the molecular structure thereof.

The molecular weight of the noncoloring compound represented by the general formula (b) is preferably 800 or less, more preferably 700 or less, further more preferably 600 or less, and most preferably 500 or less. On the other hand, the molecular weight of the noncoloring compound represented by the general formula (b) is preferably 340 or more, more preferably 360 or more, and most preferably 370 or more. Particularly, if the molecular weight is specified by upper and lower limits, the molecular weight is preferably 340 to 800, more preferably 360 to 700, furthermore preferably 370 to 600, and most preferably 370 to 500.

Specific examples (i.e., exemplary compounds b-1 to b-28) of the noncoloring compound represented by the general formula (b) are given below. However, it should be noted that the present invention is not limited to these examples.

b-1

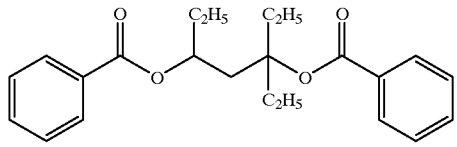

b-2

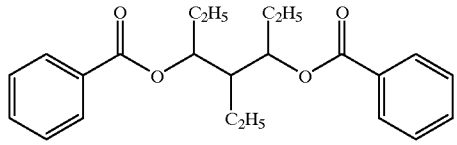

b-3

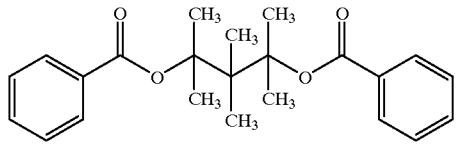

b-4

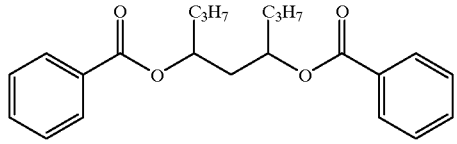

b-5

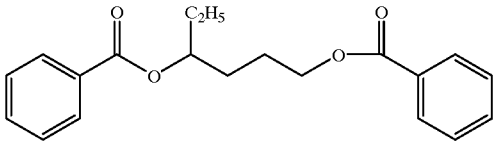

b-6

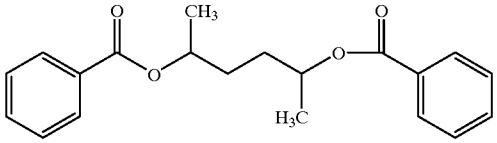

b-7

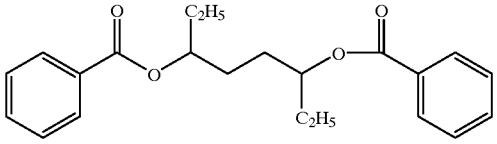

b-8

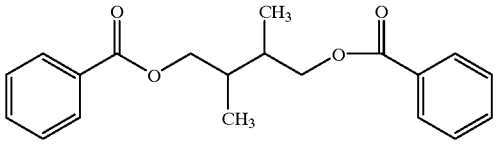

b-9

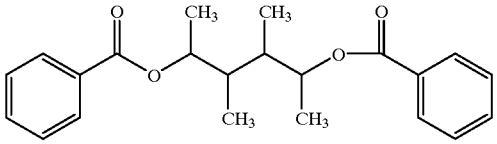

-continued
b-10
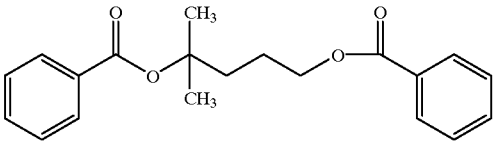
b-11
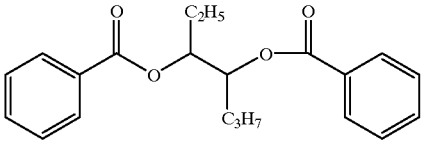
b-12
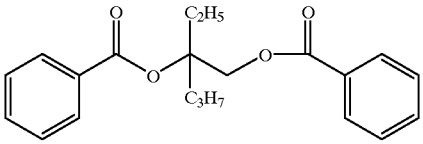
b-13
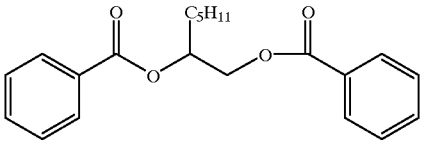
b-14
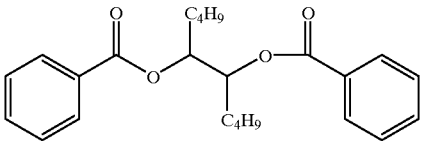
b-15
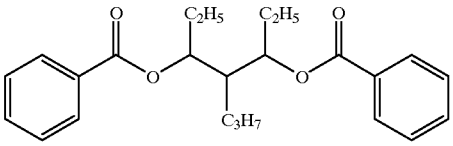
b-16
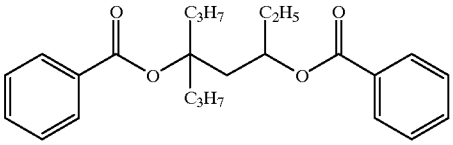
b-17
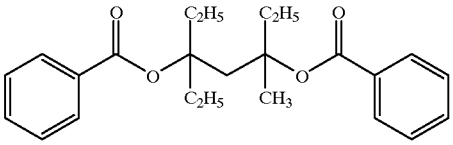
b-18
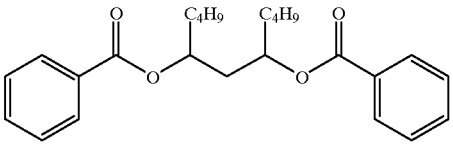
-continued
b-19
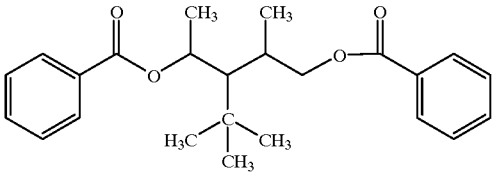
b-20
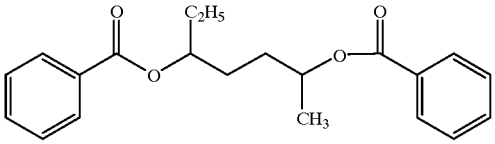
b-21
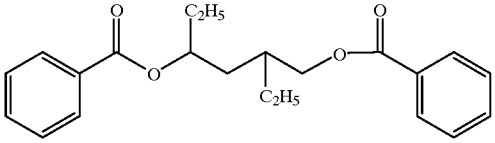
b-22
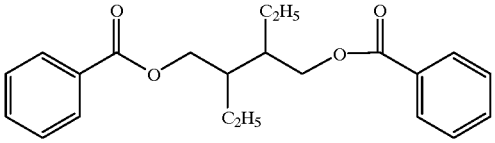
b-23
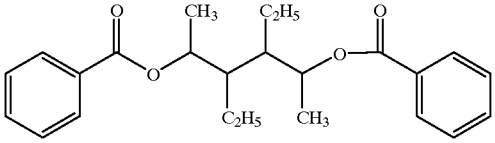
b-24
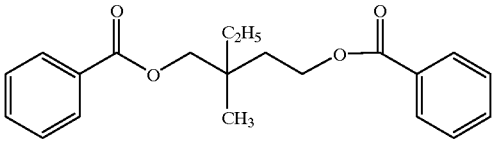
b-25
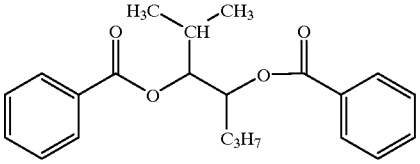
b-26
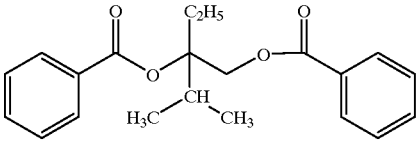
b-27
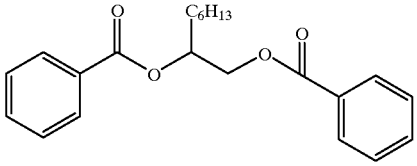

-continued b-28

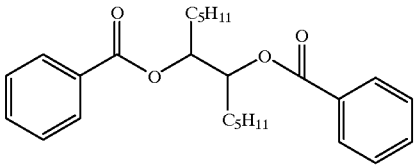

The noncoloring compound represented by the general formula (b) can be easily synthesized according to an ester synthesis method indicated below.

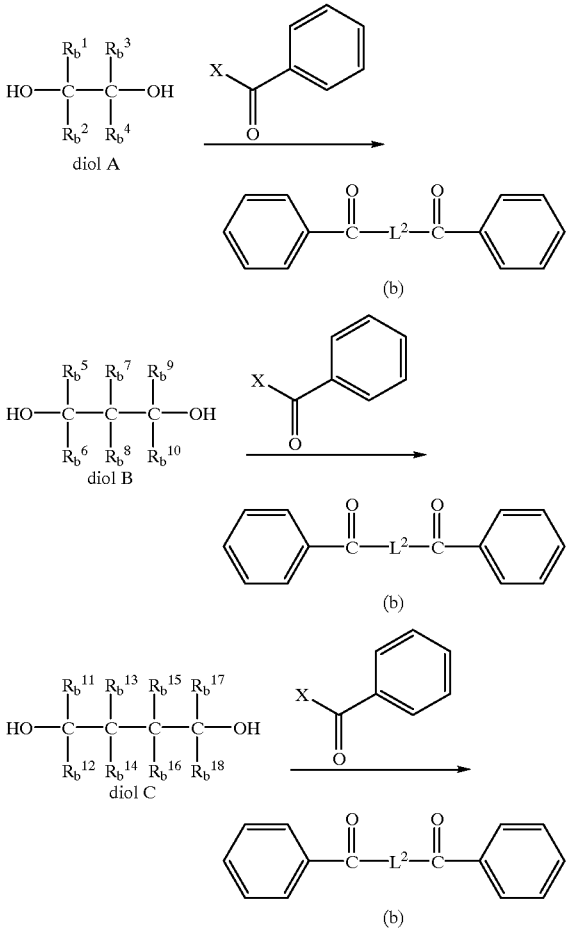

The compound represented by the general formula (b) can be synthesized by a reaction between a corresponding diol A, B, or C and a benzoic acid derivative. $Rb^1$ to $Rb^{18}$ in the formulae described above have the same respective meanings as in the general formulae (b), (b2), (b3), and (b4). $L^2$ is a group obtained by removing hydrogen atoms from a diol which is a corresponding starting material in each reaction scheme. X is a hydroxyl group, a halogen atom, or a group known as a leaving group in the field of organic synthesis. If X is a hydroxyl group, it is preferable that an acid catalyst is used and water that becomes a byproduct is removed to the outside of the reaction system by azeotropy or the like. If X is a halogen atom, it is preferable that a base in an amount of one equivalent ore more for each ester bond is used.

Next, a compound represented by the general formula (c) is explained.

General formula (c)

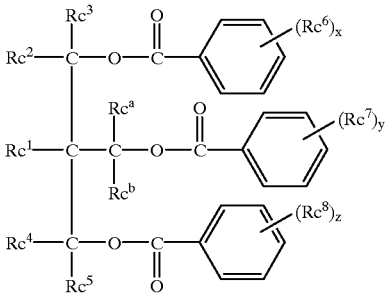

In the general formula (c), $Rc^1$ represents a hydrogen atom or an unsubstituted alkyl group having 1 to 10 carbon atoms. The unsubstituted alkyl group having 1 to 10 carbon atoms may be a branched or straight-chain alkyl group. Examples of the alkyl group include such groups as methyl, ethyl, n-propyl, isopropyl, n-butyl, s-butyl, t-butyl, n-pentyl, isopentyl, n-hexyl, n-heptyl, n-octyl, n-nonyl, n-decyl, and 2-ethylhexyl. Among these groups, a hydrogen atom, a methyl group, an ethyl group, an n-propyl group, an n-butyl group, and an n-pentyl groups are preferable.

$Rc^a$, $Rc^b$, $Rc^2$, $Rc^3$, $Rc^4$, $Rc^5$, $Rc^6$, $Rc^7$, and $Rc^8$ each independently represents a hydrogen atom or an unsubstituted alkyl group having 1 to 10 carbon atoms. Among these, a hydrogen atom or an unsubstituted alkyl group having 1 to 5 carbon atoms is preferable and a hydrogen atom or an unsubstituted alkyl group having 1 to 4 carbon atoms is more preferable.

Among $Rc^a$, $Rc^b$, $Rc^2$, $Rc^3$, $Rc^4$, and $Rc^5$, a hydrogen atom is preferable. Among $Rc^6$, $Rc^7$, and $Rc^8$, a hydrogen atom, a methyl group, an ethyl group, an isopropyl group, an n-propyl group, an n-butyl group, and the like are preferable.

x, y, and z each independently represents an integer of 0 to 5. It is preferable that x, y, and z each represents an integer of 0 to 2. It is more preferable that x, y, and z each represents 1. Further, it is preferable that $Rc^6$, $Rc^7$, and $Rc^8$ each represents the same group in view of manufacture and cost.

The upper limit of the molecular weight of the noncoloring compound represented by the general formula (c) is preferably 800 or less, and more preferably 700 or less. The lower limit of the molecular weight is preferably 450 or more, more preferably 480 or more, and most preferably 500 or more.

If the molecular weight is specified by upper and lower limits, the molecular weight is preferably 450 to 800, more preferably 480 to 800, further more preferably 500 to 800, and most preferably 500 to 700.

Specific examples (i.e., exemplary compounds c-1 to c-22) of the noncoloring compound represented by the general formula (c) are given below. However, it should be noted that the present invention is not limited to these examples.

c-1
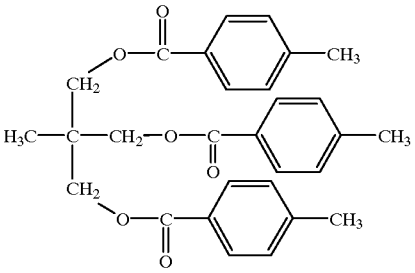
c-2
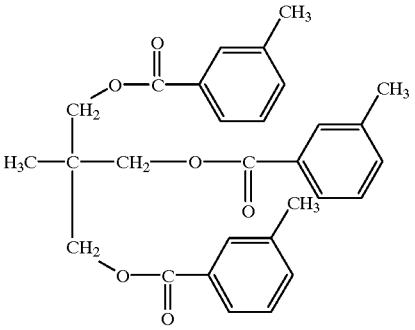
c-3
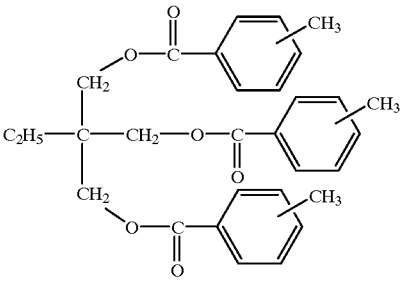
c-4
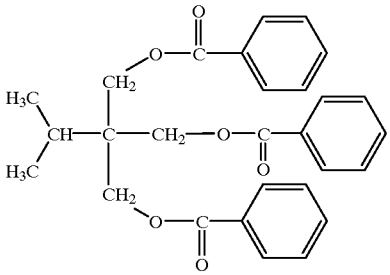
c-5
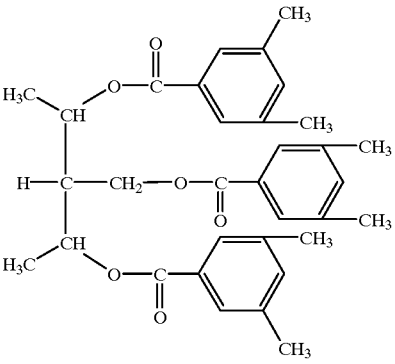
-continued
c-6
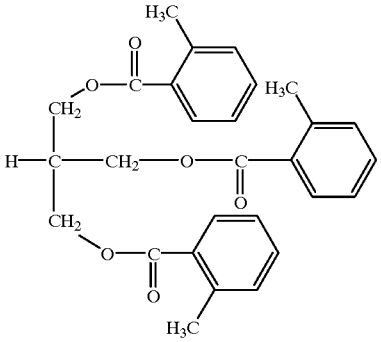
c-7
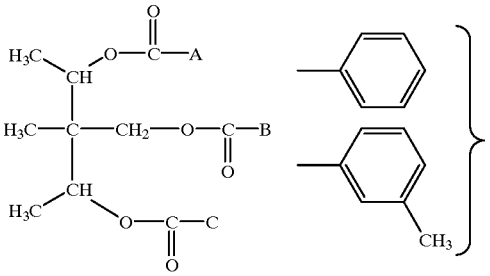
c-8
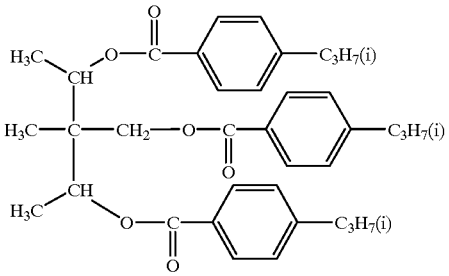
c-9
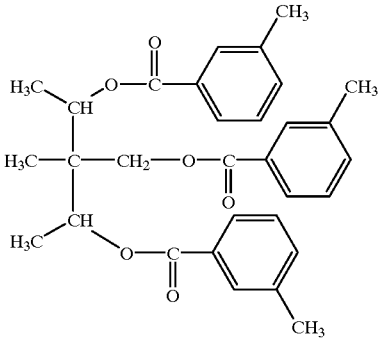
c-10
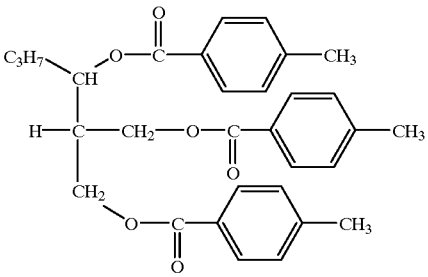

-continued
c-11
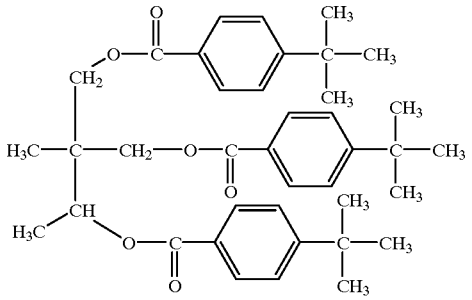
c-12
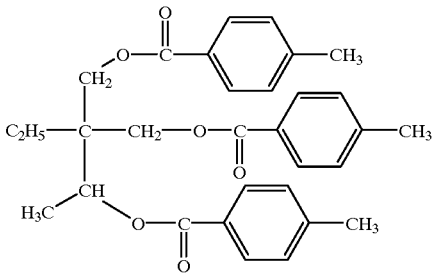
c-13
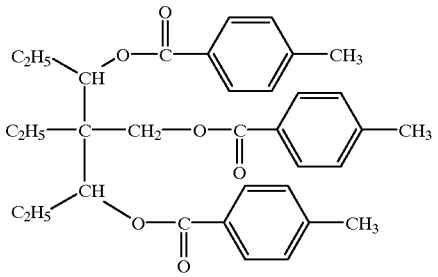
c-14
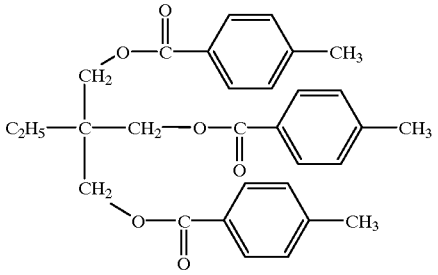
c-15
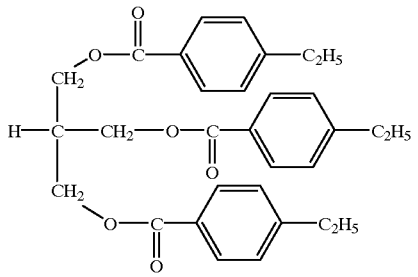
-continued
c-16
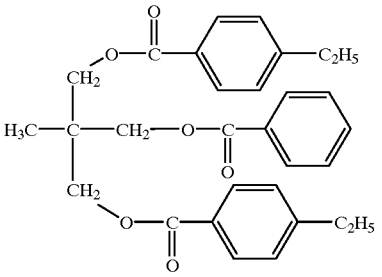
c-17
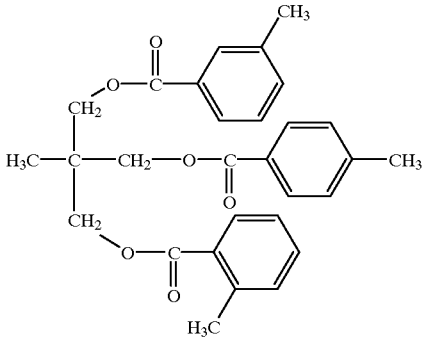
c-18
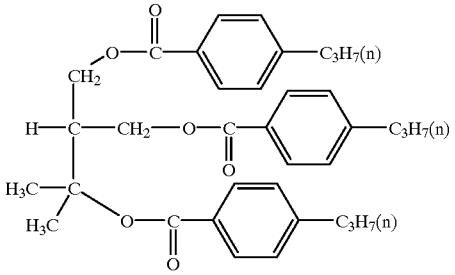
c-19
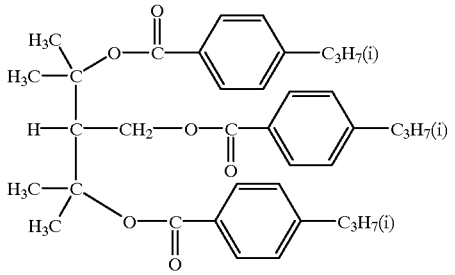
c-20
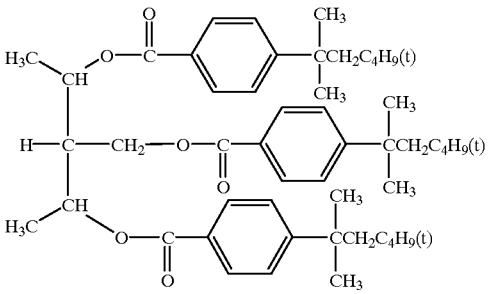

-continued c-21

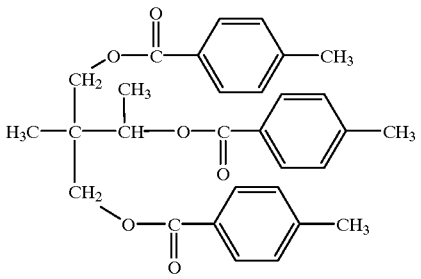

c-22

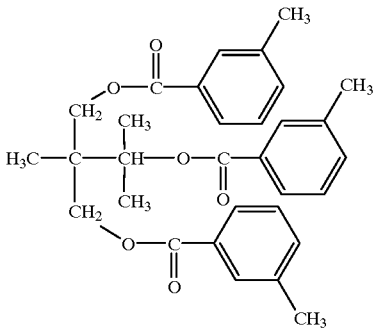

Next, a method of synthesizing the noncoloring compound represented by the general formula (c) is described. The compound can be easily synthesized according to a conventionally known ester synthesis method indicated below.

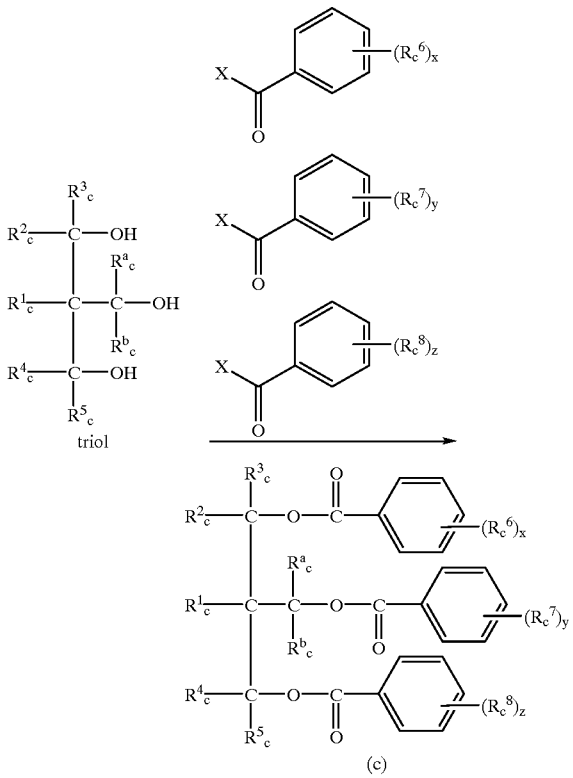

The compound represented by the general formula (c) can be synthesized by a reaction between a corresponding triol and benzoic acid derivatives. $Rc^1$ to $Rc^8$, $Rc^a$, $Rc^b$, x, y, and z in the reaction formulae described above have the same respective meanings as in the general formula (c). X is a hydroxyl group, a halogen atom, or a group known as a leaving group in the field of organic synthesis. If X is a hydroxyl group, it is preferable that an acid catalyst is used and water that becomes a byproduct is removed to the outside of the reaction system by azeotropy or the like. If X is a halogen atom, it is preferable that a base in an amount of one equivalent ore more for each ester bond is used.

The example described above indicates a reaction in which 3 kinds of compounds are used as benzoic acid derivatives. But the reaction may be carried out using 2 kinds of benzoic acid derivatives or using one kind of benzoic acid derivative.

Next, a compound represented by the general formula (d) is explained.

General formula (d)

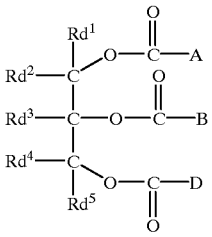

General formula (d2)

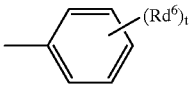

In the general formula (d), A, B, and D each independently represents an unsubstituted alkyl group having 1 to 10 carbon atoms or a group represented by the general formula (d2).

The unsubstituted alkyl group having 1 to 10 carbon atoms represented by A, B, or D may be a branched or straight-chain alkyl group. Specific examples of the alkyl group include such groups as methyl, ethyl, n-propyl, isopropyl, n-butyl, s-butyl, t-butyl, n-pentyl, isopentyl, n-hexyl, n-heptyl, n-octyl, n-nonyl, n-decyl, and 2-ethylhexyl.

Among these groups A, B, and D, an unsubstituted alkyl group having 1 to 5 carbon atoms is preferable and an unsubstituted alkyl group having 1 to 3 carbon atoms is more preferable.

In the general formula (d), $Rd^1$, $Rd^2$, $Rd^3$, $Rd^4$, and $Rd^5$ each independently represents a hydrogen atom or an unsubstituted alkyl group having 1 to 10 carbon atoms.

Examples of the unsubstituted alkyl group having 1 to 10 carbon atoms include those listed in the explanation of A, B, and D. Among $Rd^1$, $Rd^2$, $Rd^3$, $Rd^4$, and $Rd^5$, a hydrogen atom or an unsubstituted alkyl group having 1 to 5 carbon atoms is preferable and a hydrogen atom or an unsubstituted alkyl group having 1 to 3 carbon atoms is more preferable.

In the general formula (d2), $Rd^6$ represents an unsubstituted alkyl group having 1 to 10 carbon atoms. Examples of the unsubstituted alkyl group having 1 to 10 carbon atoms include those listed in the explanation of A, B, and D. Among $Rd^6$, an unsubstituted alkyl group having 1 to 5 carbon atoms is preferable and an unsubstituted alkyl group having 1 to 3 carbon atoms is more preferable.

In the general formula (d2), t represents an integer of 0 to 5. If t is 2 or greater, the $Rd^6$s may be the same as or different from each other. Among t, 0, 1, or 2 is preferable and 0 or 1 is more preferable.

In the general formulae (d) and (d2), at least one of $Rd^1$, $Rd^2$, $Rd^3$, $Rd^4$, $Rd^5$, and $Rd^6$ is an unsubstituted alkyl group having 1 to 10 carbon atoms. At least two of A, B, and D are each a group represented by the general formula (d2). Preferably all of A, B, and D are each a group represented by the general formula (d2).

If all of A, B, and D are each a group represented by the general formula (d2) and t is 0, the total number of carbon atoms of $Rd^1$, $Rd^2$, $Rd^3$, $Rd^4$, and $Rd^5$ is 3 or greater.

Among the structures represented by the general formula (d), it is preferable that all of A, B, and D are each a group represented by the general formula (d2); $Rd^1$, $Rd^2$, $Rd^3$, $Rd^4$, and $Rd^5$ are each independently a hydrogen atom or an unsubstituted alkyl group having 1 to 3 carbon atoms; t is 0 or 1; $Rd^6$ is an unsubstituted alkyl group having 1 to 3 carbon atoms; and at least one of $Rd^1$, $Rd^2$, $Rd^3$, $Rd^4$, $Rd^5$, and $Rd^6$ is an unsubstituted alkyl group having 1 to 3 carbon atoms, with the proviso that the total number of carbon atoms of $Rd^1$, $Rd^2$, $Rd^3$, $Rd^4$, and $Rd^5$ is preferably 3 or greater if each t is 0.

Among the preferred structures described above, it is more preferable that all of A, B, and D are each a group represented by the general formula (d2); $Rd^1$, $Rd^2$, $Rd^3$, $Rd^4$, and $Rd^5$ are each independently a hydrogen atom or alternatively a methyl group, an ethyl group, or an n-propyl group; t is 0 or 1; $Rd^6$ is a methyl group, an ethyl group, or an n-propyl group; and at least one of $Rd^1$, $Rd^2$, $Rd^3$, $Rd^4$, $Rd^5$, and $Rd^6$ is a methyl group, an ethyl group, or an n-propyl group, with the proviso that the total number of carbon atoms of $Rd^1$, $Rd^2$, $Rd^3$, $Rd^4$, and $Rd^5$ is preferably 3 or greater if each t is 0.

Among the more preferred structures described above, it is particularly preferable that all of A, B, and D are each a group represented by the general formula (d2); $Rd^1$, $Rd^2$, $Rd^3$, $Rd^4$, and $Rd^5$ are each independently a hydrogen atom or a methyl group; t is 0 or 1; $Rd^6$ is a methyl group; and at least one of $Rd^1$, $Rd^2$, $Rd^3$, $Rd^4$, $Rd^5$, and $Rd^6$ is a methyl group, with the proviso that the total number of carbon atoms of $Rd^1$, $Rd^2$, $Rd^3$, $Rd^4$, and $Rd^5$ is particularly preferably 3 or greater.

Among the particularly preferred structures described above, one of the most preferred structures is such that all of A, B, and D are each a group represented by the general formula (d2); t is 0; $Rd^1$, $Rd^2$, $Rd^3$, $Rd^4$, and $Rd^5$ are each independently a hydrogen atom or a methyl group; and at least one of $Rd^1$, $Rd^2$, $Rd^3$, $Rd^4$, $Rd^5$, and $Rd^6$ is a methyl group, with the proviso that the total number of carbon atoms of $Rd^1$, $Rd^2$, $Rd^3$, $Rd^4$, and $Rd^5$ is particularly preferably 3 or greater.

Another of the most preferred structures is such that all of A, B, and D are each a group represented by the general formula (d2); t is 1; $Rd^1$, $Rd^2$, $Rd^3$, $Rd^4$, and $Rd^5$ are each independently a hydrogen atom or a methyl group; and $Rd^6$ is a methyl group, with the proviso that all of A, B, and D are preferably the same.

The molecular weight of the noncoloring compound represented by the general formula (d) is preferably 400 or more and 800 or less, more preferably 410 or more and 700 or less, and particularly preferably 430 ormore and 600 or less.

Specific examples (i.e., exemplary compounds d-1 to d-37) of the noncoloring compound represented by the general formula (d) are given below. However, it should be noted that the present invention is not limited to these examples.

d-1

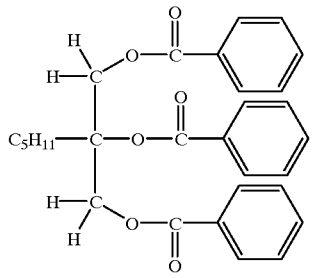

d-2

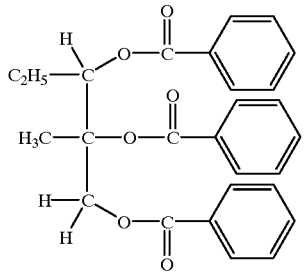

d-3

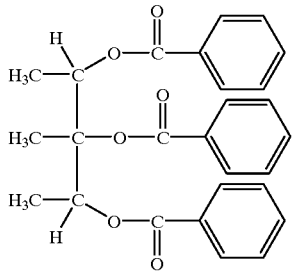

d-4

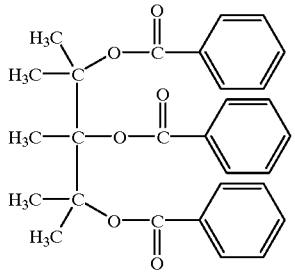

d-5

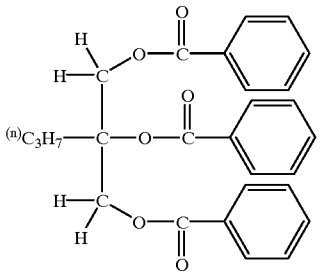

-continued
d-6
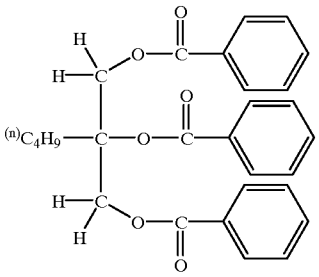
d-7
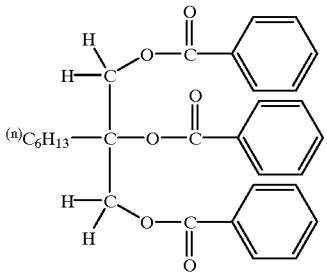
d-8
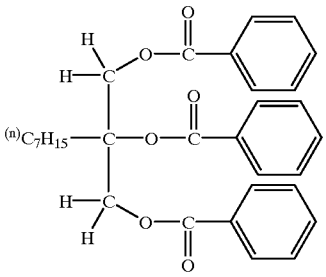
d-9
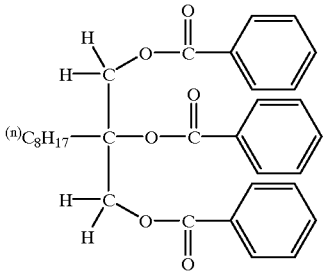
d-10
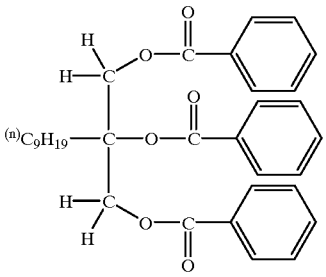
-continued
d-11
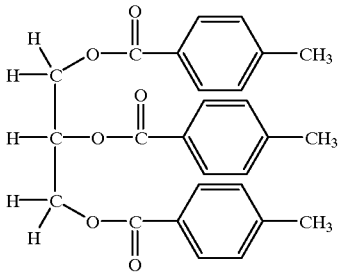
d-12
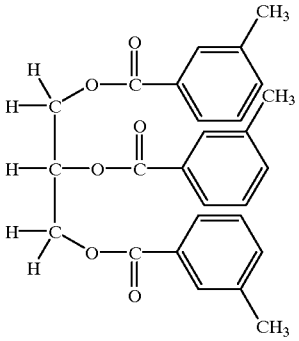
d-13
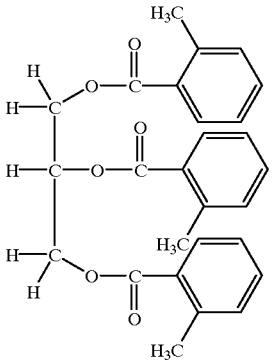
d-14
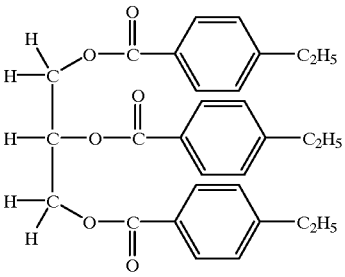
d-15
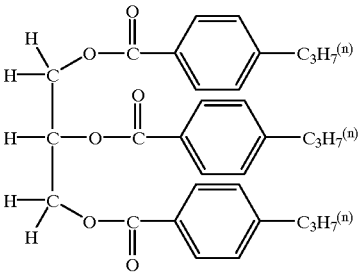

-continued
d-16
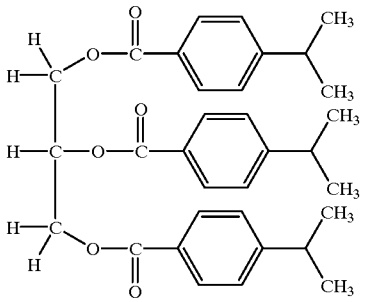
d-17
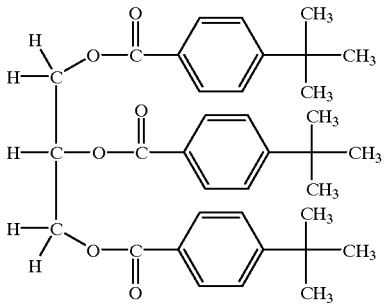
d-18
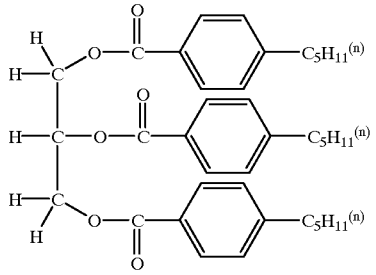
d-19
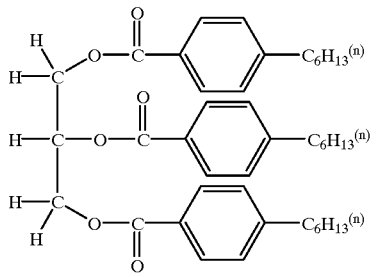
d-20
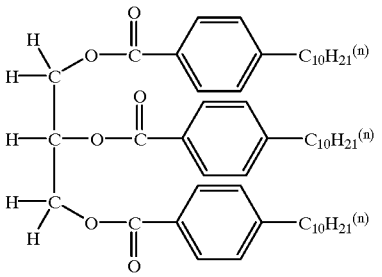
-continued
d-21
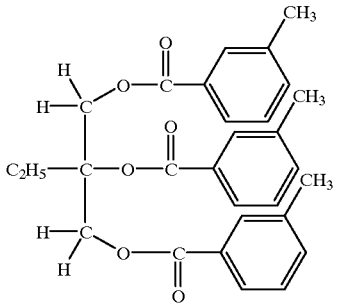
d-22
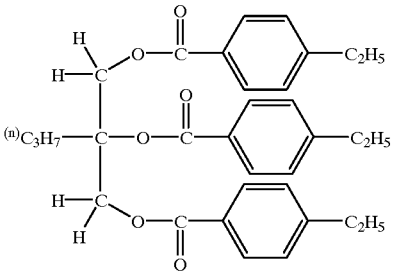
d-23
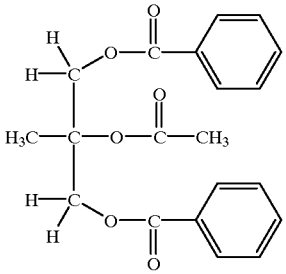
d-24
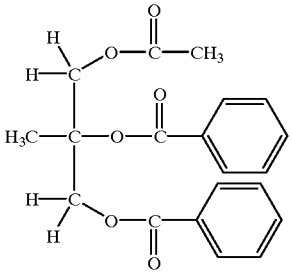
d-25
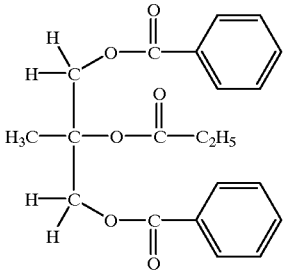

-continued
d-26
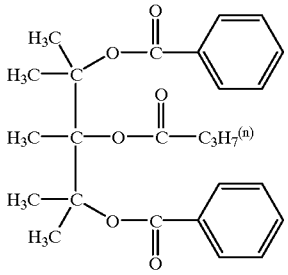
d-27
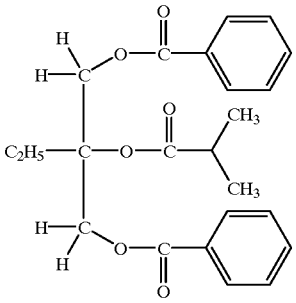
d-28
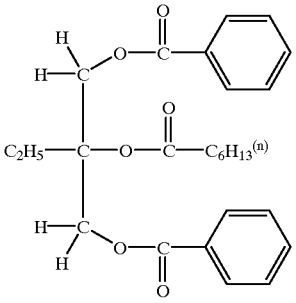
d-29
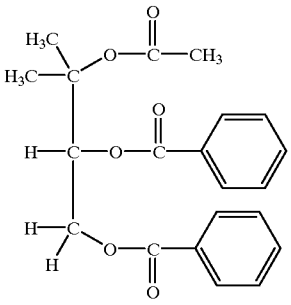
d-30
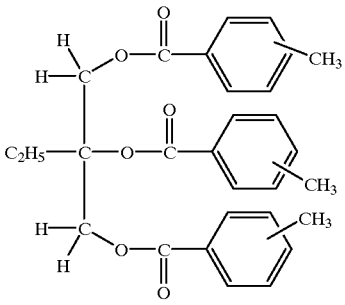
-continued
d-31
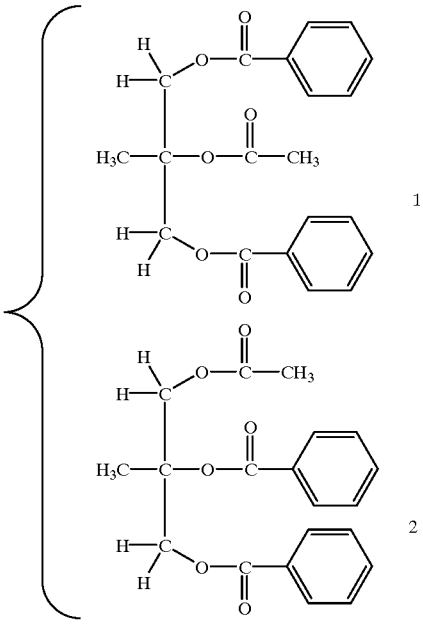
1
2
d-32
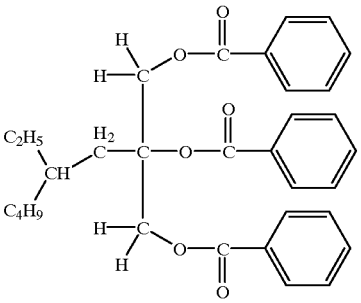
d-33
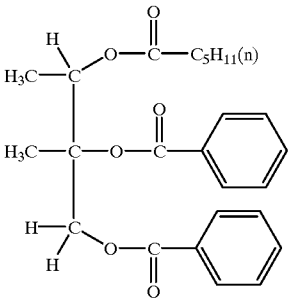
d-34
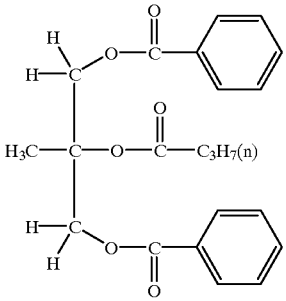

-continued d-35

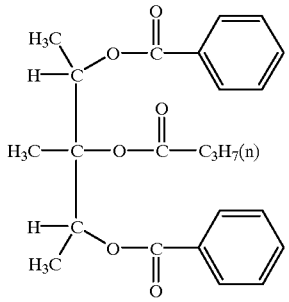

d-36

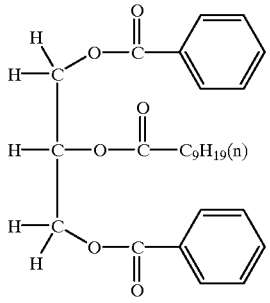

d-37

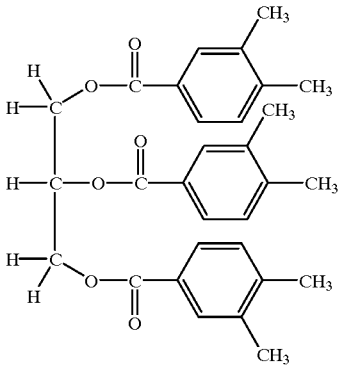

The compound represented by the general formula (d) can be easily synthesized according to a conventionally known ester synthesis method indicated below:

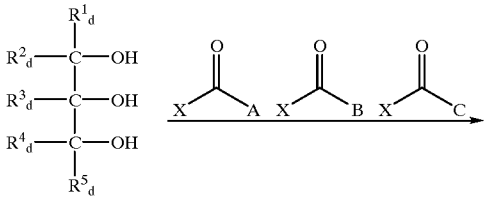

-continued

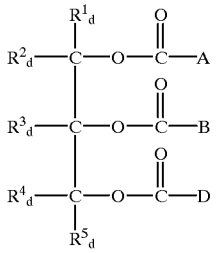

(d)

The compound represented by the general formula (d) can be synthesized by a reaction between a corresponding triol and carboxylic acid derivatives having partial structures A, B, and D.

$Rd^1$, $Rd^2$, $Rd^3$, $Rd^4$, $Rd^5$, A, B, and D in the general formulae in the synthesis scheme described above have the same respective meanings as in the general formula (d).

X in the general formulae in the synthesis scheme is a hydroxyl group, a halogen atom, or a group known as a leaving group in the field of organic synthesis. If X is a hydroxyl group, it is preferable that an acid catalyst is used and water that becomes a byproduct is removed to the outside of the reaction system by azeotropy or the like. If X is a halogen atom, it is preferable that a base in an amount of one equivalent ore more for each ester bond is used.

The synthesis scheme described above shows an example in which 3 kinds of compounds are used as carboxylic acid derivatives. But the reaction may be carried out using 2 kinds of carboxylic acid derivatives or using one kind of carboxylic acid derivative.

The noncoloring compounds represented by the general formulae (a) to (d) do not form a dye by a coupling reaction with the oxidized form of a developing agent and therefore are noncoloring compounds. Accordingly, these noncoloring compounds do not have a coupler residue in the molecular structures thereof.

The amount to be used of the compound represented by any of the general formulae (a) to (d) may vary according to purpose. The amount to be used is preferably 0.2 mg to 20 g, more preferably 1 mg to 5 g, based on 1 $m^2$ of the photosensitive material. Further, the ratio by mass of the compound to a photographically useful reagent such as a coupler is generally in the range of 0.1 to 10 and preferably in the range of 0.1 to 2.

The ratio by mass of the compound represented by any of the general formulae (a) to (d) to the dispersing medium of a dispersion containing a photographically useful reagent such as a coupler is preferably within the range of 4 to 0.1 and more preferably within the range of 1.0 to 0.2.

Examples of the photographically useful reagents excluding a coupler include a photo-fading inhibitor, a dark-heat fading inhibitor, a stain inhibitor, a color mixing preventive, a UV absorbing agent, a dye (e.g., for irradiation inhibition or halation inhibition), a compound which releases a photographically useful compound at the time of processing (e.g., a so-called blocked compound, DIR hydroquinone, dye-releasing redox compound, or the like), and so on.

Examples of the dispersing medium include gelatin that is a typical dispersing medium and a hydrophilic polymer such as polyvinyl alcohol. Further, various compounds may be incorporated according to purposes besides the above-mentioned photographically useful compounds.

Compounds represented by the general formulae (a) to (d) may be used singly or in combinations of two or more. Where two or more of the compounds are used in combination, it is preferable to use a mixture of position isomers (e.g., a mixture of position isomers with respect to $Ra^1$ and $Ra^2$ in the general formula (a)) from the standpoint of solubility.

The compounds represented by the general formulae (a) to (d) can be added to a silver halide photosensitive material in the same way as in the addition of a conventionally known high-boiling-point solvent to a silver halide photosensitive material.

The compound represented by any of the general formulae (a) to (d) maybe added to any hydrophilic colloid layer to which a photographically useful compound will be added. Preferably the compound is added to at least one hydrophilic colloid layer. More specifically the compound is added to at least one layer selected from a non-photosensitive layer, a red-sensitive emulsion layer, a green-sensitive emulsion layer, and a blue-sensitive emulsion layer.

The compounds represented by the general formulae (a) to (d) maybe used in combinations with conventionally known high-boiling-point organic solvents that are out of the scope defined by the general formulae (a) to (d). Where these conventionally known high-boiling-point organic solvents are also used, the ratios by mass of compounds represented by the general formulae (a) to (d) to the total of the high-boiling-point organic solvents are preferably 10% or more and more preferably 30% or more up to 100%.

Examples ((1) to (153)) of the conventionally known high-boiling-point organic solvents that can be used together with the compounds represented by the general formulae (a) to (d) are given below:

| | $O{=}P(\text{—}OAr)_3$ |
|---|---|
| | Ar = |
| (1) | 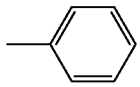 |
| (2) | 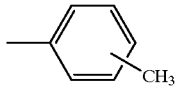 |
| (3) | 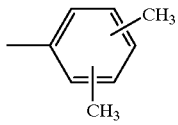 |
| (4) | 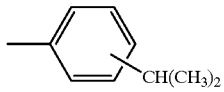 |
| (5) | 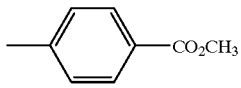 |
| (6) | $\text{-n-}C_4H_9$ |
| (7) | $\text{-n-}C_6H_{13}$ |
| (8) | $\text{—}CH_2CH(C_2H_5)CH_2CH_2CH_2CH_3$ (hereinafter abbreviated as 2EH) |
| (9) | $\text{—}CH_2CH(CH_3)CH_2C(CH_3)_3$ |
| (10) | $\text{-n-}C_{12}H_{25}$ |
| (11) | $\text{—}(CH_2)_8CH{=}CH(CH_2)_7CH_3$ |
| (12) | $\text{-n-}C_{16}H_{33}$ |
| (13) | $\text{—}CH(CH_3)CH_2Cl$ |
| (14) | $\text{—}CH_2CH_2Cl$ |
| (15) | $\text{—}CH_2CH_2O\text{-n-}C_4H_9$ |
| (16) | $\text{—}CH_2CHClCH_2Cl$ |
| (17) | $\text{—}CH(CH_2Cl)_2$ |
| (18) | $\text{—}CH_2C(CH_2Br)_3$ |
| (19) | 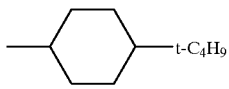 |

-continued
(20)
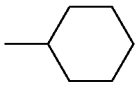
(21)
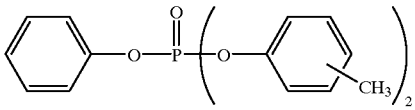
(22)
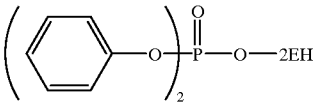
(23)
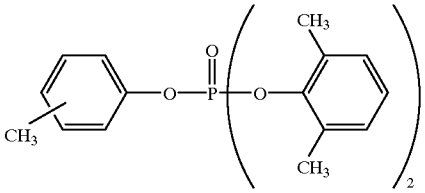
RA—OCO($CH_2$)$_r$—$CO_2$RA
| | RA= | r = |
|---|---|---|
| (24) | -n-$C_8H_{17}$ | 7 |
| (25) | —$CH_3$ | 8 |
| (26) | -n-$C_4H_9$ | 8 |
| (27) | -n-$C_8H_{17}$ | 8 |
| (28) | -n-$C_8H_{17}$ | 4 |
| (29) | -i-$C_9H_{19}$ | 4 |
| (30) | -n-$C_4H_9$ | 4 |
| (31) | —$CH(CH_3)_2$ | 4 |
| (32) | -2EH | 4 |
| (33) | —$C_{10}H_{21}$ | 4 |
| (34) | —$CH_2CH_2OCH_2CH_2O$-n-$C_4H_9$ | 4 |
(35)
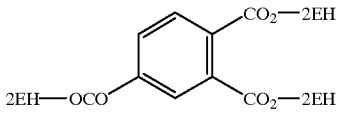
(36)
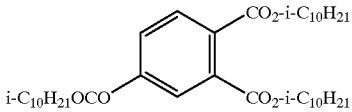
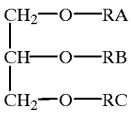
| | RA= | RB= | RC= |
|---|---|---|---|
| (37) | —$COCH_3$ | —$COCH_3$ | —CO-n-$C_{13}H_{27}$ |
| (38) | —$COCH_3$ | —$COCH_3$ | —CO-n-$C_{15}H_{31}$ |
| (39) | —$COCH_3$ | —$COCH_3$ | —CO-n-$C_{17}H_{35}$ |
| (40) | —$COCH_3$ | —H | —CO-n-$C_{17}H_{35}$ |
| (41) | —CO-n-$C_9H_{19}$ | —CO-n-$C_9H_{19}$ | —CO-n-$C_9H_{19}$ |
| (42) | H | H | —CO-n-$C_{13}H_{27}$ |
| (43) | H | H | —CO-n-$C_{15}H_{31}$ |
| (44) | H | H | —CO-n-$C_{17}H_{35}$ |
| (45) | H | H | —CO-n-$C_{17}H_{33}$ oleyl |

-continued
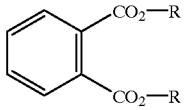
R=
(46) -n-$C_4H_9$
(47) -i-$C_7H_{15}$
(48) -2EH
(49) -n-$C_{12}H_{25}$
(50) —$C(C_2H_5)_3$
(51)
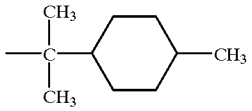
(52)
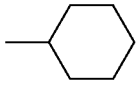
(53)
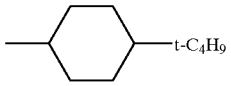
(54) -n-$C_8H_{17}$
(55) —$CH_2CH_2CH(CH_3)CH_2CH_2CH_2CH(CH_3)_2$
(56) -i-$C_{10}H_{21}$
(57) -i-$C_9H_{19}$
(58) -i-$C_{11}H_{23}$
(59) -n-$C_5H_{11}$
(60) -n-$C_6H_{13}$
(61) -n-$C_3H_7$
(62)
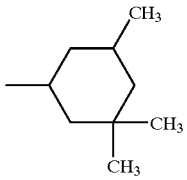
(63)
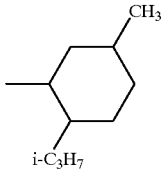
(64) —$CH_2CH_2O$-n-$C_4H_9$
(65)
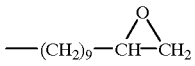
(66) —$CH_2CF_2CF_2CF_2CF_2H$
(67)
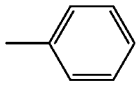

-continued
(68)
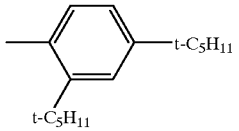
(69)
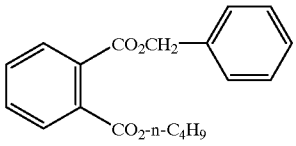
(70)
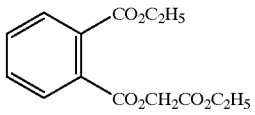
(71) $n\text{-}C_{17}H_{35}CO_2\text{-}n\text{-}C_4H_9$
(72) $n\text{-}C_5H_{11}CO_2(CH_2)_3OCO\text{-}n\text{-}C_5H_{11}$
(73)
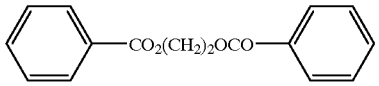
(74) $CH_3CO_2C(CH_2CO_2\text{-}n\text{-}C_4H_9)_3$
(75) $CH_3(CH_2)_5CH(OCOCH_3)CH_2CH{=}CH(CH_2)_7CO_2CH_3$
(76) $CH_3(CH_2)_5CH(OCOCH_3)CH_2CH{=}CH(CH_2)_7CO_2\text{-}n\text{-}C_4H_9$
(77) $n\text{-}C_4H_9OCO(CH_2)_6CO_2CH_2CO_2\text{-}n\text{-}C_4H_9$
(78)
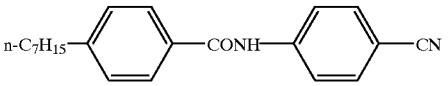
(79)
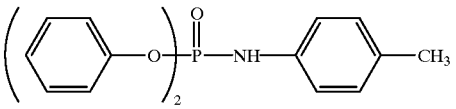
(80)
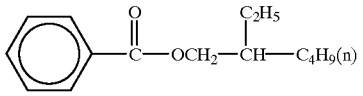
(81)
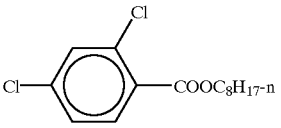
(82)
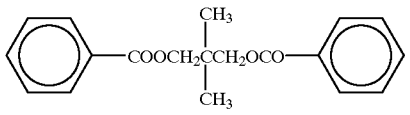
(83)
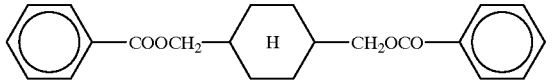

-continued
(84)
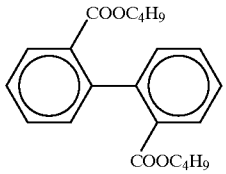
(85) $n\text{-}C_{15}H_{31}COOC_{16}H_{33}\text{-}n$
(86)
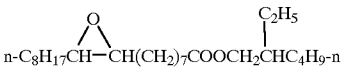
(87)
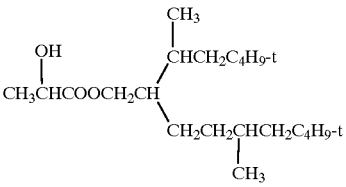
(88)
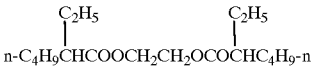
(89)
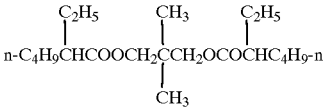
(90)
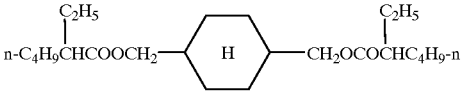
(91)
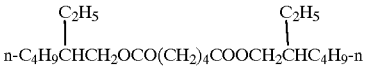
(92)
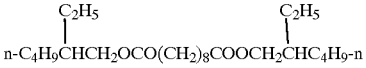
(93)
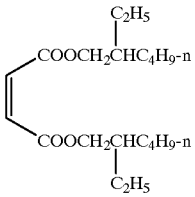
(94)
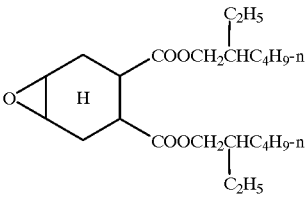
(95)
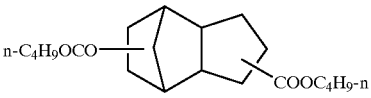

-continued
(96)
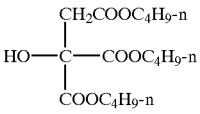
(97)
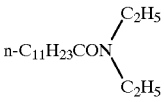
(98)
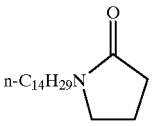
(99)
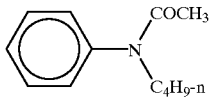
(100)
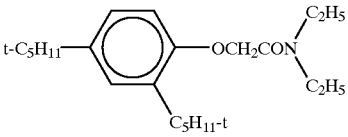
(101)
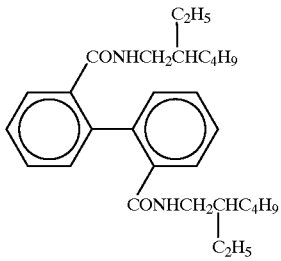
(102)
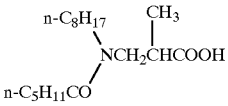
(103)
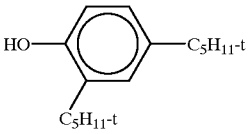
(104)
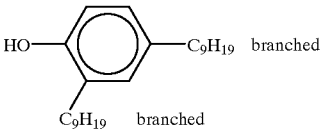
(105)
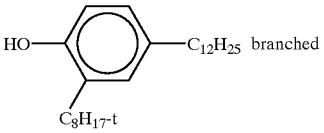

-continued
(106)
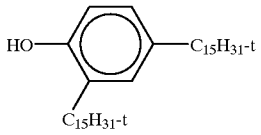
(107)
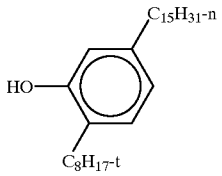
(108)
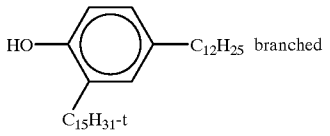
(109)
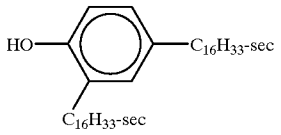
(110)
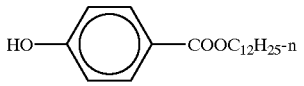
(111)
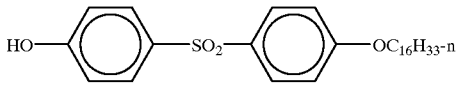
(112)
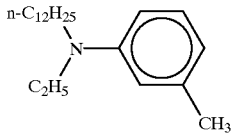
(113)
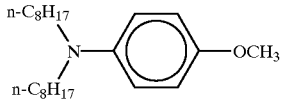
(114)
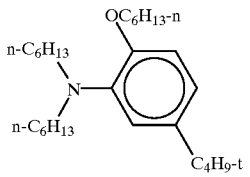
(115)
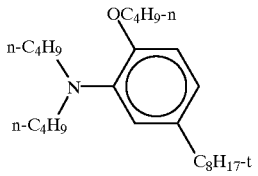
(116) average molecular weight: 20,000

-continued
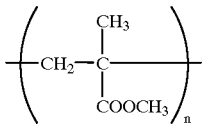
(117) average molecular weight: 50,000
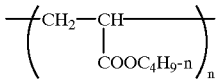
(118) average molecular weight: 60,000
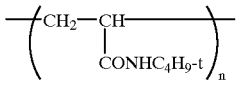
(119) average molecular weight: 40,000
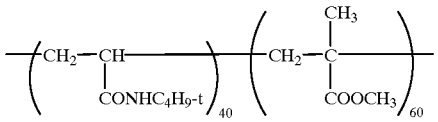
(120)
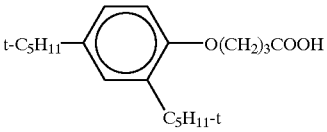
(121)
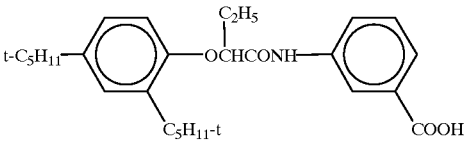
(122)
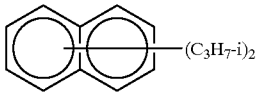
(123) $C_nH_{2n+2}$
a mixture of normal paraffins
(124)
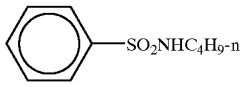
having n =14 and n = 15
(125)
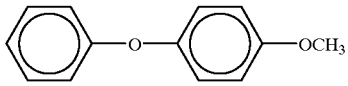
(126)
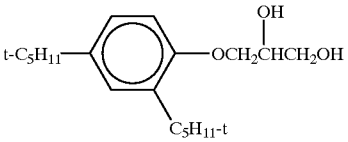
(127) chlorinated paraffin
(average composition: $C_{14}H_{24}Cl_{16}$)
(128) chlorinated paraffin -continued
(average composition: $C_{12}H_{18}Cl_8$)
(129) poly(chlorotrifluoroethylene)
(average molecular weight: 900)
(130)
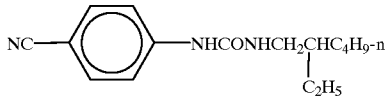
(131)
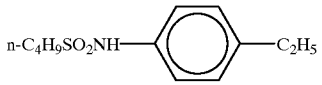
(132)
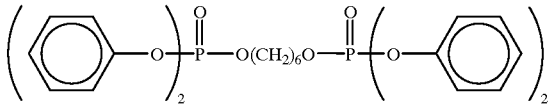
(133) n-$C_{16}H_{33}$—OH
(134) $C_8H_{17}CH{=}CH(CH_2)_8$—OH
(135)
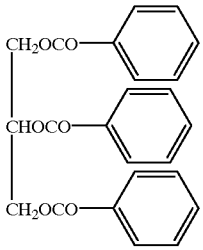
(136)
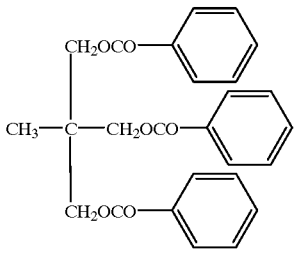
(137)
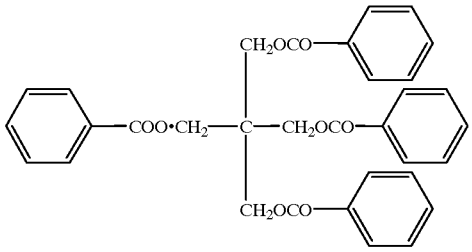
(138)
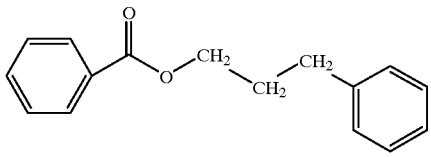

-continued
(139)
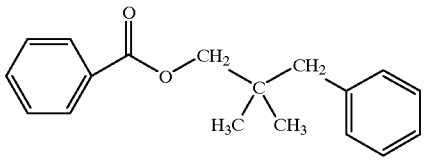
(140)
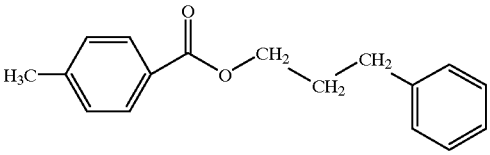
(141)
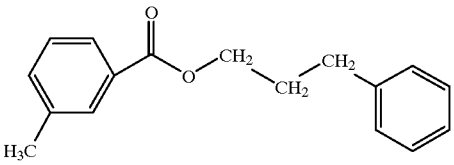
(142)
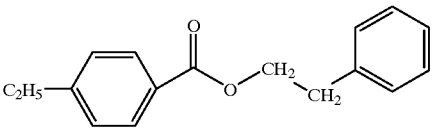
(143)
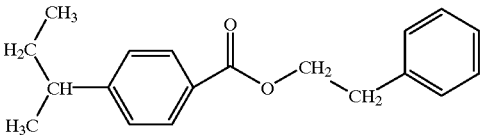
(144)
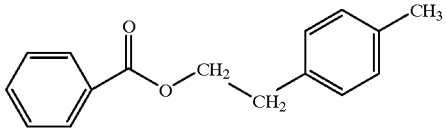
(145)
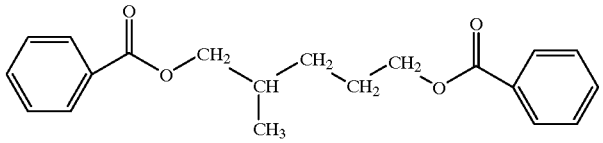
(146)
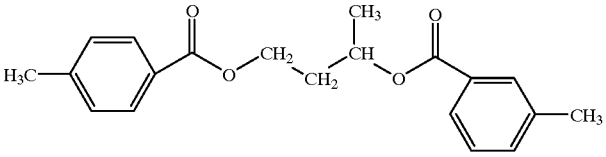
(147)
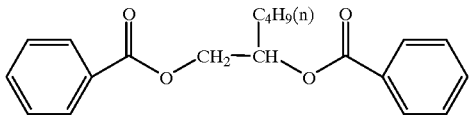

-continued (148)

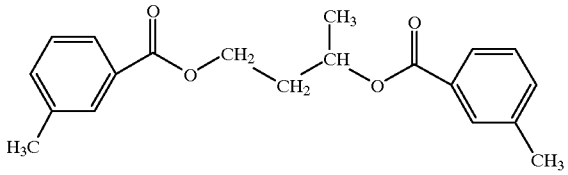

(149)

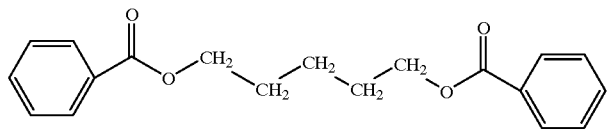

(150)

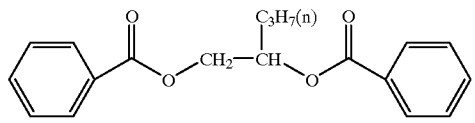

(151)

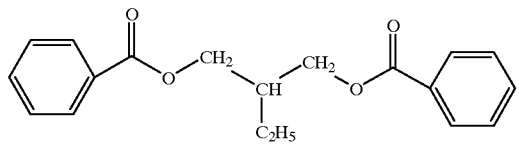

(152)

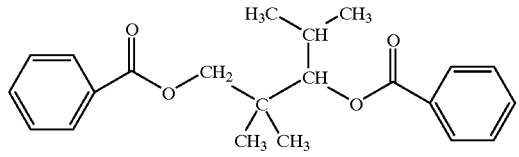

(153)

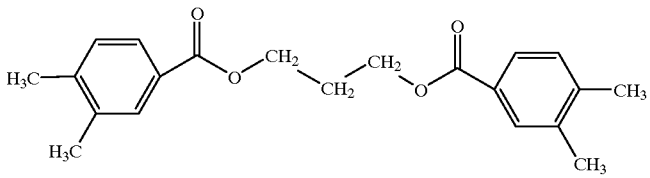

The silver halide photosensitive material in the present embodiment can be made by coating on a support as a photosensitive layer at least one yellow-developing silver halide emulsion layer, at least one magenta-developing silver halide emulsion layer, and at least one cyan-developing silver halide emulsion layer. For example, in a color print paper for general use, a subtractive-process color reproduction can be carried out by the incorporation of a color coupler designed to form a dye whose color is complementary to the light to which the silver halide emulsion is sensitive.

It is preferable that the noncoloring compound represented by any of the formulae (a) to (d) is added, together with a photographically useful compound, to any hydrophilic colloid layer. The layer, which contains the compound represented by any of the formulae (a) to (d), may be a photosensitive layer or a non-photosensitive layer. For example, if the silver halide photosensitive material of the present invention is a photosensitive material for full-color image formation, the noncoloring compound represented by any of the formulae (a) to (d) is added to at least one layer selected from a non-photosensitive layer, a red-sensitive emulsion layer, a green-sensitive emulsion layer, and a blue-sensitive emulsion layer.

Each photosensitive layer is formed by coating on a support a coating liquid prepared by dispersing a silver halide emulsion containing silver halide grains and an emulsion containing a hydrophobic compound (i.e., a photographically useful compound) such as a coupler in a binder such as gelatin. Likewise, a non-photosensitive layer is formed by coating, for example, on a support a coating liquid prepared by dispersing an emulsion containing a photographically useful compound such as a UV absorbing agent or a color mixing preventive in a binder such as gelatin. The compound represented by any of the formulae (a) to (d) can be used as a high-boiling-point organic solvent for use in the preparation of the emulsions described above. The use of this compound makes it possible to prepare a silver halide photosensitive material capable of producing durable images and diminishing the occurrence of colored stains while ensuring sufficient solubility, dispersibility, and dispersion stability of essential components having low solubility in water. Further, the use of this compound makes it possible to reduce the fogging and soft-toning during storage of the raw photosensitive material and to raise the storability of latent images. Furthermore, the use of this compound makes it possible to effectively avoid the intra-layer migration of dispersing medium during storage and to inhibit adverse effects accompanying the migration of the dispersing medium on the silver halide photosensitive material (i.e., enhancement of raw storability). In addition, the noncoloring compound (i.e., high-boiling-point organic solvent) represented by any of the formulae (a) to (d) is inexpensive and can be easily obtained and causes little damage to the environment. Therefore, this noncoloring compound is useful as a compound that replaces a high-boiling-point organic solvent based on a phthalic ester.

The emulsion described above further contains other components, for example, a color-developing coupler and a dispersing medium such as gelatin. These components are described later.

In the preparation of the silver halide photosensitive material, particularly a color print paper for general use, silver halide grains are spectrally sensitized by respective spectral sensitizing dyes to obtain blue-sensitive, green-sensitive, and red-sensitive emulsions in the process of the preparation of silver halide emulsions. The silver halide photosensitive material can be prepared by coating these emulsions in the order listed previously on a support. But an order different from this order may also be employed. For example, from the standpoint of rapid processing, the uppermost layer is preferably a photosensitive layer composed of silver halide grains having the largest average grain size. Alternatively, from the standpoint of storability under a condition irradiated with light, the lowermost layer is preferably a magenta-developing photosensitive layer.

Besides, the relationship between a photosensitive layer and a color to be developed may be different from the one described above, and at least one infrared-sensitive silver halide emulsion layer can also be used.

The silver halide grains to be used in the present invention include silver chloride, silver chlorobromide, silver iodobromide, silver chloroiodobromide, and the like. The use of silver chloride, silver chlorobromide, or silver chloroiodobromide grains, each having a silver chloride content of 90 mol % or greater, is preferable. The silver chloride content is preferably 95 mol % or greater, more preferably 95 to 99.9 mole %, and most preferably 98 to 99.9 mole %. In particular, in order to shorten the time required for development processing in the present invention, silver halide grains, which contain substantially no silver iodide and are composed of silver chlorobromide or silver chloride, can be preferably used in the present invention. The phrase "containing substantially no silver iodide" means a silver iodide content of 1 mol % or less and preferably 0.2 mol % or less. Meanwhile, for such purposes as raising sensitivity to high illumination intensity, raising sensitivity to spectral sensitization, and raising storability of the photosensitive material, silver chloride-rich grains, which contain 0.01 to 3 mol % of silver iodide on the surface thereof, can be preferably used. Although the halogen compositions of the emulsions may be different or the same between grains, the use of an emulsion in which the halogen composition is the same between grains easily unifies the properties of the constituent grains.

The halogen composition of the interior of the silver halide emulsion grain may be selected from the following examples. A uniform grain structure in which any portion of the grain has the same composition; a so-called laminate structure in which the halogen compositions differ between the core of the interior of the silver halide grain and the shell (i.e., a layer or plural layers) surrounding the core; and a grain structure having inside or on the surface of the grain thereof non-layer portions which have different halogen compositions (if such portions are present on the grain, the portions are joined to the edge, corner, or surface of the grain). In comparison with the use of grains having a uniform structure, it is more advantageous to use a structure selected from the latter two structures in order to obtain a higher sensitivity and such structure is also preferable from the standpoint of pressure resistance. In the case where the silver halide grains have the above-mentioned structures, the boundary region having different halogen compositions may exhibit a clear boundary, an unclear boundary due to mixed crystals based on the difference in compositions, or a positively continuous change in structure.

In the silver chloride-rich emulsion for use in the present embodiment, the grain is preferably structured such that phases, in which silver bromide is localized, are present in a layer or non-layer state inside or on the silver halide grain as stated previously. The silver bromide content is preferably at least 10 mol % and more preferably 20 mol % in the halogen composition of the localized phase described above. The silver bromide content in the silver bromide-localized phase can be analyzed, for example, by means of an X-ray diffractometry (described, for example, in "New Experimental Chemistry Lectures" (Shin Jikken Kagaku Kouza) 6, edited by Chemical Society of Japan, Maruzen Co., Ltd.). These localized phases may be present inside the grain, on the edges of the grain surface, on the grain corners, or on the grain surface. An example of the localized phases is the localized phase epitaxially grown on the corner of a grain.

Further, in order to reduce replenishment amounts of a development processing solution, it is effective to further increase the silver chloride content of the silver halide emulsion. In such a case, an emulsion, which is composed of almost pure silver chloride and has a silver chloride content as high as 98 to 100 mol %, is preferably used.

The average grain size of the silver halide grains contained in the silver halide emulsion for use in the present invention (diameters of circles equivalent to the projected areas were deemed to be the grain sizes and the number average was obtained from the diameters) is preferably 0.1 to 2 $\mu$m.

As to the grain size distribution, preferable is a so-called monodispersed grain system whose variation coefficient (which is obtained by dividing the statistical standard deviation of grain size distribution by the average grain size) is 20% or less, preferably 15% or less, and more preferably 10% or less. Further, for obtaining a broad latitude, it is a preferred practice to use a mixture of the monodispersed emulsions described above for the same layer or to form plural layers using the monodispersed emulsions described above.

The shape of the silver halide grain in the photographic emulsion may be selected from a regularly structured crystal such as a cube, tetradecahedron, or octahedron, an irregularly structured crystal such as a sphere or a tabular shape, and a complex made up of the foregoing. Further, the grains may be made up of a mixture of the crystals described above. Among these shapes, the grains in the present invention contain grains having the above-mentioned regularly structured crystals in a proportion of 50% or more, preferably 70% or more, and more preferably 90% or more.

Besides the emulsions described above, also preferably used is an emulsion in which the proportion of tabular grains, having an average aspect ratio (circle-equivalent diameter/thickness) of 5 or more and preferably 8 or more, exceeds 50% of the total grains in terms of projected areas.

The silver chloride(bromide) emulsions for use in the present invention can be prepared by the methods described in, for example, P. Glafkides, "Chimie et Physique Photographique", Paul Montel, 1967; G. F. Duffin, "*Photographic Emulsion Chemistry*", Focal Press, 1966; and V. L. Zelikman et al., "Making and Coating Photographic Emulsion", Focal Press, 1964. That is, the preparation can be performed by any method selected from an acidic method, a neutral method, and an ammonia method. As to the method for causing a reaction between a soluble silver salt and a soluble halogen salt, any method selected from a single jet method, a double jet method, and a combination thereof may be employed. It is possible to employ a method in which grains are formed in an environment having an excess of silver ions (i.e., a so-called reverse mixing method). It is also possible to employ a method, namely a controlled double jet method, wherein the pAg of the liquid phase in which silver halide is formed is maintained at a constant value, as a method included in the double jet method. According to this method, it is possible to obtain a silver halide emulsion having grain crystals regularly formed and nearly uniform grain sizes.

It is preferable that a localized phase or substrate of the silver halide grain of the present embodiment contains a different metal ion or a complex ion thereof. Preferred examples of the ions are selected from ions or complexes of metals belonging to Group VI, II, or IIb of the Periodic Table, lead ions, and thallium ions. Ions of metals selected from iridium, rhodium, iron, and the like, and complex ions thereof can be used in combinations mainly for the localized phase. On the other hand, ions of metals selected from osmium, iridium, rhodium, platinum, ruthenium, palladium, cobalt, nickel, iron, and the like, and complex ions thereof can be used in combinations mainly for the substrate. The kinds and concentrations of the metal ions may be different between the localized phase and the substrate. Plural kinds of these metals may be used. In particular, it is preferable that iron and iridium compounds are present in the silver bromide-localized phase.

These compounds that provide metal ions are incorporated into the localized phase and/or other grain portion (substrate) of the silver halide grain, for example, by being added or dissolved in a gelatin aqueous solution, a halide aqueous solution, a silver salt aqueous solution, or other aqueous solution, or alternatively, by being added in a state of silver halide grains already containing the metal ion and dissolved, at the time when the silver halide grains are formed.

The incorporation of the metal ions that are used in the present embodiment into the grains of the emulsion can be carried out before grain formation, during grain formation, or immediately after grain formation. The timing of the incorporation can be changed depending on the grain portion into which the metal ions are incorporated.

The silver halide emulsion that is used in the present embodiment normally undergoes a chemical sensitization and a spectral sensitization.

Examples of the chemical sensitization include a chemical sensitization using a chalcogen sensitizer (specific examples thereof include a sulfur sensitization represented by the addition of an unstable sulfur compound, a selenium sensitization by the addition of a selenium compound, and a tellurium sensitization by the addition of a tellurium compound), a noble metal sensitization represented by a gold sensitization, a reduction sensitization, and a combination of the foregoing. The compounds described in JP-A-No. 62-215272, lower right column on page 18 to upper right column on page 22, are preferably used.

The effect of the constitution of the silver halide photosensitive material in the present embodiment becomes more evident when a chloride-rich silver halide emulsion that is gold-sensitized is used.

The emulsion for use in the present embodiment is a so-called surface latent image type emulsion in which latent images are formed mainly on the grain surface.

For prevention of fogging during manufacture, storage, or photographic processing or for the stabilization of photographic performances, the emulsion for use in the present embodiment may contain various compounds or precursors thereof. Specific examples of these compounds are preferably the compounds described in JP-A No. 62-215272, pages 39–72. Further, 5-arylamino-1,2,3,4-thiatriazole (in which the aryl residue has at least one electron—withdrawing group) described in EP 0447647 is also preferably used.

The spectral sensitization is carried out in order to impart spectral sensitivity in a desired wavelength region to the emulsion of the layers in the photosensitive material of the present invention.

In the photosensitive material of the present embodiment, examples of the spectral sensitizing dyes to be used for the spectral sensitization in blue, green, and red regions include the dyes described, for example, in F. M. Harmer, "Heterocyclic compounds—Cyanine dyes and related compounds", John Wiley & Sons, New York, London, 1964. The specific examples of the compounds and the spectrally sensitizing methods described in JP-A No. 62-215272, upper right column on page 22 to page 38, are preferably used. As to the spectral sensitizing dye for red-sensitivity of silver halide emulsion grains having a high silver chloride content in particular, the spectral sensitizing dye described in JP-A No. 3-123340 is very desirable from the standpoint of stability, strength of adsorption, temperature dependence of exposure, etc.

In the photosensitive material of the present embodiment, sensitizing dyes described in JP-A No. 3-15049, upper left column on page 12 to lower left column on page 21, JP-A No. 3-20730, lower left column on page 4 to lower left column on page 15, EP 0,420,011, line 21 on page 4 to line 54 on page 6, EP 0,420,012, line 12 on page 4 to line 33 on page 10, EP 0,443,466, and U.S. Pat. No. 4,975,362 are preferably used.

In order to incorporate these spectral sensitizing dyes into silver halide emulsions, the dye may be directly dispersed in the emulsion, or alternatively, the dye may be added to the emulsion after the dye is dissolved in a solvent such as water, methanol, ethanol, propanol, methyl cellosolve, 2,2,3,3-tetrafluoropropanol, or a mixture thereof. Further, the dye may be made into solutions in the presence of an acid or base as described in Japanese Patent Application Publication (JP-B) Nos. 44-23389, 44-27555, and 57-22089, and others and the solution may be added to the emulsion, or alternatively, the dye may be made into a solution or colloidal dispersion in the presence of a surfactant as described in U.S. Pat. Nos. 3,822,135 and 4,006,025 and the solution or colloidal dispersion may be added to the emulsion. Further, the dye may be dissolved in a solvent such as phenoxyethanol which is substantially immiscible with water, and the solution may be dispersed in water or in a hydrophilic colloid. After that, the dispersion may be added to the emulsion. Furthermore, as described in JP-A Nos. 53-102733 and 58-105141, the dye may be dispersed directly in a hydrophilic colloid and the dispersion may be added to the emulsion. The timing to add the dye to the emulsion may be any stage of the manufacture of the emulsion hitherto known as useful. That is, the timing may be selected from the stages before grain formation of the emulsion, during grain formation, immediately after grain formation but before washing with water, before chemical sensitization, during chemical sensitization, immediately after chemical sensitization but before cooling the emulsion to solidify the grains, and during the preparation of a coating liquid. Most commonly, the addition is made after the completion of the chemical sensitization but before the coating operation. However, the dye may be added concurrently with the addition of a chemical sensitizer so that the chemical sensitization and spectral sensitization are carried out at the same time as described in U.S. Pat. Nos. 3,628,969 and 4,225,666. Further, the addition may be made before chemical sensitization or the addition may be made before the completion of the formation of silver halide grain precipitate to enable the start of spectral sensitization as described in JP-A No. 58-113928. Furthermore, the spectral sensitizing dye may be added in aliquots, that is, part of the dye may be added before chemical sensitization and the remainder may be added after chemical sensitization as disclosed in U.S. Pat. No. 4,225,666. Alternatively, the addition may be made at any time during the stage of silver halide grain formation according to the teachings found in, for example, U.S. Pat. No. 4,183,756. Particularly, it is preferable to add the sensitizing dye at the stage before washing with water or before chemical sensitization.

The amount to be added of the spectral sensitizing dye may vary within a wide range. The amount to be added is preferably in the range of $0.5\times10^{-6}$ to $1.0\times10^{-2}$ mole and more preferably in the range of $1.0\times10^{-6}$ to $5.0\times10^{-3}$ mole per mole of the silver halide.

In the present invention, where a sensitizing dye whose spectral sensitization sensitivity ranges from a red region to an infrared region is used, it is preferable to use a compound described in JP-A No. 2-157749, lower right column on page 13 to lower right column on page 22 together with the sensitizing dye. The use of such compound makes it possible to specifically raise the storability, processing stability, and supersensitization effect of the photosensitive material. Particularly, it is preferable to use the compound represented by the general formula (IV), (V), or (VI) in the above-mentioned patent literature. The amount to be used of the compound is in the range of $0.5\times10^{-5}$ to $5.0\times10^{-2}$ mole and preferably in the range of $5.0\times10^{-5}$ to $5.0\times10^{-3}$ mole per mole of the silver halide. The advantageous amount to be used of the compound falls within the range of 0.1 to 10,000 times and preferably within the range of 0.5 to 5,000 times the mole of the sensitizing dye.

Besides the use in a print system using an ordinary negative printer, the photosensitive material of the present embodiment is preferably used in digital scanning exposure using single-color high-density light such as a gas laser, light-emitting diode, semiconductor laser, or secondary high-frequency generating light source (SHG) combining a semiconductor laser or a solid-state laser using a semiconductor laser as an exciting light source with a nonlinear optical crystal. In order to make the system compact and inexpensive, it is preferable to use the semiconductor laser or secondary high-frequency generating light source (SHG) combining a semiconductor laser or a solid-state laser using a semiconductor laser as an exciting light source with a nonlinear optical crystal. Particularly, in order to design an apparatus which is compact and inexpensive and has long life and high stability, it is preferable to use a semiconductor laser and it is desirable to use a semiconductor laser as at least one of the light sources for exposure.

Where such a scanning light source for exposure is used, the peak of spectral sensitivity of the photosensitive material of the present invention can be set at will in accordance with the wavelength of the scanning light source to be used for exposure. In the SHG light source obtained by a combination of a solid-state laser using a semiconductor laser as an exciting light source or a semiconductor laser with a nonlinear optical crystal, the oscillation wavelength of the laser can be halved and therefore blue light and green light can be obtained. Accordingly, the peaks of spectral sensitivity of the photosensitive material can be present in three regions of ordinary blue, green, and red regions. In order to use a semiconductor laser as the light source so as to make the apparatus inexpensive, highly stable, and compact, it is preferable that at least two layers have peaks of spectral sensitivity at a wavelength of 670 nm or longer. This is because the light-emitting wavelength region of available semiconductor lasers, based on Group III–V elements that are inexpensive and stable, is only in the red to infrared region at the present time. However, since the oscillation of semiconductor lasers based on Group II–VI elements in the green and blue regions has been confirmed in laboratories, it is expected that these semiconductor lasers will become inexpensive and can be used in a stable manner when the production technology of semiconductor lasers develops. If this situation is realized, the necessity that at least two layers have peaks of spectral sensitivity at a wavelength of 670 nm or longer diminishes.

In the scanning exposure described above, the exposure time in which the silver halide in the photosensitive material is exposed to light is equal to the time required for exposing a certain minute area to the light. The minimum unit for controlling the light amount from corresponding digital data is used as this minute area and is designated as pixel. Accordingly, the exposure time per pixel varies depending on the pixel size. The pixel size depends on the pixel density and practically ranges from 50 to 2000 dpi. If the exposure time is defined as the time required for exposing the pixel size having a pixel density of 400 dpi, the exposure time is preferably $10^{-4}$ second or less and more preferably $10^{-6}$ second or less.

In the silver halide photosensitive material of the present embodiment, it is preferable to add a dye, which can be decolorized by a treatment and is described in European Patent EP 0337490A2, pp.27–76, (particularly an oxonol dye or a cyanine dye), to a hydrophilic colloid layer in order to prevent irradiation or halation or in order to raise safelight tolerance or the like.

Some of these water-soluble dyes impair color separation or safelight tolerance if the amounts to be used of the dyes are increased. The water-soluble dyes described in JP-A Nos. 5-127324, 5-127325, and 5-216185 are preferable as dyes that can be used without the impairment of the color separation.

In the present embodiment, a colored layer that can be decolorized by a treatment is used in place of the water-soluble dye or together with the water-soluble dye. The colored layer that can be decolorized by a treatment may be adjacent directly to an emulsion layer or may be in contact with an emulsion layer via an interlayer containing gelatin and a processing color mixing preventive such as hydroquinone. The colored layer is provided preferably underneath an emulsion layer (on the support side) which develops the same primary color as that of the colored layer. It is possible to provide colored layers corresponding to all primary colors and it is also possible to provide colored layers corresponding to arbitrarily selected primary colors. It is further possible to provide a colored layer having colors corresponding to a plurality of primary colors. As to the optical reflection density of the colored layer, the value of optical density at a wavelength which produces the highest optical density within a wavelength region for use in exposure (i.e., a visible light region of 400 to 700 nm in the exposure by an ordinary printer and the wavelength of a light source for scanning exposure in the case of scanning exposure) is preferably 0.2 or greater and 3.0 or smaller, more preferably 0.5 or greater and 2.5 or smaller, and particularly preferably 0.8 or greater and 2.0 or smaller.

For the formation of the colored layer, a conventionally known method can be employed. Examples of the method include the following methods. A method in which a dispersion of solid particles of a dye described in JP-A No. 2-282244, upper right column on page 3 to page 8 or a dispersion of solid particles of a dye described in JP-A No. 3-7931, upper right column on page 3 to lower left column on page 11 is incorporated into a hydrophilic colloid layer; a method in which an anionic dye is mordant-fixed to a cationic polymer; a method in which a dye is adsorbed to grains of a silver halide or the like to thereby fix the dye inside a layer; and a method in which colloidal silver is used as described in JP-A No. 1-239544. As an example of a method for dispersing particles of a dye in a state of solid particles, a method for incorporating dye particles, which are substantially insoluble in water at least at a pH of 6 or less but substantially soluble in water at least at a pH of 8or greater, is described in JP-A No. 2-308244, pp.4–13. An example of a method for mordant-fixing an anionic dye to a cationic polymer is described in JP-A No. 2-84637, pp.18–26. A method for preparing colloidal silver as a light absorber is disclosed in U.S. Pat. Nos. 2,688,601 and 3,459,563. Among these methods, a method for incorporating dye particles and a method using colloidal silver are preferable.

As to the binder or protective colloid that can be used in the present embodiment, the use of gelatin is advantageous. But other hydrophilic colloids can be used singly or together with gelatin. The use of gelatin having a low calcium content is preferable. The calcium content is preferably 800 ppm or less and more preferably 200 ppm or less. In order to prevent the growth of mildew or other bacteria in the hydrophilic colloid layer, it is preferable to add a mildew-proofing agent such as the one described in JP-A No. 63-271247.

When the photosensitive material of the present embodiment undergoes printer-exposure, it is preferable to use a band-strip filter described in U.S. Pat. No. 4,880,726. The use of this filter eliminates light-related color-mixing and remarkably enhances color reproducibility.

After exposure, the photosensitive material undergoes a conventional color developing treatment. In the present embodiment, it is preferable to carry out a bleach-fixing treatment after the color developing treatment for rapid processing. Particularly where the above-described emulsion having a high silver chloride content is used, the pH of the bleach-fixing solution is preferably about 6.5 or less, more preferably about 6 or less, for such purpose as acceleration of desilvering reaction.

As to the silver halide emulsion, and components such as a different metal ion species to be doped into the silver halide grain, a preservative stabilizer or fogging inhibitor of the silver halide emulsion, a method for chemical sensitization (sensitizer), a method for spectral sensitization (spectral sensitizer), a yellow coupler and a magenta or cyan coupler that can be used together and a method for emulsifying these couplers, a color-image preservation improving agent (a stain inhibitor or browning inhibitor) a dye (colored layer), and gelatin as well as the layer construction of the photosensitive material and pH of the coating layer of the photosensitive material, all for use in the present embodiment, prefarable reference is made to those described in the patent literatures, EP 0,335,660A2 (JP-A No. 2-139544) in particular, and shown in the following Tables 1 to 5. Further, those described in JP-A Nos. 7-104448, 7-77775, and 7-301895 are also preferably used.

TABLE 1

| Photographic constituent elements, etc. | JP-A No. 62-215272 | JP-A No. 2-33144 | EP 0,335,660A2 |
|---|---|---|---|
| Silver halide emulsions | upper right column, line 6, on page 10 to lower left column, line 5, on page 12 and lower right column, line 4 from bottom, on page 12 to upper left column, line 17, on page 13 | upper right column, line 16, on page 28 to lower right column, line 11, on page 29 and lines 2 to 5 on page 30 | line 53 on page 45 to line 3 on page 47 and lines 20 to 22 on page 47 |
| Silver halide solvents | lower left column, lines 6 to 14, on page 12 and upper left column, line 3 from bottom, on page 13 to lower left column, bottom line, on page 18 | — | — |
| Chemical sensitizers | lower left column, line 3 from bottom, to lower right column, line 5 from bottom, on page 12 and lower right column, line 1, on page 18 to upper right column, line 9 from bottom, on page 22 | lower right column, lines 12 to bottom line, on page 29 | lines 4 to 9 on page 47 |
| Spectral sensitizers (methods for spectral sensitization) | upper right column, line 8 from bottom, on page 22 to bottom line on page 38 | upper left column, lines 1 to 13, on page 30 | lines 10 to 15 on page 47 |
| Emulsion stabilizers | upper left column, line 1, on page 39 to upper right column, bottom line, on page 72 | upper left column, line 14, to upper right column, line 1, on page 30 | lines 16 to 19 on page 47 |
| Development accelerators | lower left column, line 1, on page 72 to upper right column, line 3, on page 91 | — | — |
| Color couplers (cyan, magenta, and yellow couplers) | upper right column, line 4, on page 91 to upper left column, line 6, on page 121 | upper right column, line 14, on page 3 to upper left column, bottom line, on page 18 and upper right column, line 6, on page 30 to lower right column, line 11, on page 35 | lines 15 to 27 on page 4, line 30 on page 5 to bottom line on page 28, lines 29 to 31 on page 45, and line 23 on page 47 to line 50 on page 63 |
| Color development enhancers | upper left column, line 7, on page 121 to upper right column, line 1, on page 125 | — | — |

TABLE 1-continued

| Photographic constituent elements, etc. | JP-A No. 62-215272 | JP-A No. 2-33144 | EP 0,335,660A |
|---|---|---|---|
| UV absorbing agents | upper right column, line 2, on page 125 to lower left column, bottom line, on page 127 | lower right column, line 14, on page 37 to upper left column, line 11, on page 38 | lines 22 to 31 on page 65 |
| Color mixing preventives (image stabilizers) | lower right column, line 1, on page 127 to lower left column, line 8, on page 137 | upper right column, line 12, on page 36 to upper left column, line 19, on page 37 | line 30 on page 4 to line 23 on page 5, line 1 on page 29 to line 24 on page 45, lines 33 to 40 on page 45, and lines 2 to 21 on page 65 |
| High-boiling-point organic solvents and/or low-boiling-point organic solvents | lower left column, line 9, on page 137 to upper right column, bottom line, on page 144 | lower right column, line 14, on page 35 to upper left column, line 4 from bottom, on page 36 | lines 1 to 51 on page 64 |
| Methods for dispersing photographic additives | lower left column, line 1, on page 144 to upper right column, line 7, on page 146 | lower right column, line 10, on page 27 to upper left column, bottom line 5, on page 28 and lower right column, line 12, on page 35 to upper right column, line 7, on page 36 | line 51 on page 63 to line 56 on page 64 |
| Developing agent precursors | lower left column, line 5, on page 155 to lower right column, line 2, on page 155 | — | — |
| Development-inhibitor releasing compounds | lower right column, lines 3 to 9, on page 155 | — | — |
| Layer constructions of photosensitive materials | upper left column, line 15, on page 156 to lower right column, line 14, on page 156 | upper right column, lines 1 to 15, on page 28 | lines 41 to 52 on page 48 |
| Dyes | lower right column, line 15, on page 156 to lower right column, bottom line, on page 184 | upper left column, line 12, to upper right column, line 7, on page 38 | lines 18 to 22 on page 66 |
| Color mixing preventives | upper left column, line 1, on page 185 to lower right column, line 3, on page 188 | upper right column, lines 8 to 11, on page 36 | line 57 on page 64 to line 1 on page 65 |
| Gradation controlling agents | lower right column, lines 4 to 8, on page 188 | — | — |
| Stain inhibitors | lower right column, line 9, on page 188 to lower right column, line 10, on page 193 | upper left column, bottom line, to lower right column, line 13, on page 37 | line 32 on page 65 to line 17 on page 66 |
| Surfactants | lower left column, line 1, on page 201 to upper right column, bottom line, on page 210 | upper right column, line 1, on page 18 to lower right column, bottom line, on page 24 and lower left column, line 10 from bottom, to lower right column, line 9, on page 27 | — |
| Fluorine-containing compounds (for use as antistatic agents, coating aids, lubricants, adhesion inhibitors, etc.) | lower left column, line 1, on page 210 to lower left column, line 5, on page 222 | upper left column, line 1, on page 25 to lower right column, line 9, on page 27 | — |
| Binders (hydrophilic colloids) | lower left column, line 6, on page 222 to upper left column, bottom line, on page 225 | upper right column, lines 8 to 18, on page 38 | lines 23 to 28 on page 66 |
| Thickeners | upper right column, line 1, on page 225 to upper right column, line 2, on page 227 | — | — |
| Antistatic agents | upper right column, line 3, on page 227 to upper left column, line 1, on page 230 | — | — |
| Polymer latices | upper left column, line 2, on page 230 to bottom line on page 239 | — | — |
| Matting agents | upper left column, line 1, on page 240 to upper right column, bottom line, on page 240 | — | — |
| Photographic processing methods (processing steps, additives, etc.) | upper right column, line 7, on page 3 upper right column, line 5, on page 10 | to upper left column, line 4, on page 39 to upper left column, bottom line, on page 42 | line 14 on page 67 to line 28 on page 69 |

Notes) The references from JP-A No. 62-215272 include the contents amended by the amendment dated March 16, 1987 and attached to the end of JP-A No. 62-215272.
Further, the so-called shortwave-type yellow couplers described in JP-A Nos. 63-231451, 63-123047, 63-123047, 63-241547, 1-173499, 1-213648, and 1-250944 are also preferably used as yellow couplers among the couplers described above.

It is preferable that the cyan, magenta, or yellow coupler is impregnated into a loadable latex polymer (e.g., as in U.S. Pat. No. 4,203,716) in the presence (or in the absence) of the high-boiling-point organic solvent described in the tables or is dissolved in the high-boiling-point organic solvent together with a polymer insoluble in water but soluble in an organic solvent; and, after that, the coupler is emulsified and dispersed in a hydrophilic colloid aqueous solution.

Examples of the preferably usable polymer insoluble in water but soluble in an organic solvent include homopolymers and copolymers described in U.S. Pat. No. 4,857,449, columns 7 to 15, and International Patent Laid-Open WO88/00723, pages 12 to 30. The use of methacrylate polymers or acrylamide polymers, particularly acrylamide polymers, is more preferable from such standpoint as image stability.

In the photosensitive material of the present invention, it is preferable to use an image-preservation improving agent, such as the one described in European Patent EP 0277589A2, together with the coupler. Particularly, combination of the image-preservation improving agent with a pyrazoloazole coupler or pyrrolotriazole coupler is preferable.

That is, it is preferable to use a compound which is described in the above-mentioned patent literature and which chemically combines with an aromatic amine-based developing agent remaining after color development processing to thereby form a chemically inert and substantially colorless compound and/or a compound which is described in the above-mentioned patent literature and which chemically combines with the oxidized form of an aromatic amine-based developing agent remaining after color development processing to thereby form a chemically inert and substantially colorless compound, singly or in combination thereof. This is preferable for example from the standpoint of the prevention of stain formation due to a coloring dye formation reaction with the developing agent or the oxidized form thereof remaining in the film during storage after processing and also from the standpoint of the prevention of other side effects.

As to the cyan couplers, preferred examples thereof include, besides the diphenylimidazole-based cyan couplers described in JP-A No. 2-33144, 3-hydroxypyridine-based cyan couplers described in European Patent EP 0 333185A2 (among these couplers, a 2-equivalent coupler, which is prepared by providing a chlorine-leaving group to an exemplary coupler (42), a coupler (6), and a coupler (9) are particularly preferable), cyclic active methylene-based cyan couplers described in JP-A No. 64-32260(among these couplers, exemplary couplers (3), (8), and (34) are particularly preferable), pyrrolopyrazole-type cyan couplers described in European Patent EP 0456226A1, pyrroloimidazole-type cyan couplers described in European Patent EP 0484909, and pyrrolotriazole-type cyan couplers described in European Patent EP 0484909. Among these couplers, pyrrolotriazole-type cyan couplers are particularly preferable.

As to the yellow couplers, preferred examples thereof include, besides the compounds described in known literatures in the tables, acylacetamide-type yellow couplers which have a 3- to 5-membered cyclic structure in the acyl group and are described in European Patent EP 0447969A1, malondianilide-type yellow couplers having a cyclic structure described in European Patent EP 0482552A2, and acylacetamide-type yellow couplers having a dioxane structure described in U.S. Pat. No. 5,118,599. Among these couplers, a acylacetamide-type yellow coupler whose acryl group is a 1-alkylcyclopropane-1-carbonyl group and a malondianilide-type yellow coupler in which one of the anilides constitutes an indoline ring are particularly preferable. These couplers may be used singly or in combinations.

As to the magenta couplers for use in the present embodiment, 5-pyrazolone-based magenta couplers or pyrazoloazole-based magenta couplers as described in known literatures in the tables are used. Among these couplers, preferable are a pyrazolotriazole coupler which has a secondary or tertiary alkyl group linked directly to a 2-, 3-, or 6-position of the pyrazolotriazole ring and is described in JP-A No. 61-65245, a pyrazolotriazole coupler which has a sulfonamide group in the molecule and is described in JP-A No. 61-65246, a pyrazolotriazole coupler which has an alkoxyphenylsulfonamide ballast group and is described in JP-A No. 61-147254, and a pyrazolotriazole coupler which has an alkoxy group or aryloxy group linked to a 6-position and is described in described in European Patent Nos. 226,849A and 294,785A.

As to the processing methods of the color photosensitive materials of the present embodiment, preferred examples thereof include, in addition to the methods listed in the tables, processing materials and processing methods, described in JP-A No. 2-207250, lower right column, line 1, on page 26 to upper right column, line 9, on page 34 and in JP-A No. 4-97355, upper left column, line 17, on page 5 to lower right column, line 20, on page 18, are preferable.

As to the methods for development-processing the color photosensitive materials of the present embodiment, a heat development system without using a processing liquid can be used besides conventional wet-processes such as a method which uses a developing solution containing an alkali agent and a developing agent for the processing and a method in which a developing agent is incorporated in the photosensitive material so that development is carried out by using an activator liquid, for example an alkaline solution, containing no developing agent. In particular, the activator system is preferable because of ease in handling, less disadvantages at the time of waste water disposal, and safety on environments.

In the activator system, a hydrazine-type compound described in, for example, JP-A No. 8-234388, 9-152686, 9-152693, 9-21181, and 9-160193, is preferable as the developing agent or precursor thereof to be incorporated in the photosensitive material.

Also preferably used is a development method in which the coating amount of silver of a photosensitive material is reduced and image amplification (intensification) is carried out using hydrogen peroxide. In particular, use of this method in an activator method is preferable. More specifically, preferably used are the methods which are described in JP-A Nos. 8-297354 and 9-152695 and use an activator solution containing hydrogen peroxide.

In the activator method, the photosensitive material after being treated with an activator solution normally undergoes a desilvering treatment. However, according to an image amplification treatment using a photosensitive material having a low silver content, the desilvering treatment can be omitted and a simple treatment such as washing with water or stabilization can be performed. In a method in which image information is read by a scanner or the like, a processing mode that does not require a desilvering treatment can be employed even when a photosensitive material having a high silver content such as a photographing material is used.

In the present embodiment, materials for activator solutions, desilvering solutions (bleach/fixing solutions) and rinsing and stabilizing solutions as well as treating methods using these solutions can be conventionally known ones. Preferably, those described in Research Disclosure, Item 36544 (September, 1994), pp.536 to 541, and JP-A No. 8-234388 can be used.

The high-boiling-point organic solvent according to the present embodiment is also preferably used in a photosensitive material having a magnetic recording layer for the advanced photo-system. Further, the high-boiling-point organic solvent according to the present embodiment can also be applied to a system in which heat development is carried out using a small amount of water or to a perfectly dry system in which heat development is carried out and entirely no water is used. Details of these systems are described in JP-A Nos. 6-35118, 6-17528, 56-146133, 60-119557, 1-161236, and so on.

The silver halide photosensitive material of the present invention includes not only a photosensitive material for forming colored images but also a photosensitive material for forming monotone images including black-and-white images.

The silver halide photosensitive material according to the present invention is most preferably applied to a color photosensitive material, although the silver halide photosensitive material according to the present invention is preferably applied to color photosensitive materials (e.g., color paper, display photosensitive materials, color photosensitive materials for cinema, instant photographic photosensitive materials including a dye diffusion transfer system (DTR), and photosensitive materials for heat development systems thereof) as well as to black-and-white photosensitive materials including general-purpose black-and-white photosensitive materials, micro, wash-off, medical, or industrial X-ray photosensitive materials, and printing photosensitive materials (including those for use in a silver salt diffusion transfer system and a dry systems using silver behenate or the like).

Where the compounds represented by the general formulae (a) to (d) are applied to color paper, the photosensitive material described in JP-A No. 11-7109 is preferable. Particularly, the descriptions in paragraphs [0071] to [0087] of JP-A No. 11-7109 are fully incorporated herein as part of the specification of the present invention.

Where the compounds represented by the general formulae (a) to (d) are applied to color negative films, the description in JP-A No. 11-305396, paragraphs [0115] to [0217], is preferably applied and incorporated herein as part of the specification of the present invention.

Where the compounds represented by the general formulae (a) to (d) are applied to color reversal films, the description in JP-A No. 11-84601, paragraphs [0018] to [0021], is preferably applied and incorporated herein as part of the specification of the present invention.

EXAMPLES

The present invention is explained in more detail based on examples indicated below. However, it should be noted that the present invention is not limited to these examples.

Example 1

Stability Assessment of Emulsified Dispersions 10 g (15 g used only for samples 101c~114c) of 2,5-d-t-octylhydroquinone (color mixing preventive), 20 g (15 g each for 101c~114c) of a noncoloring compound shown in following Tables 2 to 5, and 3 mL (5 mL each for 101c~114c) of ethyl acetate were mixed and dissolved. These solutions were each emulsified and dispersed in 200 g of a 10% gelatin aqueous solution containing 1.0 g of sodium dodecylbenzenesulfonate to thereby obtain emulsified dispersions (101a to 121a, 101b to 129b, 101c to 114c, and 101d to 113d) As to the emulsified dispersions 101a to 121a, 101b to 129b, and 101d to 113d, the particle sizes of the emulsified dispersions immediately after emulsification and the particle sizes of the emulsified dispersions after being stored for 24 hours at the temperatures shown in the following tables were measured by means of Coulter N4 (manufactured by Coulter Corp.). The stability of the emulsified dispersions was assessed based on the results obtained by the measurements. As to the emulsified dispersions 101c to 114c, the number of coarse oily particles of the emulsified dispersions immediately after emulsification and the number of coarse oily particles of the emulsified dispersions after being stored for 20 days in a refrigerator kept at 4° C. were counted. More specifically, 5 mL of the emulsified dispersion was coated on a glass plate (8 cm×10 cm) and dried at room temperature. After that, two sections in sizes 1 cm×8 cm each were partitioned off and the coarse oily particles whose diameters were greater than 10 μm were counted in these sections. The number of the coarse oily particles for the entire area of the glass plate was obtained by calculation based on the number thus obtained.

The results are shown in Tables 2 to 5.

TABLE 2

Results of stability assessment of the emulsified dispersions in the case where the noncoloring compounds represented by the general formula (a) were used

| Emulsified dispersion sample No. | Kinds of noncoloring compounds | Particle size (μm) Immediately after emulsification | After 24 hours at 40° C. | Remarks |
|---|---|---|---|---|
| 101a | Comparative compound a | 0.205 | 0.245 | Comparative Example |
| 102a | Comparative compound b | 0.242 | 0.402 | Comparative Example |
| 103a | Comparative compound c | 0.200 | 0.224 | Comparative Example |
| 104a | Comparative compound d | 0.203 | 0.230 | Comparative Example |
| 105a | Comparative compound e | 0.195 | 0.227 | Comparative Example |
| 106a | Comparative compound f | 0.198 | 0.218 | Comparative Example |
| 107a | Comparative compound g | 0.201 | 0.220 | Comparative Example |
| 108a | Exemplary compound a-1 | 0.183 | 0.184 | Present invention |
| 109a | Exemplary compound a-2 | 0.184 | 0.186 | Present invention |
| 110a | Exemplary compound a-3 | 0.184 | 0.185 | Present invention |
| 111a | Exemplary compound a-4 | 0.190 | 0.192 | Present invention |
| 112a | Exemplary compound a-9 | 0.186 | 0.187 | Present invention |
| 113a | Exemplary compound a-16 | 0.187 | 0.189 | Present invention |
| 114a | Exemplary compound a-18 | 0.180 | 0.183 | Present invention |
| 115a | Exemplary compound a-21 | 0.181 | 0.183 | Present invention |
| 116a | Exemplary compound a-23 | 0.182 | 0.183 | Present invention |
| 117a | Exemplary compound a-24 | 0.182 | 0.184 | Present invention |
| 118a | Exemplary compound a-29 | 0.182 | 0.192 | Present invention |
| 119a | Exemplary compound a-30 | 0.187 | 0.190 | Present invention |
| 120a | Exemplary compound a-31 | 0.185 | 0.191 | Present invention |
| 121a | Exemplary compound a-32 | 0.187 | 0.190 | Present invention |

(Note) The numbers attached to the exemplary compounds indicate the respective compounds represented by the general formula (a) previously described.

In Table 2, the numbers attached to the exemplary compounds indicate the respective numbers attached to the exemplary noncoloring compounds represented by the general formula (a) previously described. The structures of the comparative compounds a to g in Table 2 are given below.

Comparative compounds a)

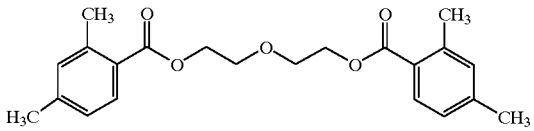

the compound described in JP-A No. 1-1015453 b)

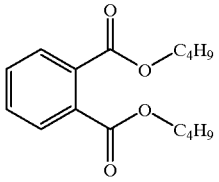

c)

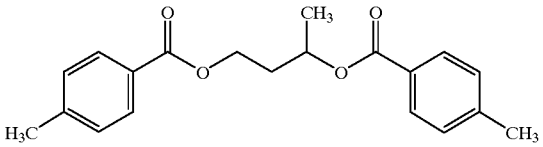

the compound described in European Patent 969320 d)

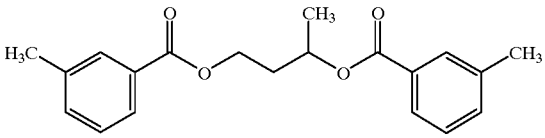

-continued the same as above e)

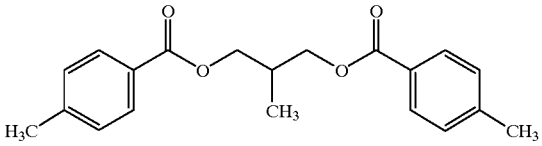

the same as above f)

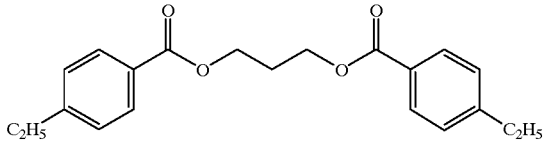

the same as above g)

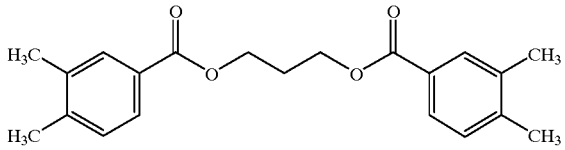

the same as above

From the results shown in Table 2, it can be seen that, in comparison with the emulsified dispersions using the comparative compounds a tog, the emulsified dispersions (108a to 121a) using the noncoloring compounds represented by the general formula (a) are excellent in dispersibility and dispersion stability, have smaller particle sizes immediately after emulsification, and exhibit little change in particle sizes after storage.

TABLE 3

Results of stability assessment of the emulsified dispersions in the case where the noncoloring compounds represented by the general formula (b) were used

| Sample No. | Kinds of noncoloring compounds | Particle size (μm) Immediately after emulsification | After 24 hours at 40° C. | Remarks |
|---|---|---|---|---|
| 101b | Comparative compound a | 0.210 | 0.240 | Comparative Example |
| 102b | Comparative compound b | 0.215 | 0.243 | Comparative Example |
| 103b | Comparative compound c | 0.212 | 0.239 | Comparative Example |
| 104b | Comparative compound d | 0.212 | 0.242 | Comparative Example |
| 105b | Comparative compound e | 0.209 | 0.236 | Comparative Example |
| 106b | Comparative compound f | 0.206 | 0.229 | Comparative Example |
| 107b | Comparative compound g | 0.208 | 0.232 | Comparative Example |
| 108b | Comparative compound h | 0.209 | 0.241 | Comparative Example |
| 109b | Comparative compound i | 0.213 | 0.242 | Comparative Example |
| 110b | Comparative compound j | 0.214 | 0.239 | Comparative Example |
| 111b | Comparative compound k | 0.211 | 0.241 | Comparative Example |
| 112b | Comparative compound l | 0.209 | 0.238 | Comparative Example |
| 113b | Comparative compound m | 0.207 | 0.240 | Comparative Example |
| 114b | Comparative compound n | 0.218 | 0.239 | Comparative Example |
| 115b | Comparative compound o | 0.242 | 0.402 | Comparative Example |
| 116b | Exemplary compound b-1 | 0.183 | 0.184 | Present invention |
| 117b | Exemplary compound b-2 | 0.184 | 0.186 | Present invention |
| 118b | Exemplary compound b-3 | 0.184 | 0.185 | Present invention |
| 119b | Exemplary compound b-4 | 0.190 | 0.192 | Present invention |
| 120b | Exemplary compound b-9 | 0.186 | 0.187 | Present invention |

TABLE 3-continued

Results of stability assessment of the emulsified dispersions in the case where the noncoloring compounds represented by the general formula (b) were used

| Sample No. | Kinds of noncoloring compounds | Particle size (μm) Immediately after emulsification | After 24 hours at 40° C. | Remarks |
|---|---|---|---|---|
| 121b | Exemplary compound b-10 | 0.187 | 0.189 | Present invention |
| 122b | Exemplary compound b-12 | 0.180 | 0.183 | Present invention |
| 123b | Exemplary compound b-13 | 0.181 | 0.183 | Present invention |
| 124b | Exemplary compound b-14 | 0.182 | 0.183 | Present invention |
| 125b | Exemplary compound b-16 | 0.182 | 0.184 | Present invention |
| 120b | Exemplary compound b-18 | 0.182 | 0.192 | Present invention |
| 127b | Exemplary compound b-21 | 0.187 | 0.190 | Present invention |
| 128b | Exemplary compound b-24 | 0.185 | 0.191 | Present invention |
| 129b | Exemplary compound b-25 | 0.187 | 0.190 | Present invention |

In Table 3, the numbers attached to the exemplary compounds indicate the respective numbers attached to the exemplary noncoloring compounds represented by the general formula (b) previously described. The structures of the comparative compounds a to o in Table 3 are given below.

Comparative compounds a)

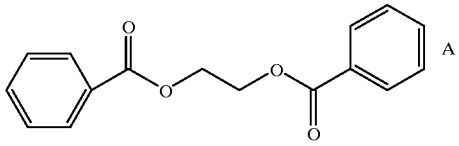

b)

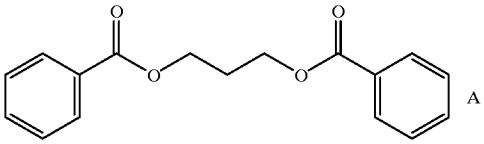

c)

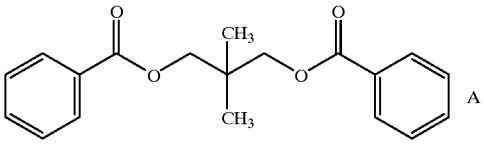

d)

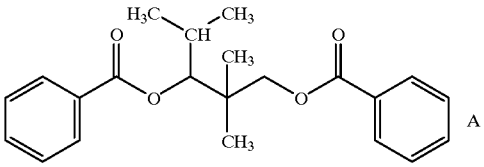

e)

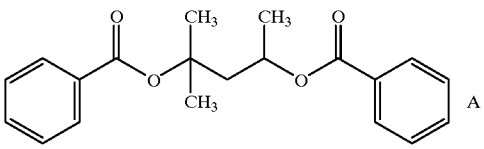

-continued f)

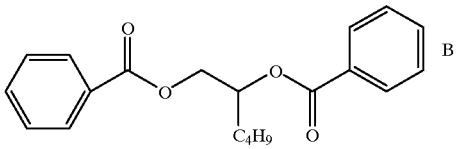

(g)

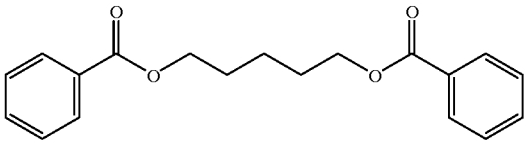

h)

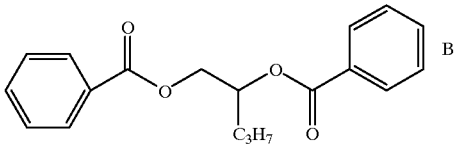

i)

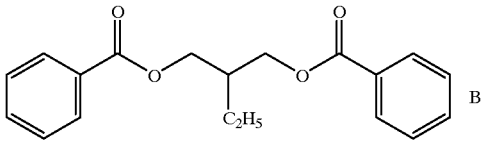

j)

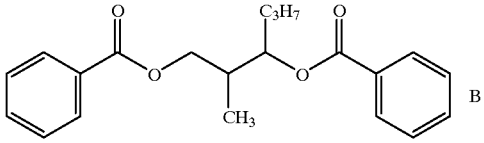

-continued k)

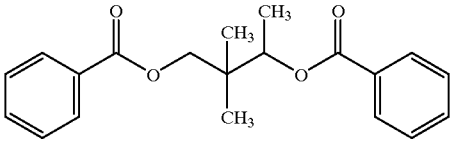

B l)

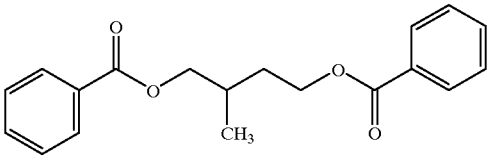

B

-continued m)

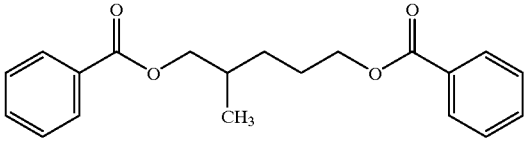

B n)

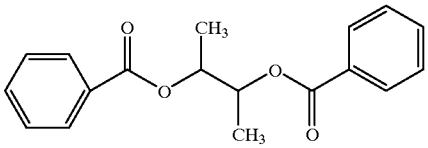

B o)

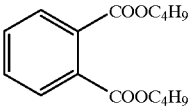

A: compounds described in JP-A No. 1-101543
B: compounds described in European Patent 969320

TABLE 4

| Sample No. | Kinds of noncoloring compounds | Number of coarse oily particles (in 5 mL) Immediately after emulsification | After 20 days in refrigerator | Remarks |
|---|---|---|---|---|
| 101c | Comparative compound a | 200 | 1500 | Comparative Example |
| 102c | Comparative compound b | 100 | 1500 | Comparative Example |
| 103c | Comparative compound c | 150 | 1200 | Comparative Example |
| 104c | Comparative compound d | 150 | 1100 | Comparative Example |
| 105c | Comparative compound e | 300 | 2000 | Comparative Example |
| 106c | Exemplary compound 1 | 50 | 150 | Present invention |
| 107c | Exemplary compound 2 | 50 | 150 | Present invention |
| 108c | Exemplary compound 3 | 50 | 150 | Present invention |
| 109c | Exemplary compound 4 | 40 | 100 | Present invention |
| 110c | Exemplary compound 9 | 40 | 80 | Present invention |
| 111c | Exemplary compound c-10 | 40 | 90 | Present invention |
| 112c | Exemplary compound c-12 | 40 | 80 | Present invention |
| 113c | Exemplary compound c-13 | 40 | 60 | Present invention |
| 114c | Exemplary compound c-19 | 50 | 70 | Present invention |

In table 4, the numbers attached to the exemplary compounds indicate the respective numbers attached to the exemplary noncoloring compounds represented by the general formula (c) previously described. The structures of the comparative compounds a to e in Table 4 are given below.

Comparative compound a

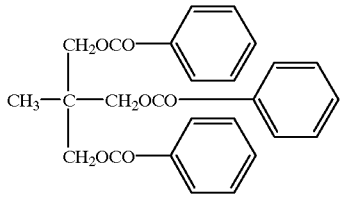

-continued

Comparative compound b

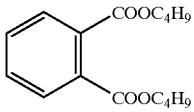

Comparative compound c

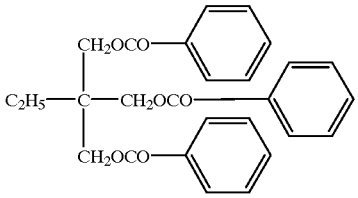

Comparative compound d

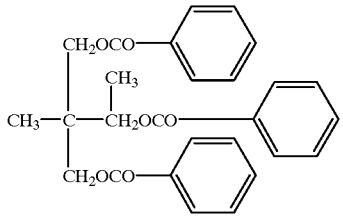

-continued

Comparative compound e

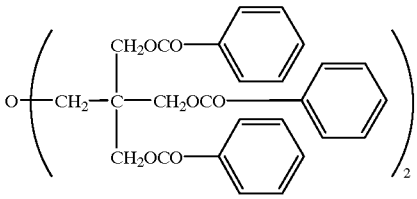

TABLE 5

Stability of the emulsified dispersions in the case where the noncoloring compounds represented by the general formula (d) were used

| Sample No. | Kinds of noncoloring compounds | Particle size (μm) Immediately after emulsification | After 24 hours at 50° C. | Remarks |
|---|---|---|---|---|
| 101d | Comparative compound a | 0.242 | 0.450 | Comparative Example |
| 102d | Comparative compound b | 0.190 | 0.235 | Comparative Example |
| 103d | Comparative compound c | 0.190 | 0.230 | Comparative Example |
| 104d | Comparative compound d | 0.185 | 0.230 | Comparative Example |
| 105d | Comparative compound e | 0.202 | 0.240 | Comparative Example |
| 106d | Comparative compound f | 0.202 | 0.240 | Comparative Example |
| 107d | Comparative compound g | 0.205 | 0.242 | Comparative Example |
| 108d | Comparative compound h | 0.205 | 0.242 | Comparative Example |
| 109d | Exemplary compound d-12 | 0.185 | 0.199 | Present invention |
| 110d | Exemplary compound d-13 | 0.185 | 0.199 | Present invention |
| 111d | Exemplary compound d-21 | 0.185 | 0.198 | Present invention |
| 112d | Exemplary compound d-30 | 0.180 | 0.195 | Present invention |
| 113d | Exemplary compound d-31 | 0.180 | 0.195 | Present invention |

In Table 5, the numbers attached to the exemplary compounds indicate the respective numbers attached to the exemplary noncoloring compounds represented by the general formula (d) previously described. The structures of the comparative compounds a to h in Table 5 are given below.

Comparative compounds a)

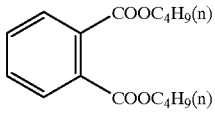

c)

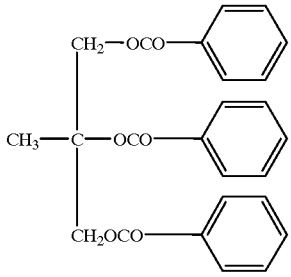

-continued b)

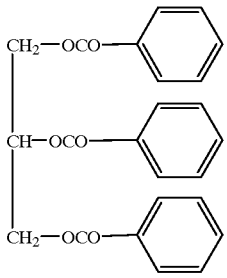

d)

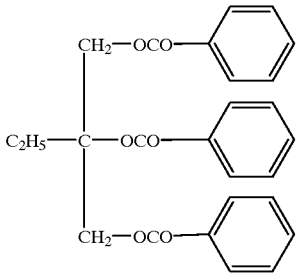

e)

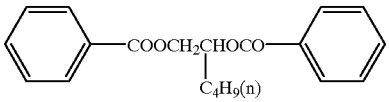

the compound described in EP 0969320A f)

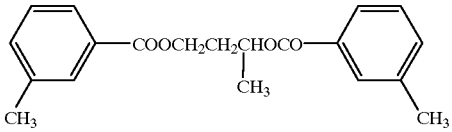

the compound described in EP 0969320A g)

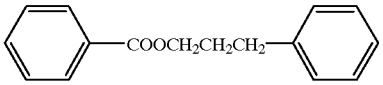

the compound described in EP 0969321A h)

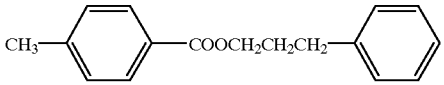

the compound described in EP 0969321A

Example 2

Assessment of Color-mixing Prevention and Storability

The support was a sheet of paper whose both surfaces were covered with a polyethylene resin. The support surface underwent a corona discharge treatment and thereafter was coated with a gelatin subbing layer containing sodium dodecylbenzenesulfonate. After that, the photographic constituent layers 1 to 7, which were prepared in the following ways, were successively coated on the subbing layer. In this way, Sample No. 201 of a silver halide color photographic photosensitive material as a comparative sample made up of the following layer construction was prepared. The coating liquids for the respective photographic constituent layers were prepared in the following ways. Sample 201c was prepared by employing the figure indicated in the following [ ] . The figure in [ ] is the amount used or value for Sample 201c.

Preparation of the Coating Liquid for Forming the 5th Layer

300 [330] g of a cyan coupler (ExC-1) 250 g of a color image stabilizer (Cpd-1), 10 g of a color image stabilizer (Cpd-9), 10 g of a color image stabilizer (Cpd-10), 20 g of a color image stabilizer (Cpd-12), and 290 g of a UV absorbing agent (UV-A) were dissolved in 230 g of a solvent (Solv-6) and 350 mL of ethyl acetate. The resulting solution was emulsified in 6500 g of a 10% gelatin aqueous solution containing 25 g of a surfactant (Cpd-20) to thereby prepare an emulsified dispersion C.

Meanwhile, a silver chlorobromide emulsion C (cubic grains; a 5:5 (in silver molar ratio) mixture composed of a large-size emulsion C having an average grain size of 0.40 $\mu$m and a small-size emulsion C having an average grain size of 0.30$\mu$m, having variation coefficients of grain size distribution of 0.09 and 0.11, respectively, and each having 0.5 mol % of silver bromide localized in portions of the surface of grain composed mainly of silver chloride) was prepared.

The large-size emulsion contained the following spectral sensitizing dye G in an amount of $9.0\times10^{-5}$ mol per mol of silver halide and the following spectral sensitizing dye H in an amount of $9.0\times10^{-5}$ mol per mol of silver halide. The small-size emulsion contained the following spectral sensitizing dye G in an amount of $12.0\times10^{-5}$ mol per mol of silver halide and the following spectral sensitizing dye H in an amount of $12.0\times10^{-5}$ mol per mol of silver halide. The chemical sensitization of this emulsion was carried out to an optimum by the addition of a sulfur sensitizer and a gold sensitizer.

The coating liquid for forming the 5th layer having the composition described later was prepared by blending the emulsified dispersion C and the silver chlorobromide emulsion C. The coating weight of the emulsion indicates the weight equivalent to the weight of silver.

The coating liquids for the 1st to 4th layers and the coating liquids for the 6th to 7th layers were prepared according to a method similar to the method for the preparation of the coating liquid for forming the 5th layer. The following H-1, H-2, and H-3 (hardeners) were used as the gelatin hardener for each layer.

The following Ab-1, Ab-2, Ab-3, and Ab-4 (preservatives), in amounts of 15 mg/m$^2$, 60.0 mg/m$^2$, 5.0 mg/m$^2$, and 10.0 mg/m$^2$, respectively, were added to each layer.

Hardener (H-1)

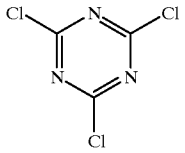

(used 0.50% by mass of the gelatin)

Hardener (H-2)

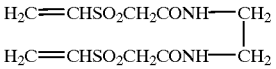

(used 1.20% by mass of the gelatin)

-continued

Hardener (H-3)

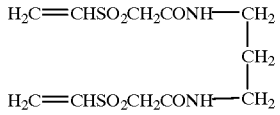

(used 0.40% by mass of the gelatin)

Preservative (Ab-1)

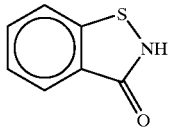

Preservative (Ab-2)

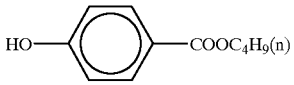

Preservative (Ab-3)

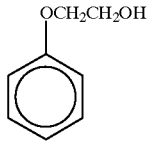

Preservative (Ab-4)

The mixture of a, b, c, and d in a ratio by mol of 1:1:1:1

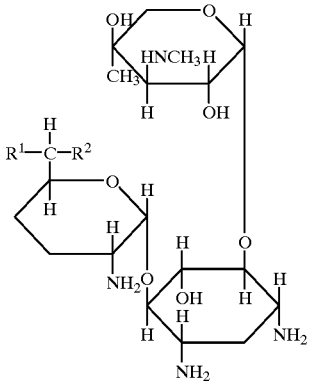

| | $R^1$ | $R^2$ |
|---|---|---|
| a | $H_3C$— | —$NHCH_3$ |
| b | $H_3C$— | —$NH_2$ |
| c | H— | —$NH_2$ |
| d | H— | —$NHCH_3$ |

The following spectral sensitizers and crystal phase control agent 1 were used in each silver chlorobromide emulsion contained in the coating liquids for the formation of the 1st, 3 rd, and 5th layers.

The amount used of the crystal phase control agent 1 was an optimal amount.

Blue-sensitive Emulsion Layer

Sensitizer A

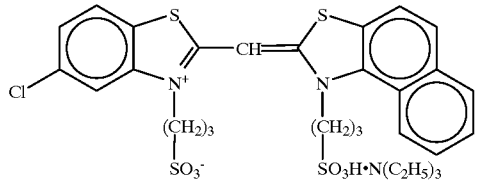

Sensitizer B

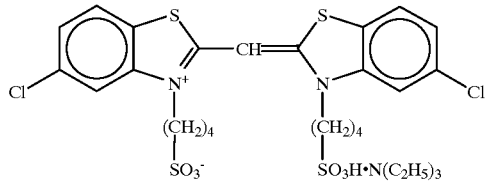

Sensitizer C

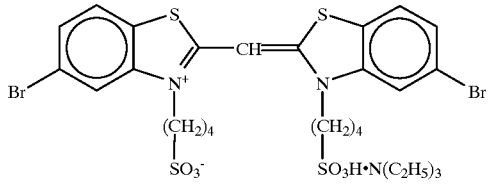

Crystal Phase Control Agent 1

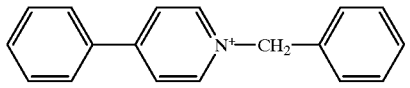

(The spectral sensitizing dye A in an amount of $0.42\times10^{-4}$ [$0.48\times10^{-4}$] mol per mol of silver halide and the spectral sensitizing dye C in an amount of $0.42\times10^{-4}$ [$0.48\times10^{-4}$] mol per mol of silver halide were added to the large-size emulsion. The spectral sensitizing dye A in an amount of $0.50\times10^{-4}$ mol per mol of silver halide and the spectral sensitizing dye B in an amount of $0.50\times10^{-4}$ mol per mol of silver halide were added to the small-size emulsion. The spectral sensitizing dye B in an amount of $3.4\times10^{-4}$ [$3.7\times10^{-4}$] mol per mol of silver halide was added to the large-size emulsion. The spectral sensitizing dye B in an amount of $4.1\times10^{-4}$ [$4.5\times10^{-4}$] mol per mol of silver halide was added to the small-size emulsion.)

Green-sensitive Emulsion Layer

Sensitizer D

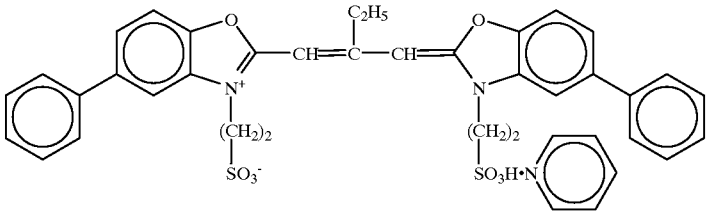

-continued

Sensitizer E

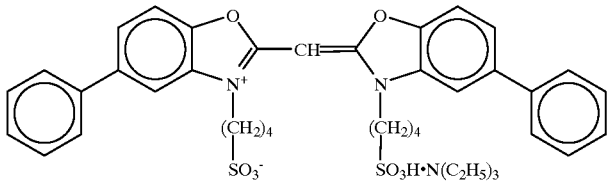

Sensitizer F

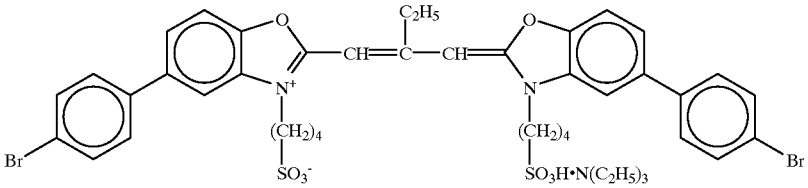

(The spectral sensitizing dye D in an amount of $3.0\times10^{-4}$ [$3.5\times10^{-4}$] mol per mol of silver halide was added to the large-size emulsion. The spectral sensitizing dye D in an amount of $3.6\times10^{-4}$ [$3.0\times10^{-4}$] mol per mol of silver halide was added to the small-size emulsion. The spectral sensitizing dye E in an amount of $4.0\times10^{-5}$ [$6.0\times10^{-5}$] mol per mol of silver halide was added to the large-size emulsion. The spectral sensitizing dye E in an amount of $7.0\times10^{-5}$ [$6.0\times10^{-5}$] mol per mol of silver halide was added to the small-size emulsion. The spectral sensitizing dye F in an amount of $2.0\times10^{-4}$ [$2.5\times10^{-4}$] mol per mol of silver halide was added to the large-size emulsion. The spectral sensitizing dye F in an amount of $2.8\times10^{-4}$ [$3.8\times10^{-4}$] mol per mol of silver halide was added to the small-size emulsion.)

Red-sensitive Emulsion Layer

Sensitizer G

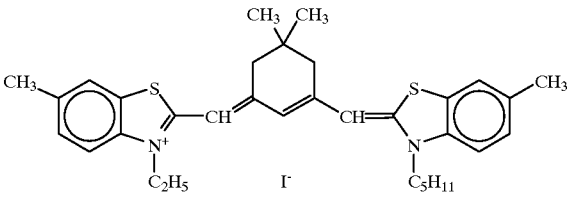

Sensitizer H

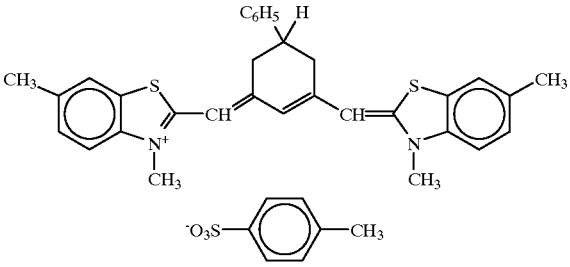

(The spectral sensitizing dye G in an amount of $8.0\times10^{-5}$ [$7.6\times10^{-5}$] mol per mol of silver halide was added to the large-size emulsion. The spectral sensitizing dye H in an amount of $8.0\times10^{-5}$ [$7.0\times10^{-5}$] mol per mol of silver halide was added to the large-size emulsion. The spectral sensitizing dye G in an amount of $10.7\times10^{-5}$ [$8.5\times10^{-5}$] mol per mol of silver halide was added to the small-size emulsion. The spectral sensitizing dye H in an amount of $10.7\times10^{-5}$ [$8.5\times10^{-5}$] mol per mol of silver halide was added to the small-size emulsion.)

Further, the following compound I in an amount of $3.0\times10^{-3}$ mol per mol of silver halide was added to the red-sensitive emulsion layer.

Compound I

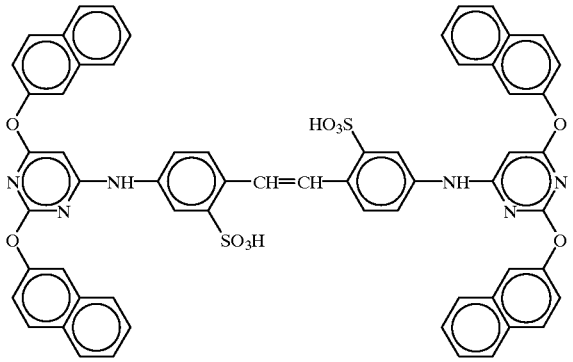

1-(3-methyureidophenyl)-5-mercaptotetrazole in amounts of $3.3\times10^{-4}$ [$3.5\times10^{-4}$] mol, $1.0\times10^{-3}$ mol, and $5.9\times10^{-4}$ [$7.0\times10^{-4}$] mol, respectively, per mol of silver halide was added to the blue-sensitive emulsion layer, green-sensitive emulsion layer, and red-sensitive emulsion layer.

Further, 1-(3-methyureidophenyl)-5-mercaptotetrazole in amounts equivalent to 0.2 mg/$M^2$, 0.2 mg/$M^2$, 0.6 mg/$m^2$, and 0.1 mg/$m^2$, respectively, was added to the 2nd layer, the 4th layer, the 6th layer, and the 7th layer.

4-hydroxy-6-methyl-1,3,3a,7-tetrazaindene in amounts of $1\times10^{-4}$ mol and $2\times10^{-4}$ mol, respectively, per mol of silver halide was added to the blue-sensitive emulsion layer and green-sensitive emulsion layer.

A latex of an acrylic acid/butyl acrylate copolymer (having a monomer ratio by mass of 1:1 and an average molecular weight of 200,000 to 400,000) in an amount equivalent to 0.05 [0.07]g/$m^2$ was added to the red-sensitive emulsion layer.

Catechol-3,5-disulfonic acid disodium salt in amounts equivalent to 6 g/$m^2$, 6 g/$m^2$, and 18 g/$m^2$, respectively, was added to the 2nd layer, the 4th layer, and the 6th layer.

Furthermore, for the prevention of irradiation, the following dyes (the figure in brackets indicates the coating amount) were added.

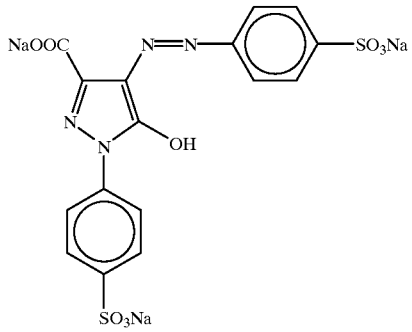

(2mg/m$^2$)

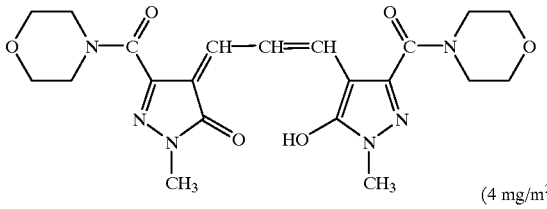

(4 mg/m$^2$)

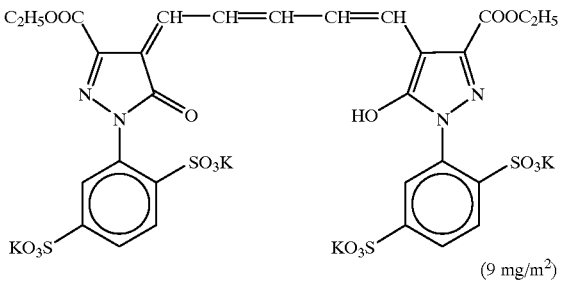

(9 mg/m$^2$)

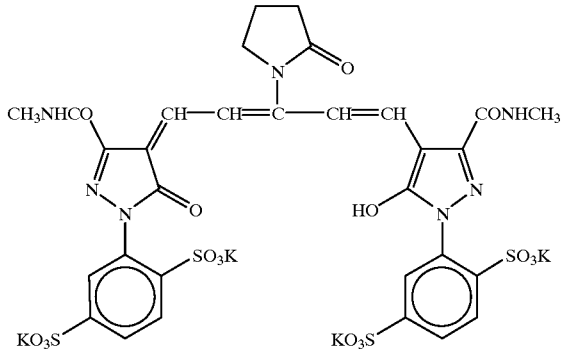

(9 mg/m$^2$)

Layer Construction

The composition of each layer is given below. Each figure indicates a coating weight (g/m$^2$). The amount of the silver halide emulsion indicates the coating weight equivalent to the weight of silver.

Support

Paper laminated with a polyethylene resin

[the polyethylene resin on the 1st layer side contains white pigments ($TiO_2$: content is 16% by mass, ZnO: content is 4% by mass), a fluorescent brightener (4,4'-bis(5-methylbenzoxazolyl)stilbene, content: 0.03% by mass), and a blue dye (ultramarine blue)].

The 1st Layer (blue-sensitive emulsion layer)

silver chlorobromide emulsion A 0.24[0.28]

(cubic grains; a 5:5 (in silver molar ratio) mixture composed of a large-size emulsion A having an average grain size of 0.72[0.75] μm and a small-size emulsion A having an average grain size of 0.60[0.63] μm, having variation coefficients of grain size distribution of 0.08 and 0.10, respectively, and each having 0.3 mol % of silver bromide localized in portions of the surface of grain composed mainly of silver chloride)

| | |
|---|---|
| Gelatin | 1.25 |
| Yellow coupler (ExY) | 0.57 [0.60] |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| The 2nd layer (color mixing preventive layer) | |
| Gelatin | 0.99 [0.90] |
| Color mixing preventive (Cpd-19) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-2) | 0.22 |
| The 3rd layer (green-sensitive emulsion layer) | |
| silver chlorobromide emulsion B | 0.14 [0.17] |

(cubic grains; a 1:3 (in silver molar ratio) mixture composed of a large-size emulsion B having an average grain size of 0.45 μm and a small-size emulsion B having an average grain size of 0.35 μm, having variation coefficients of grain size distribution of 0.10 and 0.08, respectively, and each having 0.4 mol % of silver bromide localized in portions of the surface of grain composed mainly of silver chloride).

| | |
|---|---|
| Gelatin | 1.36 |
| Magenta coupler (ExM) | 0.15 [0.18] |
| Ultraviolet absorbing agent (UV-A) | 0.14 |
| Color image stabilizer (Cpd-2) | 0.02 |
| Color image stabilizer (Cpd-4) | 0.002 |
| Color image stabilizer (Cpd-6) | 0.03 |
| Color image stabilizer (Cpd-8) | 0.06 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.07 |
| Solvent (Solv-4) | 0.14 |
| Solvent (Solv-5) | 0.05 |
| The 4th layer (color mixing preventive layer) | |
| Gelatin | 0.71 [0.60] |
| Color mixing preventive (Cpd-19) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-2) | 0.16 |
| The 5th layer (red-sensitive emulsion layer) | |
| silver chlorobromide emulsion C | 0.20 [0.25] |

(cubic grains; a 5:5 (in silver molar ratio) mixture composed of a large-size emulsion C having an average grain size of 0.40 μm and a small-size emulsion C having an average grain size of 0.30 μm, having variation coefficients of grain size distribution of 0.09 and 0.11, respectively, and each having 0.5 mol % of silver bromide localized in portions of the surface of grain composed mainly of silver chloride).

| | |
|---|---|
| Gelatin | 1.11 |
| Cyan coupler (ExC-1) | 0.30 [0.33] |
| Ultraviolet absorbing agent (UV-A) | 0.29 |
| Color image stabilizer (Cpd-1) | 0.25 |
| Color image stabilizer (Cpd-9) | 0.01 |

-continued

| | |
|---|---|
| Color image stabilizer (Cpd-10) | 0.01 |
| Color image stabilizer (Cpd-12) | 0.02 |
| Solvent (Solv-6) | 0.23 |
| The 6th layer (ultraviolet absorbing layer) | |
| Gelatin | 0.46 [0.50] |
| Ultraviolet absorbing agent (UV-B) | 0.45 |
| Solvent (Solv-7) | 0.25 |
| The 7th layer (protective layer) | |
| Gelatin | 1.00 [0.90] |
| Acryl-modified copolymer of polyvinyl alcohol (degree of modification: 17%) | 0.04 |
| Liquid paraffin | 0.02 |
| Surfactant (Cpd-13) | 0.01 |

Further, Sample 202 (silver halide color photographic photosensitive material) as a Comparative Example was prepared in the same way as in the preparation of Sample 201 obtained above, except that the composition of the 5th layer of Sample 201 was changed to the following composition. Like Sample 202, Sample 202c was prepared using Sample 201c in the same way as in the preparation of Sample 202, except that the amount used of the following cyan coupler ExC-2 was changed to 0.14 g/m$^2$. The figure in [ ] is the amount used for Sample 202c.

| The 5th layer (red-sensitive emulsion layer) | |
|---|---|
| silver chlorobromide emulsion C | 0.12 |

(cubic grains; a 5:5 (in silver molar ratio) mixture composed of a large-size emulsion C having an average grain size of 0.40 $\mu$m and a small-size emulsion C having an average grain size of 0.30 $\mu$m, having variation coefficients of grain size distribution of 0.09 and 0.11, respectively, and each having 0.8 mol % of silver bromide localized in portions of the surface of grain composed mainly of silver chloride).

| | |
|---|---|
| Gelatin | 1.11 |
| Cyan coupler (ExC-2) | 0.13[0.14] |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.01 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |

Yellow coupler (ExY)

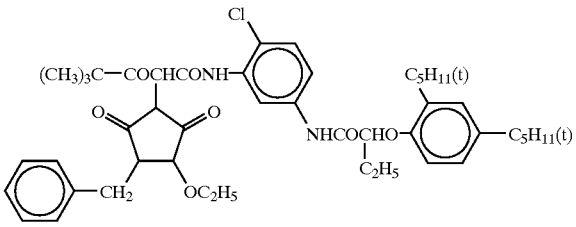

-continued

Magenta coupler (ExM1)

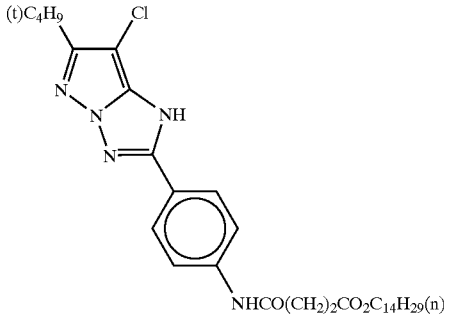

Cyan Coupler (ExC-1)

The mixture of

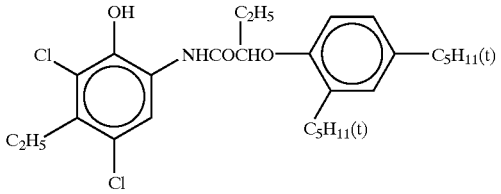

and

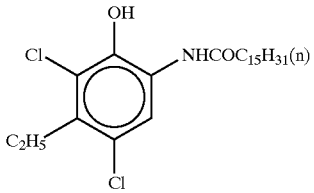

in a ratio by mol of 15:85

Cyan Coupler (ExC-2)

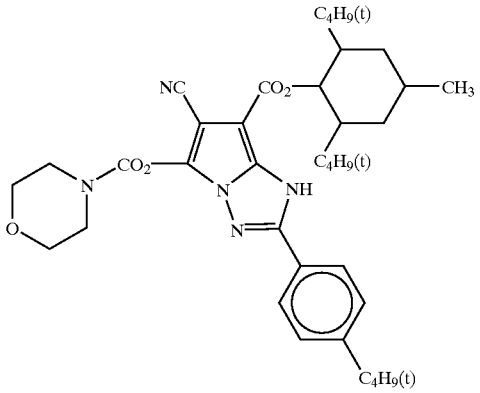

Cyan Coupler (ExC-3)

The mixture of

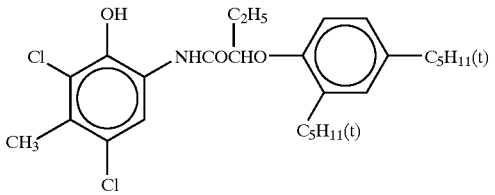

-continued

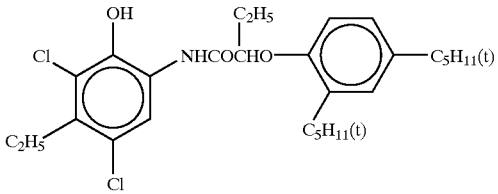

and

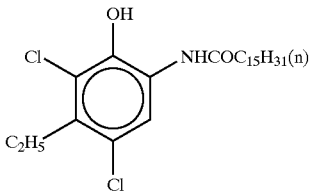

in a ratio by mol of 50:25:25

Color Image Stabilizer (Cpd-1)

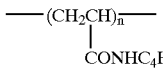

number average molecular weight: 60,000

Color Image Stabilizer (Cpd-2)

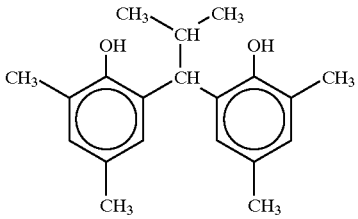

Color Image Stabilizer (Cpd-3)

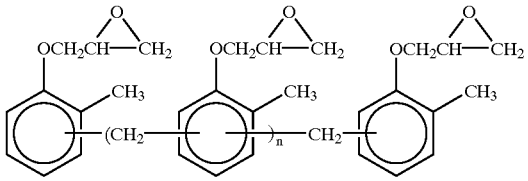

(The average of n is 7 to 8)

Color Image Stabilizer (Cpd-4)

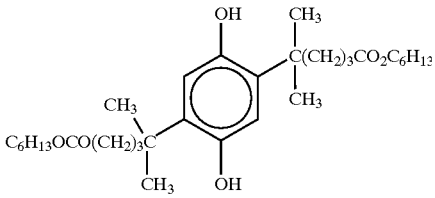

Color Mixing Preventive (Cpd-5)

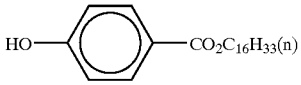

Stabilizer (Cpd-6)

-continued

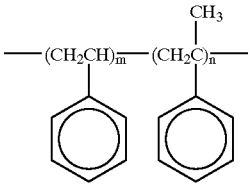

The number average of molecular weight: 600
m/n = 10/90

Color Mixing Preventive (Cpd-7)

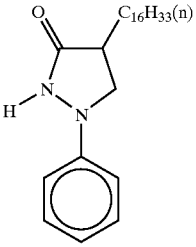

Color Mixing Preventive (Cpd-8)

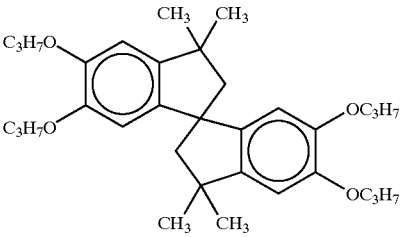

Color Image Stabilizer (Cpd-9)

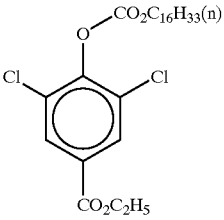

Color Image Stabilizer (Cpd-10)

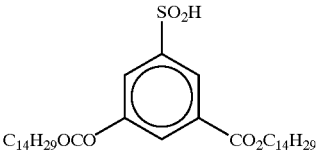

(Cpd-11)

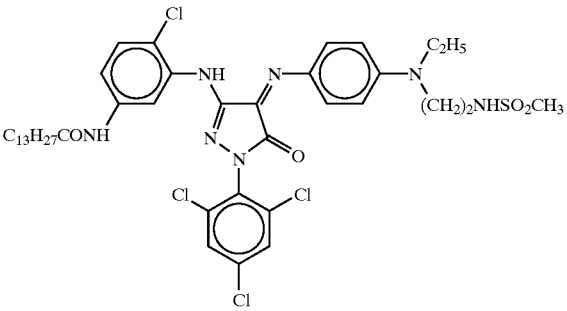

-continued
Color Image Stabilizer (Cpd-12)
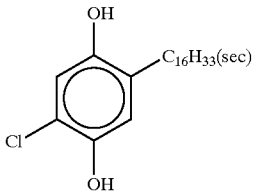
Surfactant (Cpd-13)
The ⅔ mixture of
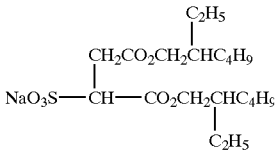
and
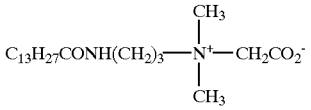
(Cpd-14)
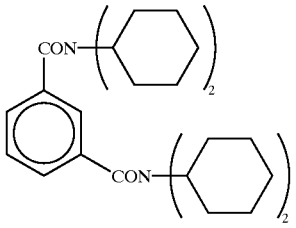
(Cpd-15)
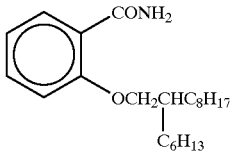
(Cpd-16)
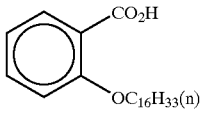
(Cpd-17)
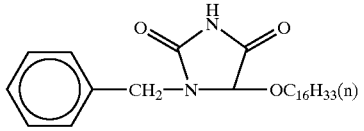
(Cpd-18)
-continued
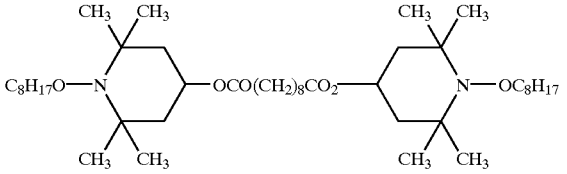
Color Mixing preventive (Cpd-19)
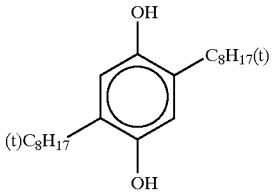
Surfactant (Cpd-20)
The ¼ mixture (mol ratio) of
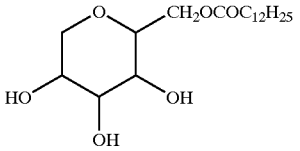
and
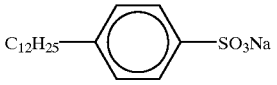
Ultraviolet Absorbing Agent (UV-1)
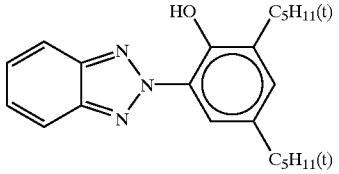
Ultraviolet Absorbing Agent (UV-2)
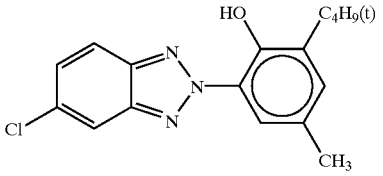
Ultraviolet Absorbing Agent (UV-3)
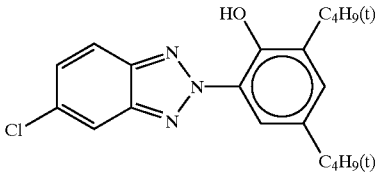
Ultraviolet Absorbing Agent (UV-4)

-continued

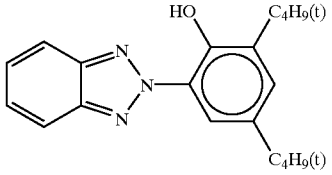

Ultraviolet Absorbing Agent (UV-5)

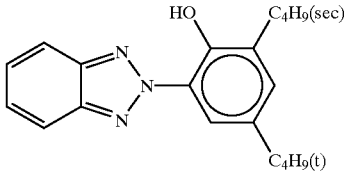

Ultraviolet Absorbing Agent (UV-6)

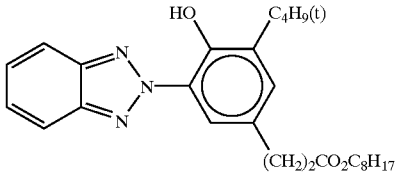

Ultraviolet Absorbing Agent (UV-7)

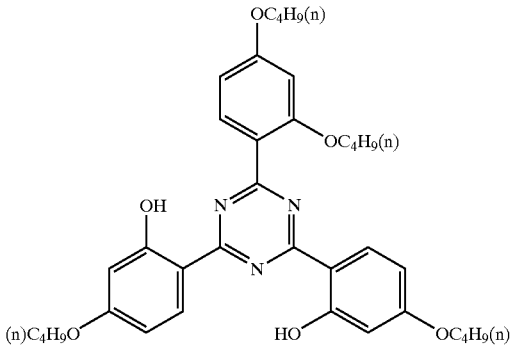

UV-A: The mixture of 4/2/2/3 (mass ratio) of UV-1, UV-2, UV-3 and UV-4

UV-B: The mixture of 9/3/3/4/5/3 (mass ratio) of UV-1, UV-2, UV-3, UV-4, UV-5 and UV-6

UV-C: The mixture of 1/1/1/2 (mass ratio) of UV-2, UV-3, UV-6 and UV-7

(Solv-1)

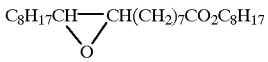

(Solv-2)

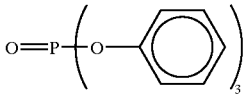

(Solv-3)

$C_4H_9OCO(CH_2)_8CO_2C_4H_9$ (Solv-4)

$O{=}P(OC_6H_{13}(n))_3$ (Solv-5)

-continued

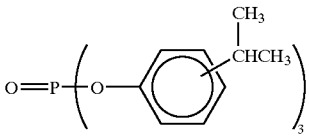

(Solv-6)

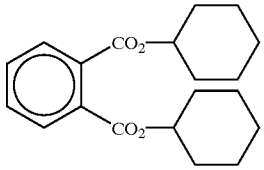

(Solv-7)

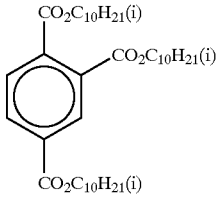

(Solv-8)

$C_8H_{17}OCO(CH_2)_8CO_2C_8H_{17}$

Sample 203 (silver halide color photographic photosensitive material) as a Comparative Example was prepared in the same way as in the preparation of Sample 202, except that the silver chlorobromide emulsion A was changed to an emulsion of tabular grains (containing 0.3 mol % of iodine) equivalent to 0.40[0.44] μm cubes and having an aspect ratio of 8. As in the case of Sample 203, Sample 203c was prepared using Sample 202c, except that the emulsion of tabular grains equivalent to 0.44 μm cubes was used. The figure in [ ] is for Sample 203c.

Further, Sample 204 to 206(silver halide color photographic photosensitive materials) were prepared in the same way as in the preparation of Samples 201 to 203, respectively, except that the order of the blue-sensitive emulsion layer and the red-sensitive emulsion layer was reversed in the layer formation. Likewise, Samples 204c to 206c were prepared in the same way as in the preparation of Samples 201 to 203, except that Samples 201c to 203c were used, respectively.

By using Sample 201 thus obtained, the following process A and process B were prepared for carrying out color development processing.

The processing steps are indicated below.

<Preparation of the Process A>

Each of the photosensitive materials 201 to 206 was processed into a roll having a width of 127 mm and subjected to image-wise exposure. After that, by using a mini-labo printer processor PP1258AR manufactured by Fuji Photo Film Co., Ltd., continuous processing (running test) of the samples was carried out until the replenished amount of the replenisher solution to the color developing bath reached the double of the tank capacity in the processing under the following conditions. The processing using this running liquid is designated as process A.

| processing step | temperature | time | replenished amount* |
|---|---|---|---|
| color development | 38.5° C. | 45 seconds | 45 mL |
| bleach-fixing | 38.0° C. | 45 seconds | 35 mL |
| rinsing (1) | 38.0° C. | 20 seconds | — |
| rinsing (2) | 38.0° C. | 20 seconds | — |
| rinsing (3) | **38.0° C. | 20 seconds | — |
| rinsing (4) | **38.0° C. | 30 seconds | 121 mL |

*replenished amount per $1m^2$ of the photosensitive material
**The rinsing step (3) is equipped with a rinse cleaning system RC50D manufactured by Fuji Photo Film Co., Ltd. so as to take out of the rinsing step (3) the rinsing liquid which is then sent by a pump to a reverse osmosis film module (RC50D).

The permeate thus obtained is supplied to the rinsing step (4) and the condensed water is returned to the rinsing step (3). The pump pressure was controlled so that the amount of permeated water to the reverse osmosis was maintained at 50 to 300 mL/minute and the circulation was carried out for 10 hours per day at a controlled temperature.
(In the Rinsing, a Counter-current Flow from Tank (1) to (4) was Employed).

The compositions of the processing solutions were as follows.

| | [tank solution] | [replenisher solution] |
|---|---|---|
| [color developing solution] | | |
| water | 800 mL | 800 mL |
| dimethylpolysiloxane-based surfactant (Silicone KF351A/manufactured by Shin-Etsu Chemical Co., Ltd.) | 0.1 g | 0.1 g |
| tri(isopropanol)amine | 8.8 g | 8.8 g |
| ethylenediaminetetraacetic acid | 4.0 g | 4.0 g |
| polyethylene glycol (molecular weight: 300) | 10.0 g | 10.0 g |
| sodium 4,5-dihydroxybenzene-1.3-disulfonate | 0.5 g | 0.5 g |
| potassium chloride | 10.0 g | — |
| potassium bromide | 0.040 g | 0.010 g |
| triazinylaminostilbene-based fluorescent brightener (HACKOL FWA-SP/manufactured by Showa Kagaku Co., Ltd.) | 2.5 g | 5.0 g |
| sodium sulfite | 0.1 g | 0.1 g |
| disodium-N,N-bis(sulfonateethyl)hydroxylamine | 8.5 g | 11.1 g |
| N-ethyl-N-(β-methanesulfoneamidoethyl)-3-methyl-4-amino-4-aminoaniline.3/2 sulfonic acid.monohydrate | 5.0 g | 15.7 g |
| potassium carbonate | 26.3 g | 26.3 g |
| water to make | 1000 mL | 1000 mL |
| pH(25° C./controlled by acetic acid and ammonia) | 10.15 | 12.50 |
| [bleach-fixing solution] | | |
| water | 700 mL | 600 mL |
| iron(III)ammonium ethylenediaminetetraacetate | 47.0 g | 94.0 g |
| ethylenediaminetetraacetic acid | 1.4 g | 2.8 g |
| m-carboxybenzenesulfinic acid | 8.3 g | 16.5 g |
| nitric acid (67%) | 16.5 g | 33.0 g |
| imidazole | 14.6 g | 29.2 g |
| ammonium thiosulfate (750 g/L) | 107.0 mL | 214.0 mL |
| ammonium sulfite | 16.0 g | 32.0 g |
| sodium hydrogensulfite | 23.1 g | 46.2 g |
| water to make | 1000 mL | 1000 mL |
| pH(25° C./controlled by acetic acid and ammonia) | 6.0 | 6.0 |
| [rinsing solution] | | |
| sodium chloroisocyanurate | 0.02 g | 0.02 g |
| deionized water (conductivity: 5 μS/cm or less) | 1000 mL | 1000 mL |
| pH | 6.5 | 6.5 |

<Preparation if the Process B>

Sample 201 was processed into a roll having a width of 127 mm and subjected to image-wise exposure. After that, continuous processing (running test) of the sample was carried out until the replenished amount of the replenisher solution to the color developing bath reached the double of the tank capacity in the processing under the following conditions. The processing using this running liquid is designated as process B. In the processing, a modified mini-labo printer processer PP1258AR manufactured by Fuji Photo Film Co., Ltd., which was modified to increase the transfer speed to shorten the processing time, was used.

| processing step | temperature | time | replenished amount* |
|---|---|---|---|
| color development | 45.0° C. | 12 seconds | 45 mL |
| bleach-fixing | 40.0° C. | 12 seconds | 35 mL |
| rinsing (1) | 40.0° C. | 4 seconds | — |
| rinsing (2) | 40.0° C. | 4 seconds | — |
| rinsing (3) | **40.0° C. | 4 seconds | — |
| rinsing (4) | **40.0° C. | 4 seconds | 121 mL |

*replenished amount per $1m^2$ of the photosensitive material
**The rinsing step (3) is equipped with a rinse cleaning system RC50D manufactured by Fuji Photo Film Co., Ltd. so as to take out of the rinsing step (3) the rinsing liquid which is then sent by a pump to a reverse osmosis film module (RC50D).

The permeate thus obtained is supplied to the rinsing step (4) and the condensed water is returned to the rinsing step (3). The pump pressure was controlled so that the amount of permeated water to the reverse osmosis was maintained at 50 to 300 mL/minute and the circulation was carried out for 10 hours per day at a controlled temperature.
(In the Rinsing, a Counter-current Flow from Tank (1) to (4) was Employed).

The compositions of the processing solutions were as follows.

| | [tank solution] | [replenisher solution] |
|---|---|---|
| [color developing solution] | | |
| water | 800 mL | 800 mL |
| dimethylpolysiloxane-based surfactant (Silicone KF351A/manufactured by Shin-Etsu Chemical Co., Ltd.) | 0.1 g | 0.1 g |
| tri(isopropanol)amine | 8.8 g | 8.8 g |
| ethylenediaminetetraacetic acid | 4.0 g | 4.0 g |
| polyethylene glycol (molecular weight: 300) | 10.0 g | 10.0 g |
| sodium 4,5-dihydroxybenzene-1,3-disulfonate | 0.5 g | 0.5 g |
| potassium chloride | 10.0 g | — |
| potassium bromide | 0.040 g | 0.010 g |
| triazinylaminostilbene-based fluorescent brightener (HACKOL FWA-SP/manufactured by Showa Kagaku Co., Ltd.) | 2.5 g | 5.0 g |
| sodium sulfite | 0.1 g | 0.1 g |
| disodium-N,N-bis(sulfonateethyl)-hydroxylamine | 8.5 g | 11.1 g |
| N-ethyl-N-(β-methanesulfoneamidoethyl)-3-methyl-4-amino-4-aminoanilinedot.3/2 sulfonic acid.monohydrate | 10.0 g | 22.0 g |
| potassium carbonate | 26.3 g | 26.3 g |
| water to make | 1000 mL | 1000 mL |
| pH(25° C./controlled by acetic acid and ammonia) | 10.15 | 12.50 |
| [bleach-fixing solution] | | |
| water | 700 mL | 600 mL |
| iron(III) ammonium ethylenediamine-tetraacetate | 75.0 g | 150.0 g |

-continued

| | [tank solution] | [replenisher solution] |
|---|---|---|
| ethylenediaminetetraacetic acid | 1.4 g | 2.8 g |
| m-carboxybenzenesulfinic acid | 8.3 g | 16.5 g |
| nitric acid (67%) | 16.5 g | 33.0 g |
| imidazole | 14.6 g | 29.2 g |
| ammonium thiosulfate (750 g/L) | 107.0 mL | 214.0 mL |
| ammonium sulfite | 16.0 g | 32.0 g |
| sodium hydrogensulfite | 23.1 g | 46.2 g |
| water to make | 1000 mL | 1000 mL |
| pH(25° C./controlled by acetic acid and ammonia) | 5.5 | 5.5 |
| [rinsing solution] | | |
| sodium chloroisocyanurate | 0.02 g | 0.02 g |
| deionized water (conductivity: 5 μs/cm or less) | 1000 mL | 1000 mL |
| pH | 6.5 | 6.5 |

Samples 301a to 322a, 301b to 326b, 301c to 315c, and 301d to 314d (with the proviso that 301a, 301b, and 301d are the common samples) were prepared in the same way as in the preparation of Sample 202 (Sample 202c was used in Samples 301c to 315c), except that the high-boiling-point organic solvent used in the 2nd and 4th layers was replaced with the noncoloring compounds, respectively, shown in the following Tables 6 to 9. These samples were stored for 10 days under a condition of 25° C. and 55% RH. After that, these samples were subjected to the following assessments.

Assessment 1 [Color Mixing Prevention in Processing]

The samples were subjected to separation exposure of 0.1 second at 250 lux. second using a sensitometer (manufactured by Fuji Photo Film Co., Ltd., model FWH, light source temperature: 3,200° K). The samples after the exposure were processed according to the process B. After that, the magenta density (Y(M)) that gave a yellow density of 2.0 in the yellow colored portion and the cyan density (M(C)) that gave a magenta density of 2.0 in the magenta colored portion were measured. Based on the values thus obtained, the degree of color mixing in the processing was assessed. The smaller the value is, the better the color purity.

Assessment 2 [Storability in a State before Exposure-magenta-]

The samples were further stored for 2 days under a condition of 40° C. and 90% RH.

Before and after the storage, the samples were subjected to separation exposure described above and processed according to the process A. After that, magenta Dmax was measured and the density change between before and after the storage (MDmax=Dmax(before storage)−Dmax(after storage)) was calculated.

Assessment 3 [Storability in a State before Exposure-magenta-]

The density change (MDmax=Dmax(before storage)−Dmax(after storage)) was calculated in the same way as in the assessment 2, except that the storing condition was changed from the condition of 40° C. and 90% RH for 2 days to a condition of 30° C. and 100% RH for 5 days.

Assessment 4 [Storability in a State before Exposure-cyan-]

The samples were further stored for 7 days under a condition of 30° C. and 80% RH.

Before and after the storage, the samples were subjected to separation exposure described above and processed according to the process A. After that, cyan Dmax was measured and the density change between before and after the storage (CDmax=Dmax(before storage)−Dmax(after storage)) was calculated.

TABLE 6

Assessment results of the silver halide photosensitive materials using the noncoloring compounds represented by the general formula (a)

| Sample No. | Kinds of noncoloring compounds | Color mixing in processing*1 Y(M) | M(C) | ΔMDmax*2 | Remarks |
|---|---|---|---|---|---|
| 301a | — | 0.50 | 0.45 | 0.23 | Comparative Example |
| 302a | Comparative compound a | 0.33 | 0.34 | 0.17 | Comparative Example |
| 303a | Comparative compound b | 0.30 | 0.33 | 0.21 | Comparative Example |
| 304a | Comparative compound c | 0.37 | 0.37 | 0.11 | Comparative Example |
| 305a | Comparative compound d | 0.40 | 0.36 | 0.12 | Comparative Example |
| 306a | Comparative compound e | 0.37 | 0.37 | 0.13 | Comparative Example |
| 307a | Comparative compound f | 0.38 | 0.34 | 0.12 | Comparative Example |
| 308a | Comparative compound g | 0.37 | 0.36 | 0.10 | Comparative Example |
| 309a | Exemplary compound a-1 | 0.30 | 0.32 | 0.09 | Example |
| 310a | Exemplary compound a-2 | 0.30 | 0.31 | 0.09 | Example |
| 311a | Exemplary compound a-3 | 0.29 | 0.32 | 0.08 | Example |
| 312a | Exemplary compound a-4 | 0.30 | 0.30 | 0.09 | Example |
| 313a | Exemplary compound a-9 | 0.31 | 0.32 | 0.07 | Example |
| 314a | Exemplary compound a-16 | 0.32 | 0.34 | 0.06 | Example |
| 315a | Exemplary compound a-18 | 0.30 | 0.33 | 0.06 | Example |
| 316a | Exemplary compound a-21 | 0.31 | 0.34 | 0.06 | Example |
| 317a | Exemplary compound a-23 | 0.30 | 0.33 | 0.07 | Example |
| 318a | Exemplary compound a-24 | 0.31 | 0.33 | 0.07 | Example |
| 319a | Exemplary compound a-29 | 0.30 | 0.33 | 0.06 | Example |
| 320a | Exemplary compound a-30 | 0.32 | 0.33 | 0.06 | Example |
| 321a | Exemplary compound a-31 | 0.30 | 0.33 | 0.06 | Example |
| 322a | Exemplary compound a-32 | 0.30 | 0.33 | 0.06 | Example |

*1: assessment 1, *2: assessment 2

In Table 6, the numbers attached to the exemplary compounds indicate the respective numbers attached to the exemplary noncoloring compounds represented by the general formula (a) previously described. The comparative compounds a to g are the same as the comparative compounds a to g shown in Table 2. From the results shown in Table 6, it can be seen that the use of the noncoloring compounds represented by the general formula (a) provides a silver halide color photographic photosensitive material excellent in both prevention of color mixing in processing and storability in a state before exposure (i.e., storability as a raw silver halide color photographic photosensitive material). That is, in the silver halide color photographic photosensitive material of the present invention, excellent color purity is obtained and high-contrast images, which are characterized by remarkably little reduction in color developability (i.e., Mdmax is small) even under a condition of high temperature and high humidity, can be formed in a stable manner because intra-layer solvent migration is inhibited. Besides, samples, which were prepared in the same way as in the preparation of Sample 201 and Samples 203 to 206, except that the same alteration as in the preparation of Samples 301a to 322a was made, provided nearly the same effect.

In Table 7, the numbers attached to the exemplary compounds indicate the respective numbers attached to the exemplary noncoloring compounds represented by the general formula (b) previously described. The comparative compounds a to o are the same as the comparative compounds a to o shown in Table 3.

From the results shown in Table 7, it can be seen that the use of the noncoloring compounds represented by the general formula (b) provides a silver halide color photographic photosensitive material excellent in both prevention of color mixing in processing and storability in a state before exposure. Besides, samples, which were prepared in the same way as in the preparation of Sample 201 and Samples 203 to 206, except that the high-boiling-point organic solvents were changed to the noncoloring compounds represented by the general formula (b) as in Samples 301b to 326b, provided nearly the same effect.

TABLE 7

Assessment results of the silver halide photosensitive materials using the noncoloring compounds represented by the general formula (b)

| Sample No. | Kinds of noncoloring compounds | Color mixing in processing*1 Y(M) | M(C) | ΔMDmax*2 | Remarks |
|---|---|---|---|---|---|
| 301b | — | 0.50 | 0.45 | 0.23 | Comparative Example |
| 302b | Comparative compound a | 0.33 | 0.34 | 0.17 | Comparative Example |
| 303b | Comparative compound b | 0.34 | 0.34 | 0.15 | Comparative Example |
| 304b | Comparative compound c | 0.37 | 0.37 | 0.11 | Comparative Example |
| 305b | Comparative compound d | 0.40 | 0.36 | 0.12 | Comparative Example |
| 306b | Comparative compound e | 0.37 | 0.37 | 0.13 | Comparative Example |
| 307b | Comparative compound f | 0.38 | 0.34 | 0.12 | Comparative Example |
| 308b | Comparative compound g | 0.41 | 0.40 | 0.17 | Comparative Example |
| 309b | Comparative compound h | 0.38 | 0.38 | 0.18 | Comparative Example |
| 310b | Comparative compound i | 0.35 | 0.37 | 0.17 | Comparative Example |
| 311b | Comparative compound j | 0.38 | 0.36 | 0.17 | Comparative Example |
| 312b | Comparative compound k | 0.38 | 0.37 | 0.16 | Comparative Example |
| 313b | Comparative compound l | 0.37 | 0.36 | 0.18 | Comparative Example |
| 314b | Comparative compound m | 0.40 | 0.39 | 0.19 | Comparative Example |
| 315b | Comparative compound n | 0.41 | 0.40 | 0.20 | Comparative Example |
| 316b | Comparative compound o | 0.30 | 0.33 | 0.21 | Comparative Example |
| 317b | Exemplary compound b-1 | 0.30 | 0.32 | 0.09 | Present invention |
| 318b | Exemplary compound b-2 | 0.30 | 0.31 | 0.09 | Present invention |
| 319b | Exemplary compound b-3 | 0.29 | 0.32 | 0.08 | Present invention |
| 320b | Exemplary compound b-4 | 0.30 | 0.30 | 0.09 | Present invention |
| 321b | Exemplary compound b-9 | 0.31 | 0.32 | 0.07 | Present invention |
| 322b | Exemplary compound b-16 | 0.30 | 0.34 | 0.06 | Present invention |
| 323b | Exemplary compound b-18 | 0.31 | 0.33 | 0.06 | Present invention |
| 324b | Exemplary compound b-21 | 0.32 | 0.34 | 0.06 | Present invention |
| 325b | Exemplary compound b-24 | 0.30 | 0.33 | 0.07 | Present invention |
| 326b | Exemplary compound b-25 | 0.31 | 0.33 | 0.07 | Present invention |

*1: assessment 1, *2: assessment 2

TABLE 8

| Sample No. | Kinds of noncoloring compounds | ΔMDmax*1 | Remarks |
|---|---|---|---|
| | Assessment results of the silver halide photosensitive materials using the noncoloring compounds represented by the general formula (c) | | |
| 301c | — | 0.30 | Comparative Example |
| 302c | Comparative compound a | 0.25 | Comparative Example |
| 303c | Comparative compound b | 0.24 | Comparative Example |
| 304c | Comparative compound c | 0.25 | Comparative Example |
| 305c | Comparative compound d | 0.23 | Comparative Example |
| 306c | Comparative compound e | 0.27 | Comparative Example |
| 307c | Exemplary compound 1 | 0.10 | Present invention |
| 308c | Exemplary compound 2 | 0.09 | Present invention |
| 309c | Exemplary compound 3 | 0.08 | Present invention |
| 310c | Exemplary compound 4 | 0.09 | Present invention |
| 311c | Exemplary compound c-9 | 0.08 | Present invention |
| 312c | Exemplary compound c-10 | 0.07 | Present invention |
| 313c | Exemplary compound c-12 | 0.08 | Present invention |
| 314c | Exemplary compound c-13 | 0.09 | Present invention |
| 315c | Exemplary compound c-19 | 0.07 | Present invention |

*1: assessment 3

In Table 8, the numbers attached to the exemplary compounds indicate the respective numbers attached to the exemplary noncoloring compounds represented by the general formula (c) previously described. The comparative compounds a to e are the same as the comparative compounds a to e shown in Table 4.

From the results shown in Table 8, it can be seen that the use of the noncoloring compounds represented by the general formula (c) provides a silver halide color photographic photosensitive material excellent in storability. Besides, samples, which were prepared in the same way as in the preparation of Samples 201c, 203c, and 204c, except that the same alteration as in Samples 301c to 315c was made, provided nearly the same effect.

From the results shown in Table 9, it can be seen that the use of the noncoloring compounds represented by the general formula (d) provides a silver halide color photographic photosensitive material excellent in both prevention of color mixing in processing and storability in a state before exposure. Besides, samples, which were prepared in the same way as in the preparation of Sample 201 and Samples 203 to 206, except that the same alteration as in Samples 301d to 314d was made, provided nearly the same effect.

Example 3

Assessment of Humidity and Heat Resistance and Lightfastness

Samples 401a to 416a were prepared in the same way as in the preparation of Sample 304a, except that the high-boiling-point organic solvent used in the 1st layer was replaced with the noncoloring compounds, respectively, shown in the following Table 10. These samples were subjected to the following assessments. The results of the assessments are shown in Table 10.

TABLE 9

| Sample No. | Kinds of noncoloring compounds | Color mixing in processing*1 Y(M) | M(C) | ΔCDmax*2 | Remarks |
|---|---|---|---|---|---|
| | Assessment results of the silver halide photosensitive materials using the noncoloring compounds represented by the general formula (d) | | | | |
| 301d | — | 0.50 | 0.45 | 0.24 | Comparative Example |
| 302d | Comparative compound a | 0.30 | 0.34 | 0.22 | Comparative Example |
| 303d | Comparative compound b | 0.32 | 0.33 | 0.20 | Comparative Example |
| 304d | Comparative compound c | 0.32 | 0.33 | 0.20 | Comparative Example |
| 305d | Comparative compound d | 0.32 | 0.33 | 0.19 | Comparative Example |
| 306d | Comparative compound e | 0.31 | 0.34 | 0.20 | Comparative Example |
| 307d | Comparative compound f | 0.31 | 0.34 | 0.20 | Comparative Example |
| 308d | Comparative compound g | 0.32 | 0.34 | 0.20 | Comparative Example |
| 309d | Comparative compound h | 0.32 | 0.34 | 0.20 | Comparative Example |
| 310d | Exemplary compound d-12 | 0.30 | 0.33 | 0.07 | Present invention |
| 311d | Exemplary compound d-13 | 0.30 | 0.33 | 0.07 | Present invention |
| 312d | Exemplary compound d-21 | 0.30 | 033 | 0.05 | Present invention |
| 313d | Exemplary compound d-30 | 0.30 | 0.33 | 0.05 | Present invention |
| 314d | Exemplary compound d-31 | 0.30 | 0.33 | 0.05 | Present invention |

*1: assessment 1, *2: assessment 4

In Table 9, the numbers attached to the exemplary compounds indicate the respective numbers attached to the exemplary noncoloring compounds represented by the general formula (d) previously described. The comparative compounds a to h are the same as the comparative compounds a to h shown in Table 5.

Assessment 5 [Humidity and Heat Resistance of Yellow Dyes]

The samples were subjected to separation exposure and thereafter processed according to the process A. After that, the samples were stored for 28 days under a condition of 80° C. and 70% RH. The change of density before and after the storage in the yellow-colored portion was measured in the following way. That is, the density (D) of the point that gave a density of 2.0 ($D_0$) in the yellow-colored portion before the storage was measured after the storage and the density retention ratio (%) ($D/(D_0)\times100$) was calculated.

TABLE 10

| | Results of assessment of humidity and heat resistance of the silver halide photosensitive materials using the noncoloring compounds represented by the general formula (a) | | |
|---|---|---|---|
| Sample No. | Kinds of noncoloring compounds | Humidity and heat resistance (density retention ratio (%) $[D/(D_0) \times 100]$ | Remarks |
| 401a | Comparative compound a | 74 | Comparative Example |
| 402a | Comparative compound b | 69 | Comparative Example |
| 403a | Comparative compound c | 73 | Comparative Example |
| 404a | Comparative compound d | 72 | Comparative Example |
| 405a | Comparative compound e | 73 | Comparative Example |
| 406a | Comparative compound f | 72 | Comparative Example |
| 407a | Comparative compound g | 76 | Comparative Example |
| 408a | Exemplary compound a-1 | 82 | Example |
| 409a | Exemplary compound a-2 | 80 | Example |
| 410a | Exemplary compound a-3 | 81 | Example |
| 411a | Exemplary compound a-7 | 82 | Example |
| 412a | Exemplary compound a-8 | 80 | Example |
| 413a | Exemplary compound a-10 | 79 | Example |
| 414a | Exemplary compound a-11 | 81 | Example |
| 415a | Exemplary compound a-15 | 82 | Example |
| 416a | Exemplary compound a-17 | 82 | Example |

In Table 10, the numbers attached to the exemplary compounds indicate the respective numbers attached to the exemplary noncoloring compounds represented by the general formula (a) previously described. The comparative compounds a to g are the same as the comparative compounds a to g shown in Table 2.

From the results shown in Table 10, it can be seen that the use of the noncoloring compounds represented by the general formula (a) provides a silver halide color photographic photosensitive material excellent in humidity and heat resistance (i.e., excellent in image preservation)

Samples 401b to 424b were prepared in the same way as in the preparation of Sample 304b in Table 7, except that the high-boiling-point organic solvent was changed according to the following Table 11. The samples thus prepared were subjected to the assessment 5 described above.

The results of the assessment are shown in the following Table 11.

Table 11 Results of assessment of humidity and heat resistance of the silver halide photosensitive materials using the noncoloring compounds represented by the general formula (b).

TABLE 11

| Sample No. | Kinds of high-boiling-point organic solvent | Humidity and heat resistance (density retention ratio (%) [D/(D$_0$) × 100] | Remarks |
|---|---|---|---|
| | Results of assessment of humidity and heat resistance of the silver halide photosensitive materials using the noncoloring compounds represented by the general formula (b) | | |
| 401b | Comparative compound a | 74 | Comparative Example |
| 402b | Comparative compound b | 75 | Comparative Example |
| 403b | Comparative compound c | 73 | Comparative Example |
| 404b | Comparative compound d | 72 | Comparative Example |
| 405b | Comparative compound e | 73 | Comparative Example |
| 406b | Comparative compound f | 72 | Comparative Example |
| 407b | Comparative compound g | 76 | Comparative Example |
| 408b | Comparative compound h | 77 | Comparative Example |
| 409b | Comparative compound i | 76 | Comparative Example |
| 410b | Comparative compound j | 76 | Comparative Example |
| 411b | Comparative compound k | 77 | Comparative Example |
| 412b | Comparative compound l | 78 | Comparative Example |
| 413b | Comparative compound m | 76 | Comparative Example |
| 414b | Comparative compound n | 76 | Comparative Example |
| 415b | Comparative compound o | 69 | Comparative Example |
| 416b | Exemplary compound b-1 | 82 | Present invention |
| 417b | Exemplary compound b-2 | 80 | Present invention |
| 418b | Exemplary compound b-6 | 81 | Present invention |
| 419b | Exemplary compound b-7 | 82 | Present invention |
| 420b | Exemplary compound b-8 | 80 | Present invention |
| 421b | Exemplary compound b-10 | 79 | Present invention |
| 422b | Exemplary compound b-11 | 81 | Present invention |
| 423b | Exemplary compound b-15 | 82 | Present invention |
| 424b | Exemplary compound b-17 | 82 | Present invention |

In Table 11, the numbers attached to the exemplary compounds indicate the respective numbers attached to the exemplary noncoloring compounds represented by the general formula (b) previously described. The comparative compounds a to o are the same as the comparative compounds a to o shown in Table 3.

From the results shown in Table 11, it can be seen that the use of the noncoloring compounds represented by the general formula (b) provides a silver halide color photographic photosensitive material excellent in humidity and heat resistance.

Samples 401c to 415c were prepared in the same way as in the preparation of Sample 304c in Table 8, except that the high-boiling-point organic solvent was changed according to the following Table 12. The samples thus prepared were subjected to the following assessment. The results are shown in Table 12.

Assessment 6 [Humidity and Heat Resistance of Yellow Dyes]

The density retention ratio (%) (D/(D$_0$)×100) in the yellow-colored portion was calculated in the same way as in the assessment 5, except that the samples after being processed were stored for 20 days under a condition of 80° C. and 50% RH instead of 28 days under a condition of 80° C. and 70% RH.

TABLE 12

| Sample No. | Kinds of high-boiling-point organic solvent | Humidity and heat resistance (density retention ratio (%) [D/(D$_0$) × 100] | Remarks |
|---|---|---|---|
| | Results of assessment of humidity and heat resistance of the silver halide photosensitive materials using the noncoloring compounds represented by the general formula (c) | | |
| 401c | Comparative compound a | 80 | Comparative Example |
| 402c | Comparative compound b | 82 | Comparative Example |
| 403c | Comparative compound c | 82 | Comparative Example |
| 404c | Comparative compound d | 83 | Comparative Example |
| 405c | Comparative compound e | 75 | Comparative Example |
| 406c | Exemplary compound c-1 | 90 | Present invention |
| 407c | Exemplary compound c-2 | 90 | Present invention |
| 408c | Exemplary compound c-3 | 91 | Present invention |
| 409c | Exemplary compound c-4 | 92 | Present invention |
| 410c | Exemplary compound c-9 | 90 | Present invention |
| 411c | Exemplary compound c-10 | 91 | Present invention |
| 412c | Exemplary compound c-12 | 92 | Present invention |

TABLE 12-continued

| Results of assessment of humidity and heat resistance of the silver halide photosensitive materials using the noncoloring compounds represented by the general formula (c) | | | |
|---|---|---|---|
| Sample No. | Kinds of high-boiling-point organic solvent | Humidity and heat resistance (density retention ratio (%) $[D/(D_0) \times 100]$ | Remarks |
| 413c | Exemplary compound c-13 | 92 | Present invention |
| 414c | Exemplary compound c-19 | 91 | Present invention |

In Table 12, the numbers attached to the exemplary compounds indicate the respective numbers attached to the exemplary noncoloring compounds represented by the general formula (c) previously described. The comparative compounds a to e are the same as the comparative compounds a to e shown in Table 4.

From the results shown in Table 12, it can be seen that the use of the noncoloring compounds represented by the general formula (c) provides a silver halide color photographic photosensitive material excellent in humidity and heat resistance.

Samples 401d to 413d were prepared in the same way as in the preparation of Sample 202 in Example 2, except that part of the high-boiling-point organic solvent (Solv-3 and Solv-4) for the 3rd layer was changed according to the following Table 13. The samples thus prepared were subjected to the following assessment. The results of the assessment are shown in Table 13.

Assessment 7 [Lightfastness of Magenta Dyes]

The samples were subjected to separation exposure and thereafter processed according to the process A. After that, the samples were irradiated with xenon light at 100,000 lux for 20 days. The change of density before and after the irradiation in the magenta-colored portion was measured in the following way. That is, the density (D) of the point that gave a density of 0.5 ($D_0$) in the magenta-colored portion before the irradiation was measured after the irradiation and the density retention ratio (%) $(D/(D_0)\times100)$ was calculated.

TABLE 13

| Results of assessment of lightfastness of the silver halide photosensitive materials using the noncoloring compounds represented by the general formula (d) | | | |
|---|---|---|---|
| Sample No. | Kinds of high-boiling-point organic solvent | Lightfastness density retention ratio (%) $(D/D_0 \times 100)$ | Remarks |
| 401d | Comparative compound a | 50 | Comparative Example |
| 402d | Comparative compound b | 53 | Comparative Example |
| 403d | Comparative compound c | 53 | Comparative Example |
| 404d | Comparative compound d | 53 | Comparative Example |
| 405d | Comparative compound a | 53 | Comparative Example |
| 406d | Comparative compound b | 53 | Comparative Example |
| 407d | Comparative compound c | 50 | Comparative Example |
| 408d | Comparative compound d | 50 | Comparative Example |
| 409d | Exemplary compound d-12 | 65 | Present invention |
| 410d | Exemplary compound d-13 | 65 | Present invention |
| 411d | Exemplary compound d-21 | 65 | Present invention |
| 412d | Exemplary compound d-30 | 60 | Present invention |
| 413d | Exemplary compound d-31 | 60 | Present invention |

In Table 13, the numbers attached to the exemplary compounds indicate the respective numbers attached to the exemplary noncoloring compounds represented by the general formula (d) previously described. The comparative compounds a to d are the same as the comparative compounds a to d shown in Table 5.

From the results shown in Table 13, it can be seen that the use of the noncoloring compounds represented by the general formula (d) provides a silver halide color photographic photosensitive material excellent in lightfastness.

Example 4

The following layers were formed on a 127 μm-thick cellulose triacetate support that had been coated with a subbing layer. In this way, a multilayer color photosensitive sample 501 as a Comparative Example was prepared. The figures given below indicate the amounts added per $m^2$. Besides, it should be noted that the effects of the compounds added are not limited to the effects described. Likewise, Sample 501c was prepared by employing the figure indicated in the following [ ]. The figure in [ ] is the amount used or value for Sample 501c.

| | |
|---|---|
| The 1st layer: antihalation layer | |
| Black colloidal silver | 0.20 g |
| Gelatin | 2.00 g |
| Ultraviolet absorbing agent U-1 | 0.10 g |
| Ultraviolet absorbing agent U-3 | 0.10 g |
| Ultraviolet absorbing agent U-4 | 0.10 g |
| High-boiling-point organic solvent Oil-1 | 0.10 g |
| High-boiling-point organic solvent Oil-5 | 0.010 g |
| Dye D-4 | 1.0 mg |
| Dye D-8 | 2.5 mg |
| Dispersion of solid crystal particles of a dye E-1 | 0.05 g |
| The 2nd layer: interlayer | |
| Gelatin | 0.30 [0.50] g |
| Compound Cpd-A | 0.2 mg |
| Compound Cpd-J | 1.0 mg |
| Compound Cpd-K | 3.0 mg |
| Compound Cpd-M | 0.030 g |
| Ultraviolet absorbing agent U-6 | 6.0 mg |
| High-boiling-point organic solvent Oil-3 | 0.010 g |
| High-boiling-point organic solvent Oil-4 | 0.010 g |
| High-boiling-point organic solvent Oil-7 | 2.0 mg |
| High-boiling-point organic solvent Oil-8 | 4.0 mg |
| Dye D-7 | 4.0 mg |
| The 3rd layer: interlayer | |
| Yellow colloidal silver | 0.010 g |
| Gelatin | 0.80 [0.50] g |
| Compound Cpd-M | 0.020 g |
| High-boiling-point organic solvent Oil-3 | 0.010 g |
| The 4th layer: low-speed red-sensitive emulsion layer | |
| Emulsion A amount of silver | 0.10 [0.20] g |
| Emulsion B amount of silver | 0.20 [0.10] g |
| Emulsion C amount of silver | 0.15 [0.20] g |
| Gelatin | 0.70 g |
| Coupler C-1 | 0.050 g |

-continued

| | |
|---|---|
| Coupler C-2 | 0.10 g |
| Coupler C-3 | 0.010 g |
| Coupler C-6 | 6.0 mg |
| Coupler C-9 | 5.0 mg |
| Coupler C-11 | 0.030 g |
| Ultraviolet absorbing agent U-1 | 0.010 g |
| Ultraviolet absorbing agent U-2 | 0.010 g |
| Compound Cpd-A | 1.0 mg |
| Compound Cpd-I | 0.020 g |
| Compound Cpd-J | 2.0 mg |
| High-boiling-point organic solvent Oil-2 | 0.10 g |
| High-boiling-point organic solvent Oil-5 | 0.010 g |
| Additive P-1 | 0.020 g |

The 5th layer: medium-speed red-sensitive emulsion layer

| | |
|---|---|
| Emulsion C amount of silver | 0.20 [0.25] g |
| Emulsion D amount of silver | 0.20 [0.25] g |
| Gelatin | 0.80 g |
| Coupler C-1 | 0.040 g |
| Coupler C-2 | 0.13 g |
| Coupler C-3 | 0.020 g |
| Coupler C-6 | 7.0 mg |
| Coupler C-11 | 0.050 g |
| Ultraviolet absorbing agent U-1 | 0.010 g |
| Ultraviolet absorbing agent U-2 | 0.010 g |
| High-boiling-point organic solvent Oil-2 | 0.10 g |
| Additive P-1 | 0.020 g |

The 6th layer: high-speed red-sensitive emulsion layer

| | |
|---|---|
| Emulsion E amount of silver | 0.25 g |
| Emulsion F amount of silver | 0.20 [0.25] g |
| Gelatin | 1.50 g |
| Coupler C-1 | 0.10 g |
| Coupler C-3 | 0.70 [0.80] g |
| Coupler C-6 | 0.010 g |
| Coupler C-11 | 0.20 g |
| Ultraviolet absorbing agent U-1 | 0.010 g |
| Ultraviolet absorbing agent U-2 | 0.010 g |
| High-boiling-point organic solvent Oil-1 | 0.10 g |
| High-boiling-point organic solvent Oil-9 | 0.010 g |
| Compound Cpd-L | 1.0 mg |
| Compound Cpd-F | 0.050 g |
| Additive P-1 | 0.10 g |

The 7th layer: interlayer

| | |
|---|---|
| Gelatin | 1.00 [0.80] g |
| Additive P-2 | 0.10 g |
| Compound Cpd-I | 0.010 g |
| Dye D-5 | 0.020 g |
| Dye D-9 | 6.0 mg |
| Compound Cpd-M | 0.040 g |
| Compound Cpd-O | 3.0 mg |
| Compound Cpd-P | 5.0 mg |
| High-boiling-point organic solvent Oil-1 | 0.070 g |

The 8th layer: interlayer

| | |
|---|---|
| Yellow colloidal silver amount of silver | 0.010 [0.020] g |
| Gelatin | 1.00 g |
| Additive P-2 | 0.05 g |
| Ultraviolet absorbing agent U-1 | 0.010 g |
| Ultraviolet absorbing agent U-3 | 0.010 g |
| Compound Cpd-A | 0.050 g |
| Compound Cpd-M | 0.050 g |
| High-boiling-point organic solvent Oil-3 | 0.010 g |
| High-boiling-point organic solvent Oil-1 | 0.070 g |

The 9th layer: low-speed green-sensitive emulsion layer

| | |
|---|---|
| Emulsion G amount of silver | 0.40 g |
| Emulsion H amount of silver | 0.20 g |
| Emulsion I amount of silver | 0.30 [0.35] g |
| Gelatin | 1.80 [1.50] g |
| Coupler C-4 | 0.020 g |
| Coupler C-7 | 0.10 g |
| Coupler C-8 | 0.070 g |
| Coupler C-12 | 0.020 g |
| Coupler C-13 | 0.010 g |
| Compound Cpd-B | 0.030 g |
| Compound Cpd-D | 5.0 mg |
| Compound Cpd-E | 5.0 mg |

-continued

| | |
|---|---|
| Compound Cpd-G | 2.5 mg |
| Compound Cpd-F | 0.010 g |
| Compound Cpd-K | 2.0 mg |
| Ultraviolet absorbing agent U-6 | 5.0 mg |
| High-boiling-point organic solvent Oil-1 | 0.15 g |
| High-boiling-point organic solvent Oil-6 | 0.030 g |
| High-boiling-point organic solvent Oil-4 | 8.0 mg |
| Additive P-1 | 5.0 mg |

The 10th layer: medium-speed green-sensitive emulsion layer

| | |
|---|---|
| Emulsion I amount of silver | 0.20 [0.25] g |
| Emulsion J amount of silver | 0.20 [0.25] g |
| Silver bromide emulsion composed of internally fogged grains (cubic grains having a sphere-equivalent average grain diameter of 0.11 μm) amount of silver | 5.0 mg |
| Gelatin | 0.70 g |
| Coupler C-4 | 0.30 g |
| Coupler C-8 | 0.020 g |
| Coupler C-12 | 0.020 g |
| Coupler C-13 | 0.010 g |
| Compound Cpd-B | 0.030 g |
| Compound Cpd-F | 0.010 g |
| Compound Cpd-G | 2.0 mg |
| High-boiling-point organic solvent Oil-1 | 0.050 g |
| High-boiling-point organic solvent Oil-5 | 6.0 mg |

The 11th layer: high-speed green-sensitive emulsion layer

| | |
|---|---|
| Emulsion K amount of silver | 0.50 g |
| Gelatin | 0.80 g |
| Coupler C-3 | 5.0 mg |
| Coupler C-4 | 0.40 [0.45] g |
| Coupler C-8 | 0.010 g |
| Coupler C-12 | 0.020 g |
| Compound Cpd-B | 0.050 g |
| Compound Cpd-F | 0.010 g |
| Compound Cpd-K | 2.0 mg |
| High-boiling-point organic solvent Oil-1 | 0.050 g |

The 12th layer: interlayer

| | |
|---|---|
| Gelatin | 0.30 [0.40] g |
| Compound Cpd-M | 0.05 g |
| High-boiling-point organic solvent Oil-3 | 0.025 g |
| High-boiling-point organic solvent Oil-6 | 0.025 g |
| Dye D-6 | 5.0 mg |

The 13th layer: yellow filter layer

| | |
|---|---|
| Yellow colloidal silver amount of silver | 0.040 [0.010] g |
| Gelatin | 0.70 [0.80] g |
| Compound Cpd-C | 0.010 g |
| Compound Cpd-M | 0.030 g |
| High-boiling-point organic solvent Oil-1 | 0.070 g |
| Dispersion of solid crystal particles of a dye E-2 | 0.015 [0.020] g |

The 14th layer: interlayer

| | |
|---|---|
| Gelatin | 0.50 g |
| Compound Cpd-Q | 0.20 g |

The 15th layer: low-speed blue-sensitive emulsion layer

| | |
|---|---|
| Emulsion L amount of silver | 0.30 g |
| Emulsion M amount of silver | 0.20 [0.25] g |
| Gelatin | 0.80 g |
| Coupler C-5 | 0.30 g |
| Coupler C-6 | 0.010 g |
| Coupler C-10 | 0.030 g |
| Compound Cpd-I | 8.0 mg |
| Compound Cpd-K | 1.0 mg |
| Compound Cpd-M | 5.0 mg |
| Ultraviolet absorbing agent U-6 | 0.010 g |
| High-boiling-point organic solvent Oil-2 | 0.010 g |
| High-boiling-point organic solvent Oil-3 | 0.010 g |

The 16th layer: medium-speed blue-sensitive emulsion layer

| | |
|---|---|
| Emulsion N amount of silver | 0.25 g |
| Emulsion O amount of silver | 0.20 [0.25] g |
| Silver bromide emulsion composed of internally fogged grains (cubic grains having a sphere-equivalent average grain diameter of 0.11 μm) amount of silver | 0.010 [0.003] g |
| Gelatin | 0.90 g |
| Coupler C-5 | 0.40 [0.30] g |

-continued

| | |
|---|---|
| Coupler C-6 | 0.020 g |
| Coupler C-10 | 0.060 g |
| Compound Cpd-N | 2.0 mg |
| High-boiling-point organic solvent Oil-2 | 0.080 g |
| The 17th layer: high-speed blue-sensitive emulsion layer | |
| Emulsion O amount of silver | 0.20 g |
| Emulsion P amount of silver | 0.25 g |
| Gelatin | 2.00 g |
| Coupler C-3 | 5.0 mg |
| Coupler C-5 | 0.20 [0.30] g |
| Coupler C-6 | 0.020 g |
| Coupler C-10 | 1.00 [1.10] g |
| High-boiling-point organic solvent Oil-1 | 0.10 g |
| High-boiling-point organic solvent Oil-6 | 0.020 g |
| Ultraviolet absorbing agent U-6 | 0.10 g |
| Compound Cpd-B | 0.20 g |
| Compound Cpd-N | 5.0 mg |
| The 18th layer: the 1st protective layer | |
| Gelatin | 0.70 [0.90] g |
| Ultraviolet absorbing agent U-1 | 0.10 g |
| Ultraviolet absorbing agent U-2 | 0.050 g |
| Ultraviolet absorbing agent U-5 | 0.20 g |
| Compound Cpd-O | 5.0 mg |
| Compound Cpd-A | 0.030 g |
| Compound Cpd-H | 0.20 g |
| Dye 1 | 8.0 mg |
| Dye 2 | 0.010 g |
| Dye 3 | 0.010 g |
| High-boiling-point organic solvent Oil-1 | 0.10 g |
| The 19th layer: the 2nd protective layer | |
| Colloidal silver amount of silver | 5.0 [6.0] mg |

-continued

| | |
|---|---|
| Silver iodobromide emulsion composed of fine grains (having an average grain diameter of 0.06 μm and an AgI content of 1 mol %) amount of silver | 0.070 g |
| Gelatin | 0.90 g |
| Ultraviolet absorbing agent U-1 | 0.010 g |
| Ultraviolet absorbing agent U-6 | 0.010 g |
| High-boiling-point organic solvent Oil-3 | 0.010 g |
| The 20th layer: the 3rd protective layer | |
| Gelatin | 1.00 [1.20] g |
| Polymethyl methacrylate (particles having an average diameter of 1.5 μm) | 0.10 g |
| Copolymer of methyl methacrylate and methacrylic acid by a ratio of 6:4 (particles having an average diameter of 1.5 μm) | 0.10 g |
| Silicone oil SO-1 | 0.20 g |
| Surfactant W-1 | 3.0 mg |
| Surfactant W-2 | 8.0 mg |
| Surfactant W-3 | 0.040 [0.050] g |
| Surfactant W-7 | 0.015 g |

Besides the components described above, additives F-1 to F-8 were added to each of the emulsion layers. Further, besides the components described above, a gelatin hardener H-1 and surfactants W-3, W-4, W-5, and W-6 for coating and emulsification were added to each of the layers.

Furthermore, phenol, 1,2-benzisothiazoline-3-one, 2-phenoxyethanol, phenethyl alcohol, and p-benzoic acid butyl ester were added as a preservative and a mildew-proofing agent.

TABLE 14

Emulsions used in Samples 501, 502a to 520a, 502b to 522b, 501c to 514c, and 502d to 510d.

| Emulsions | Characteristics | Sphere-equivalent average grain diameter (μm) | Variation coefficient (%) | AgI content (%) |
|---|---|---|---|---|
| A | Monodispersed (111) tabular grain average aspect ratio 2.5 | 0.30 | 15 | 3.0 |
| B | Monodispersed (111) tabular grain average aspect ratio 2.5 | 0.35 | 12 | 3.5 |
| C | Monodispersed (111) tabular grain average aspect ratio 3.5 | 0.55 | 15 | 3.0 |
| D | Monodispersed (111) tabular grain average aspect ratio 3.5 | 0.70 | 12 | 4.0 |
| E | Monodispersed (111) tabular grain average aspect ratio 4.5 | 0.90 | 15 | 3.0 |
| F | Monodispersed (111) tabular grain average aspect ratio 5.0 | 1.20 | 12 | 3.5 |
| G | Monodispersed cubic grains | 0.30 | 10 | 4.0 |
| H | Monodispersed (111) tabular grain average aspect ratio 2.5 | 0.40 | 12 | 4.0 |
| I | Monodispersed (111) tabular grain average aspect ratio 3.0 | 0.55 | 12 | 3.0 |
| J | Monodispersed (111) tabular grain average aspect ratio 3.0 | 0.70 | 15 | 2.5 |
| K | Monodispersed (111) tabular grain average aspect ratio 6.0 | 1.05 | 13 | 2.5 |
| L | Monodispersed (111) tabular grain average aspect ratio 3.5 | 0.45 | 10 | 5.0 |
| M | Monodispersed (111) tabular grain average aspect ratio 4.0 | 0.50 | 12 | 4.0 |
| N | Monodispersed (111) tabular grain average aspect ratio 5.5 | 0.80 | 15 | 2.0 |
| O | Monodispersed (111) tabular grain average aspect ratio 8.0 | 1.10 | 15 | 1.0 |
| P | Monodispersed (111) tabular grain average aspect ratio 10.0 | 1.90 | 15 | 0.8 |

TABLE 15
| Spectral sensitization of Emulsions A to P | | |
|---|---|---|
| Emulsions | Sensitizing dyes added | Amounts (g) added per mole of silver halide |
| A | S-1 | 0.01 |
| | S-2 | 0.35 |
| | S-3 | 0.02 |
| | S-8 | 0.03 |
| | S-13 | 0.015 |
| | S-14 | 0.01 |
| B | S-2 | 0.35 |
| | S-3 | 0.02 |
| | S-8 | 0.03 |
| | S-13 | 0.015 |
| | S-14 | 0.01 |
| C | S-2 | 0.45 |
| | S-3 | 0.04 |
| | S-8 | 0.04 |
| | S-13 | 0.02 |
| D | S-2 | 0.5 |
| | S-3 | 0.05 |
| | S-8 | 0.05 |
| | S-13 | 0.015 |
| E | S-1 | 0.01 |
| | S-2 | 0.45 |
| | S-3 | 0.05 |
| | S-8 | 0.05 |
| | S-13 | 0.01 |
| F | S-2 | 0.4 |
| | S-3 | 0.04 |
| | S-8 | 0.04 |
| G | S-4 | 0.3 |
| | S-5 | 0.05 |
| | S-12 | 0.1 |
| H | S-4 | 0.2 |
| | S-5 | 0.05 |
| | S-9 | 0.15 |
| | S-14 | 0.02 |
| I | S-4 | 0.3 |
| | S-9 | 0.2 |
| | S-12 | 0.1 |
| J | S-4 | 0.35 |
| | S-5 | 0.05 |
| | S-12 | 0.1 |
| K | S-4 | 0.3 |
| | S-9 | 0.05 |
| | S-12 | 0.1 |
| | S-14 | 0.02 |
| L | S-6 | 0.1 |
| | S-10 | 0.2 |
| | S-11 | 0.05 |
| M | S-6 | 0.05 |
| | S-7 | 0.05 |
| | S-10 | 0.25 |
| | S-11 | 0.05 |
| N | S-10 | 0.4 |
| | S-11 | 0.15 |
| O | S-6 | 0.05 |
| | S-7 | 0.05 |
| | S-10 | 0.3 |
| | S-11 | 0.1 |
| P | S-6 | 0.05 |
| | S-7 | 0.05 |
| | S-10 | 0.2 |
| | S-11 | 0.25 |
C-1
TABLE 15-continued
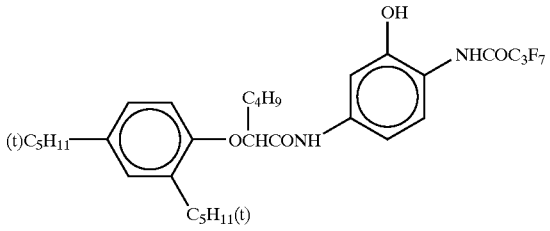
C-2
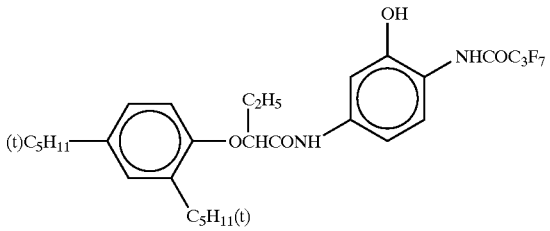
C-3
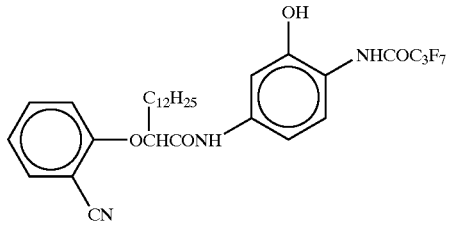
C-4
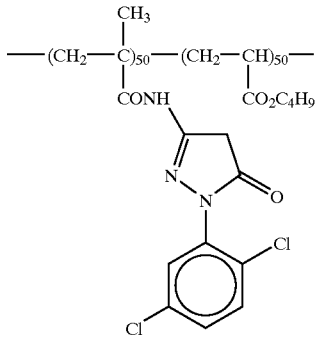
(The number means % by mass)
The average mulecular weight: about 25,000)
C-5
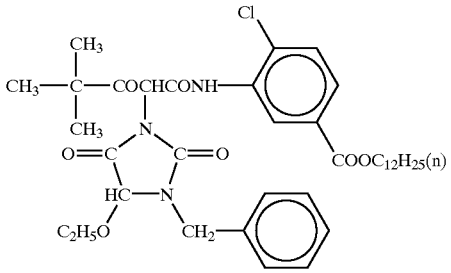
C-6

TABLE 15-continued
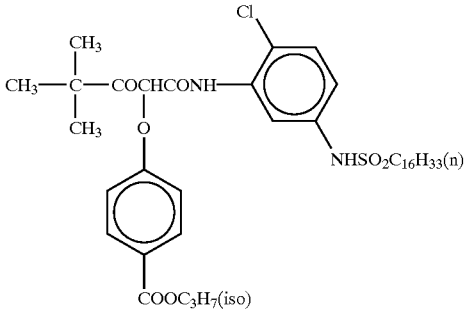
C-7
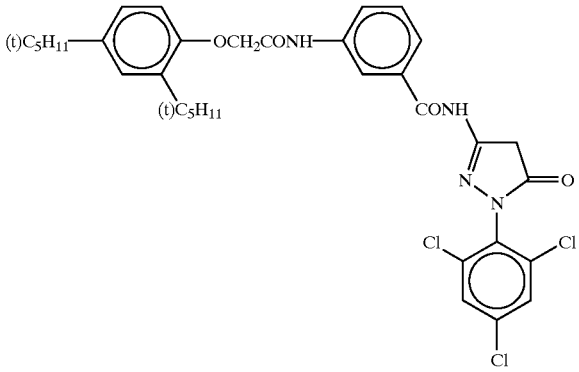
C-8
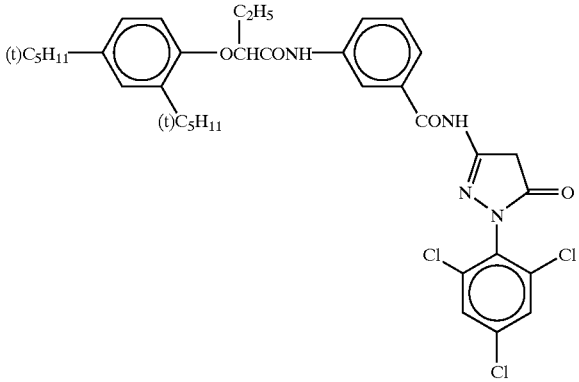
C-9
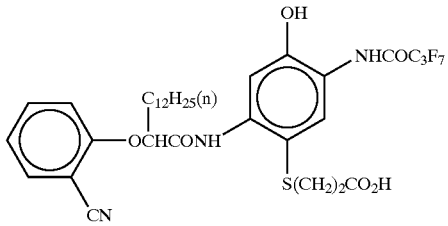
C-10
TABLE 15-continued
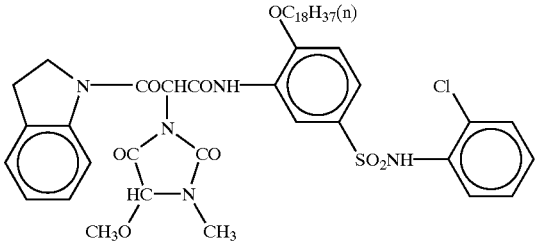
C-11
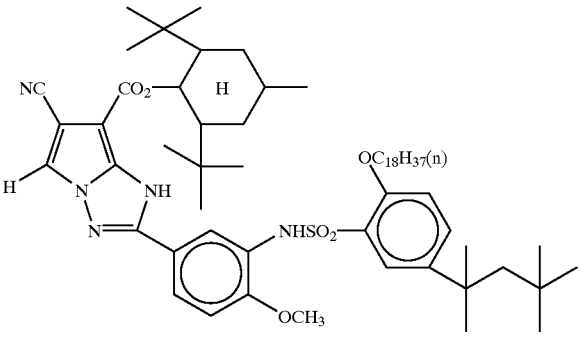
C-12
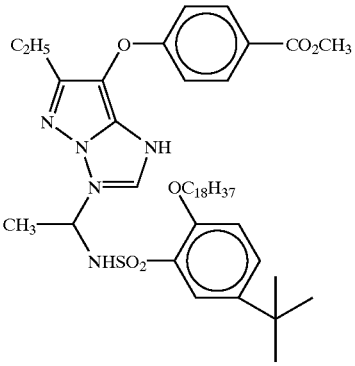
C-13
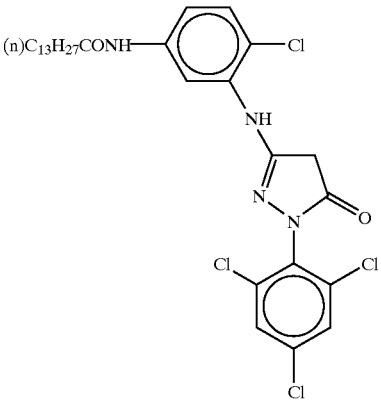
| | |
|---|---|
| Oil-1 | di-n-butyl phthalate |
| Oil-2 | tricresyl phophate |
| Oil-3 | |

TABLE 15-continued
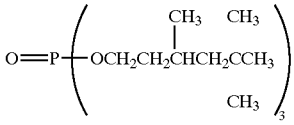
Oil-4 tricyclohexyl phosphate
Oil-5 di-2-ethylhexyl succinate
Oil-6
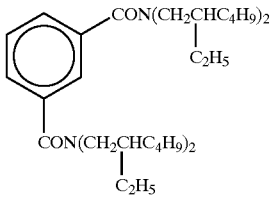
Oil-7
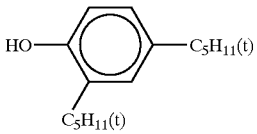
Oil-8 $C_{11}H_{23}CON(C_2H_5)_2$
Oil-9
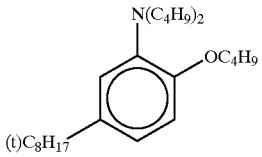
Cpd-A
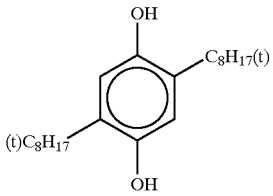
Cpd-B
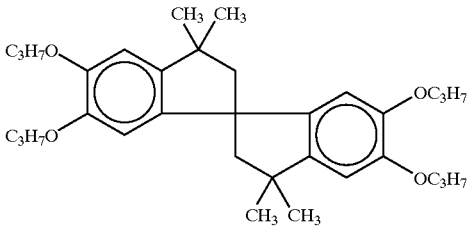
Cpd-C
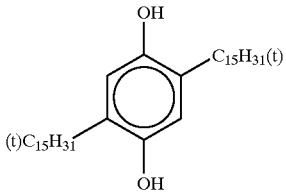
TABLE 15-continued
Cpd-D
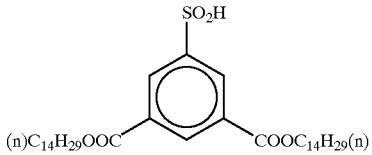
Cpd-E
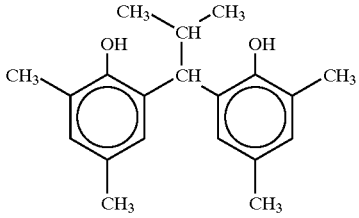
Cpd-F
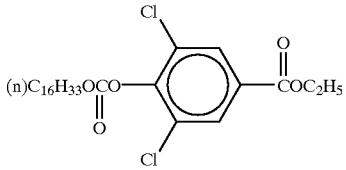
Cpd-G
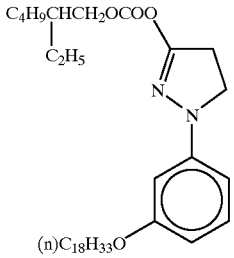
Cpd-H
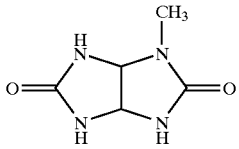
Cpd-I
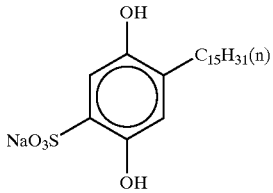
Cpd-J TABLE 15-continued
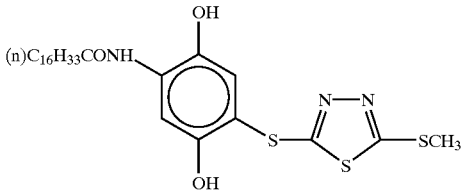
Cpd-K
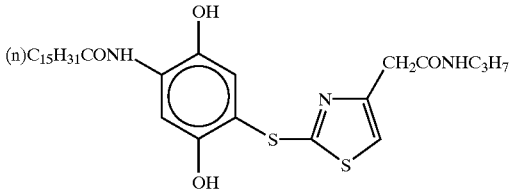
Cpd-L
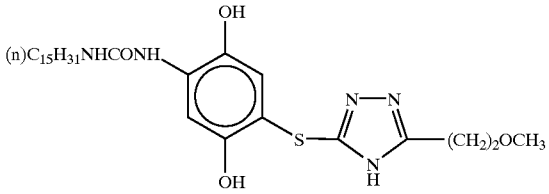
Cpd-M
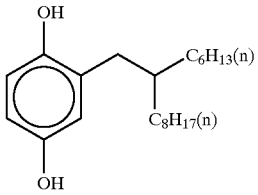
Cpd-N
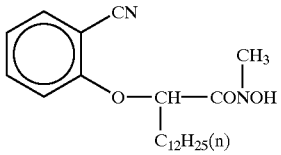
Cpd-O
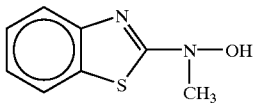
Cpd-P
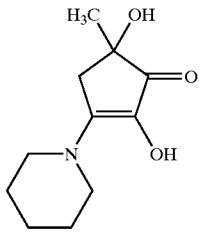
TABLE 15-continued
Cpd-Q
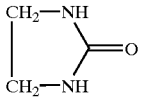
U-1
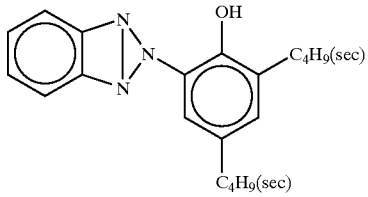
U-2
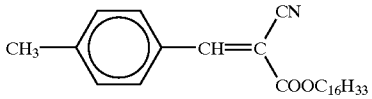
U-3
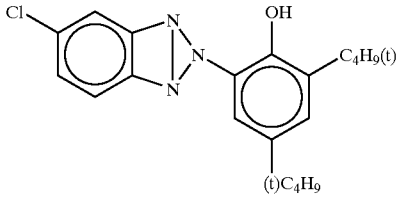
U-4
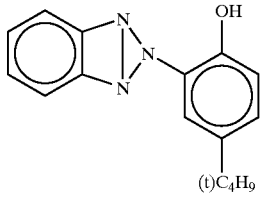
U-5
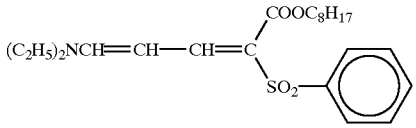
U-6
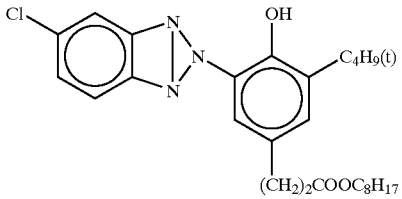
S-1

TABLE 15-continued
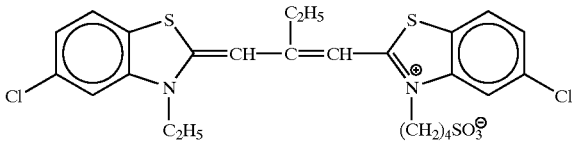
S-2
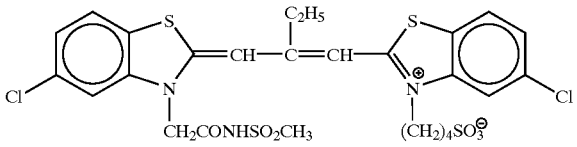
S-3
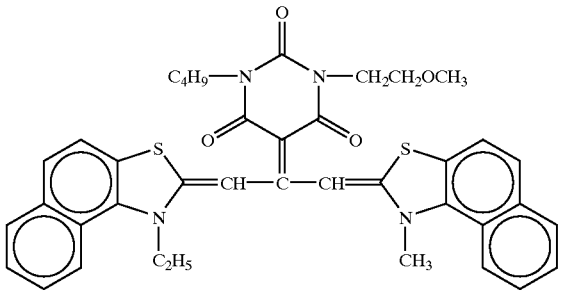
S-4
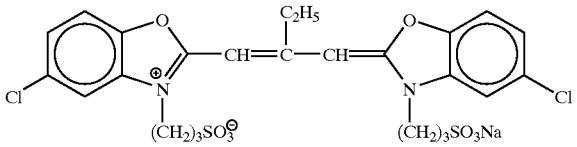
S-5
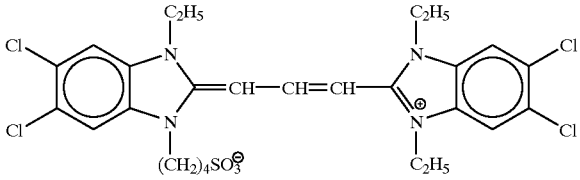
S-6
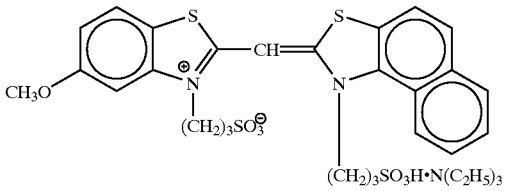
S-7
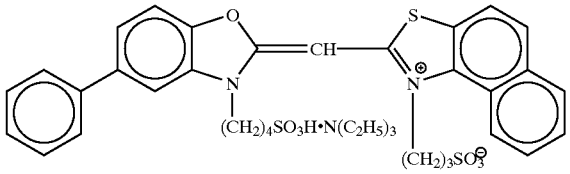
TABLE 15-continued
S-8
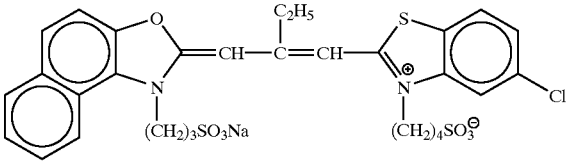
S-9
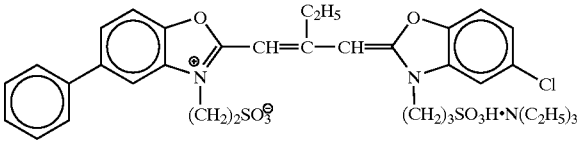
S-10
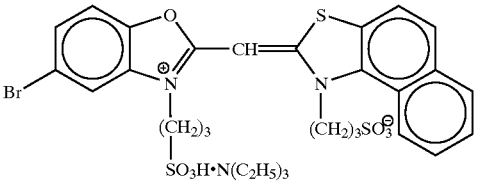
S-11
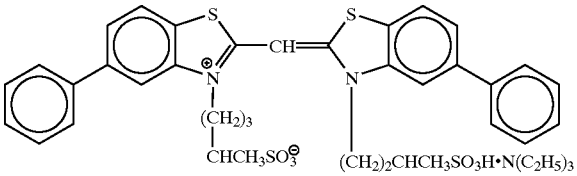
S-12
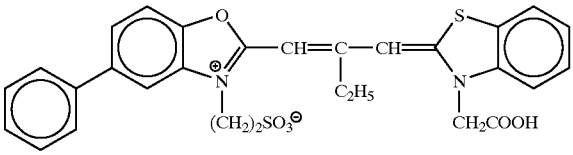
S-13
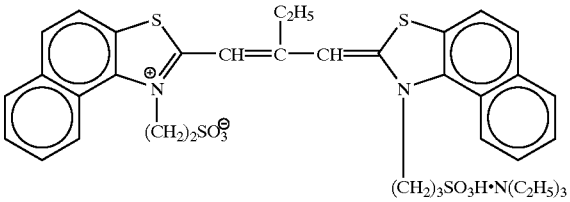
S-14
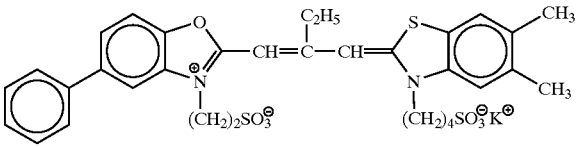
D-1

TABLE 15-continued
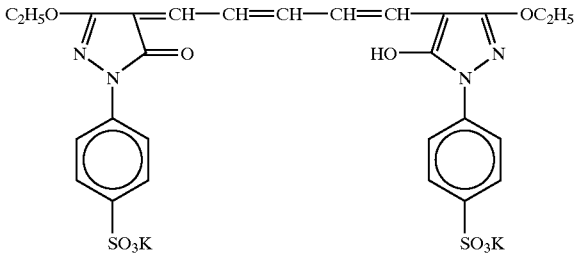
D-2
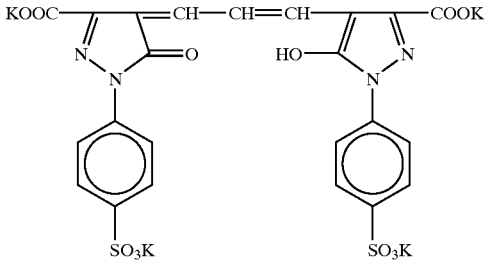
D-3
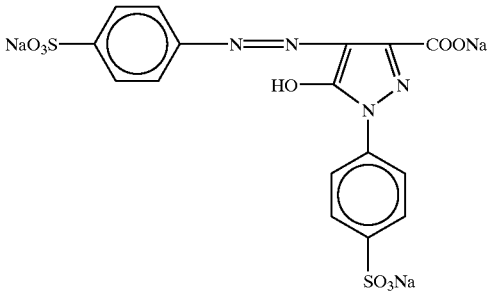
D-4
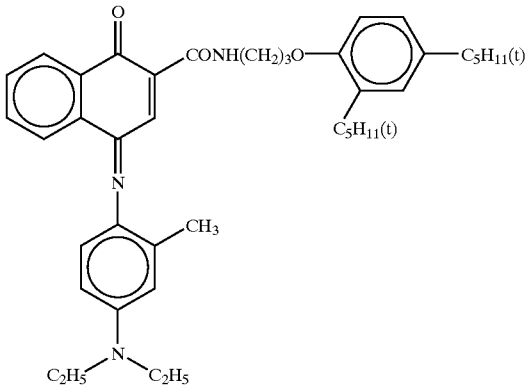
D-5
TABLE 15-continued
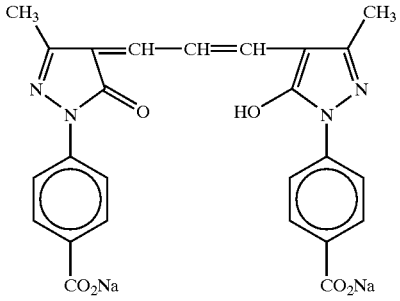
D-6
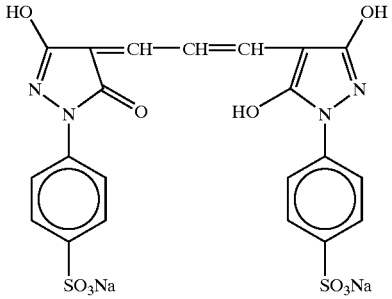
D-7
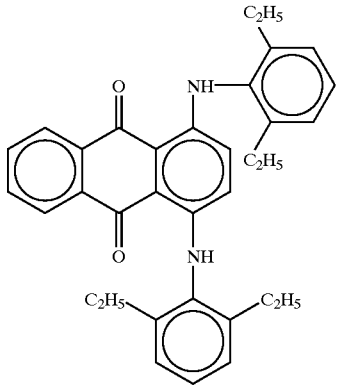
D-8
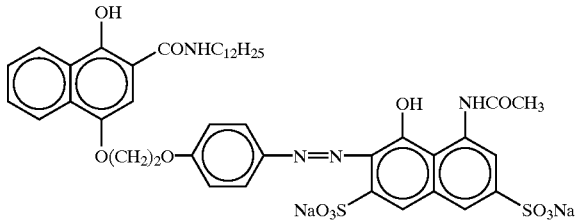
D-9

TABLE 15-continued
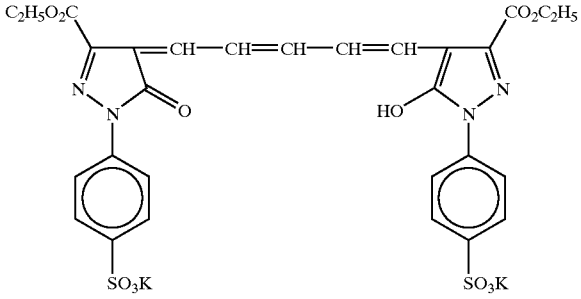
E-1
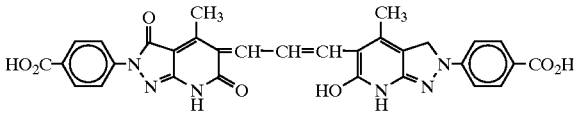
E-2
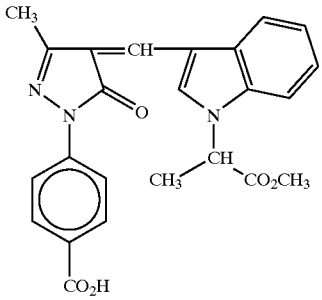
H-1
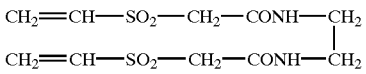
W-1
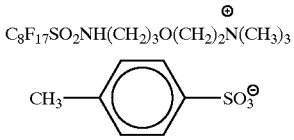
W-2
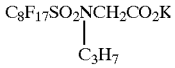
W-3
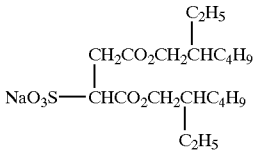
W-4
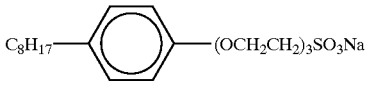
TABLE 15-continued
W-5
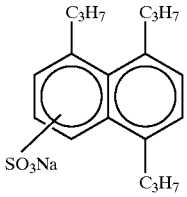
W-6
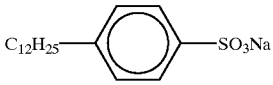
W-7 $C_8F_{17}SO_3Li$
P-1
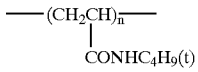
(n = 100~1000)
P-2
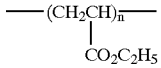
(n = 100~1000)
SO-1
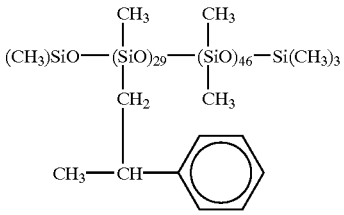
F-1
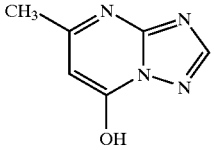
F-2
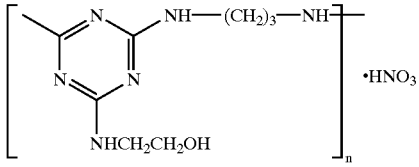
(n = 3~4)
F-3

TABLE 15-continued

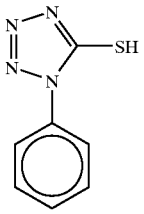

F-4

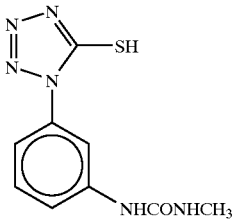

F-5

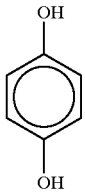

F-6

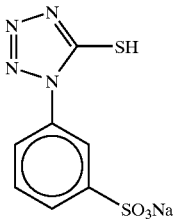

F-7

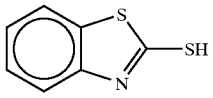

F-8

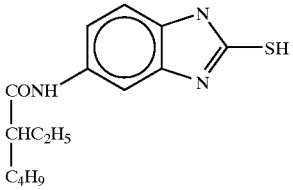

(Preparation of Dispersions of Organic Solid Particles of a Dye)

A dye E-1 was dispersed in the following way. Water and 200 g of Pluronic F88 (an ethylene oxide/propylene oxide block copolymer manufactured by BASF Corp.) were added to 1430 g of a wet cake of the dye containing 30% of methanol and the mixture was stirred to make a slurry having a dye concentration of 6%. The slurry was charged into an Ultravisco mill (UVM-2) (manufactured by Imex Co. Ltd.) loaded with 1700 mL of zirconia beads having an average diameter of 0.5 mm and ground for 8 hours at a flow rate of 0.5 L/min and a peripheral speed of 10 m/s. Next, after the beads were eliminated by filtration, the dispersion obtained as a product was diluted with water so that the concentration of the dye became 3% by weight. After that, for the purpose of stabilization, the dispersion was kept at 90° C. for 10 hours. The average particle diameter of the dispersion of the dye was 0.60 μm and the broadness of the particle diameter distribution (particle diameter standard deviation×100/average particle diameter) was 18%.

In the same way, a dispersion of solid particles of a dye E-2 was obtained. The average particle diameter was 0.54 μm.

Samples 502a to 520a were prepared in the same way as in the preparation of Sample 501, except that the high-boiling-point organic solvent Oil-1 (the same compound as the comparative compound b (noncoloring compound) in Table 6) in all of the layers of Sample 501 was replaced with the noncoloring compounds shown in the following Table 16. The replacement was made in such a manner that the mass of the noncoloring compound in each layer of Samples 502a to 520a was equal to the mass of the high-boiling-point organic solvent Oil-1 in each layer of Sample 501.

Samples 502b to 522b were prepared in the same way as in the preparation of Sample 501, except that the high-boiling-point organic solvent Oil-1 in all of the layers of Sample 501 was replaced with the high-boiling-point organic solvents shown in the following Table 17. The replacement was made in such a manner that the amount of the high-boiling-point organic solvent used in each of Samples 502a to 520a was equal to the mass of the high-boiling-point organic solvent Oil-1 in Sample 501.

Samples 501, 502a to 520a, and Samples 502b to 522b thus prepared were processed into strips. One set of the strips was stored for one month under a condition of 30° C. and 80% RH. Another set of the strips was stored for one month under a freezing condition. The strips after being stored were exposed to white light having a color temperature of 4,800° K through a wedge whose density continuously changed. The samples after the exposure were processed according to the following development processing. After that, the sensitivity that gave a magenta density of 1.0 was measured. The difference between the sensitivity in the case stored under a condition of 30° C. and 80% RH and the sensitivity in the case stored under a freezing condition was sought. The smaller the value, the better the performance is because of smaller change in sensitivity. The assessment results of Samples 501, 502a to 520a are shown in Table 16 and the assessment results of Samples 501, 502b to 522b are shown in Table 17.

Meanwhile, Samples 501, 502a to 520a, and Samples 502b to 522b were each cut and punched into a 135 size and rolled into two patrones. One patrone was stored for one month under a condition of 30° C. and 80% RH and the other patrone was stored for one month under a freezing condition. After that, the two patrones were each loaded in a camera and photographs of a person, a scene, and a gray chart were taken. The samples were subjected to the following development processing and the difference due to the storing conditions was visually inspected. The assessment results were indicated in two ratings, that is, ○: almost no difference was found and acceptable, and X: unacceptable difference was found. The assessment was conducted by 10 persons and the number of the persons who gave ○ are shown in Table 16 (for Samples 501, 502a to 520a) and in Table 17 (for Samples 501, 502b to 522b).

Samples 502c to 514c were prepared in the same way as in the preparation of Sample 501c, except that the high-boiling-point organic solvent Oil-1 in all of the layers of Sample 501c was replaced according to the following Table 18. The replacement was made in such a manner that the amount of the high-boiling-point organic solvent used in Samples 502c to 514c was equal to the mass of the high-boiling-point organic solvent Oil-1 in Sample 501c in each layer.

Samples 501c, 502c to 514c thus prepared were processed into strips. One set of the strips was stored for one month under a condition of 25° C. and 90% RH. Another set of the strips was stored for one month under a freezing condition. The strips after being stored were exposed to white light having a color temperature of 4,800° K through a wedge whose density continuously changed. The samples after the exposure were processed according to the following development processing. After that, the sensitivity that gave a magenta density of 1.0 was measured. The difference between the sensitivity in the case stored under a condition of 25° C. and 90% RH and the sensitivity in the case stored under a freezing condition was sought. The smaller the value, the better the performance is because of smaller change in sensitivity. The assessment results are shown in Table 18.

Samples 502d to 510d were prepared in the same way as in the preparation of Sample 501, except that the high-boiling-point organic solvent Oil-1 in all of the layers of Sample 501 was replaced according to the following Table 19. The replacement was made in such a manner that the amount of the high-boiling-point organic solvent used in Samples 502d to 510d was equal to the mass of the high-boiling-point organic solvent Oil-1 in Sample 501 in each layer.

Samples 501, 502d to 510d thus prepared were processed into strips. One set of the strips was stored for one month under a condition of 25° C. and 85% RH. Another set of the strips was stored for one month under a freezing condition. The strips after being stored were exposed to white light having a color temperature of 4,800° K through a wedge whose density continuously changed. The samples after the exposure were processed according to the following development processing. After that, the sensitivity that gave a magenta density of 1.0 was measured. The difference between the sensitivity in the case stored under a condition of 25° C. and 85% RH and the sensitivity in the case stored under a freezing condition was sought. The smaller the value, the better the performance is because of smaller change in sensitivity. The assessment results are shown in Table 19.

Meanwhile, Samples 501, 502d to 510d were each cut and punched into a 135 size and rolled into two patrones. One patrone was stored for one month under a condition of 25° C. and 85% RH and the other patrone was stored for one month under a freezing condition. After that, the two patrones were each loaded in a camera and photographs of a person, a scene, and a gray chart were taken. The samples were subjected to the following development processing and the difference due to the storing conditions was visually inspected. The assessment results were indicated in two ratings, that is, ○: almost no difference was found and acceptable, and X: unacceptable difference was found. The assessment was conducted by 10 persons and the number of the persons who gave ○ are shown in Table 19.

Samples 501, 502a to 520a, 502b to 522b, 502c to 514c, and 502d to 510d were subjected to the following development processing steps.

| processing step | time | tempera-ture | tank capacity | replenished amount |
|---|---|---|---|---|
| 1st development | 6 minutes | 38° C. | 12 L | 2200 mL/m$^2$ |

-continued

| processing step | time | tempera-ture | tank capacity | replenished amount |
|---|---|---|---|---|
| 1st rinsing | 2 minutes | 38° C. | 4 L | 7500 mL/m$^2$ |
| reversing | 2 minutes | 38° C. | 4 L | 1100 mL/m$^2$ |
| color development | 6 minutes | 38° C. | 12 L | 2200 mL/m$^2$ |
| pre-bleach | 2 minutes | 38° C. | 4 L | 1100 mL/m$^2$ |
| bleaching | 6 minutes | 38° C. | 12 L | 220 mL/m$^2$ |
| fixing | 4 minutes | 38° C. | 8 L | 1100 mL/m$^2$ |
| 2nd rinsing | 4 minutes | 38° C. | 8 L | 7500 mL/m$^2$ |
| final rinsing | 1 minute | 25° C. | 2 L | 1100 mL/m$^2$ |

The compositions of the processing solutions were as follows.

| | [tank solution] | [replenisher solution] |
|---|---|---|
| [1st developing solution] | | |
| nitro-N,N,N-trimethylenephosphonic acid.pentasodium salt | 1.5 g | 1.5 g |
| diethylenetriaminepentaacetic acid.pentasodium salt | 2.0 g | 2.0 g |
| sodium sulfite | 30 g | 30 g |
| potassium hydroquinone.monosulfonate | 20 g | 20 g |
| potassium carbonate | 15 g | 20 g |
| sodium hydrogensulfite | 12 g | 15 g |
| 1-phenyl-4-methyl-4-hydroxymethyl-3-pyrazolidone | 1.5 g | 2.0 g |
| potassium bromide | 2.5 g | 1.4 g |
| potassium thiocyanate | 1.2 g | 1.2 g |
| potassium iodide | 2.0 mg | — |
| diethylene glycol | 13 g | 15 g |
| water to make | 1000 mL | 1000 mL |
| pH | 9.60 | 9.60 |
| pH was controlled by sulfuric acid or potassium hydroxide. | | |
| [reversing solution] | | |
| nitro-N,N,N-trimethylenephosphonic acid.pentasodium salt | 3.0 g | 3.0 g |
| stannous chloride.dihydrate | 1.0 g | 1.0 g |
| p-aminophenol | 0.1 g | 0.1 g |
| sodium hydroxide | 8 g | 8 g |
| glacial acetic acid | 15 mL | 15 mL |
| water to make | 1000 mL | 1000 mL |
| pH | 6.00 | 6.00 |
| pH was controlled by acetic acid or sodium hydroxide. | | |
| [color developing solution] | | |
| nitro-N,N,N-trimethylenephosphonic acid.pentasodium salt | 2.0 g | 2.0 g |
| sodium sulfite | 7.0 g | 7.0 g |
| sodium tertiary phosphate.octadecahydrate | 36 g | 36 g |
| potassium bromide | 1.0 g | — |
| potassium iodide | 90 mg | — |
| sodium hydroxide | 3.0 g | 3.0 g |
| citrazinic acid | 1.5 g | 1.5 g |
| N-ethyl-N-(β-methanesulfoneamidoethyl)-3-methyl-4-aminoaniline.3/2 sulfuric acid.monohydrate | 11 g | 11 g |
| 3,6-dithiaoctane-1,8-diol | 1.0 g | 1.0 g |
| water to make | 1000 mL | 1000 mL |
| pH | 11.80 | 12.00 |
| pH was controlled by sulfuric acid or potassium hydroxide. | | |
| [pre-bleaching] | | |
| ethylenediaminetetraacetic acid.disodium salt.dihydrate | 8.0 g | 8.0 g |
| sodium sulfite | 6.0 g | 8.0 g |

-continued

| | [tank solution] | [replenisher solution] |
|---|---|---|
| 1-thioglycerol | 0.4 g | 0.4 g |
| formaldehyde/sodium hydrogensulfite adduct | 30 g | 35 g |
| water to make | 1000 mL | 1000 mL |
| pH | 6.30 | 6.10 |
| pH was controlled by acetic acid or sodium hydroxide. | | |
| [bleaching solution] | | |
| ethylenediaminetetraacetic acid.disodium salt.dihydrate | 2.0 g | 4.0 g |
| Fe(III)ammonium ethylenediaminetetra-acetate.dihydrate | 120 g | 240 g |
| potassium bromide | 100 g | 200 g |
| ammonium nitrate | 10 g | 20 g |
| water to make | 1000 mL | 1000 mL |
| pH | 5.70 | 5.50 |
| pH was controlled by nitric acid or sodium hydroxide. | | |
| [fixing solution] | | |
| ammonium thiosulfate | 80 g | 80 g |
| sodium sulfite | 5.0 g | 5.0 g |
| sodium hydrogensulfite | 5.0 g | 5.0 g |
| water to make | 1000 mL | 1000 mL |
| pH | 6.60 | 6.60 |
| pH was controlled by acetic acid or ammonia water. | | |
| [stabilizing solution] | | |
| 1,2-benzisothiazoline-3-one | 0.02 g | 0.03 g |
| polyoxyethylene-p-monononylphenyl ether (having an average degree of polymerization of 10) | 0.3 g | 0.3 g |
| polymaleic acid (average molecular weight: 2,000) | 0.1 g | 0.15 g |
| water to make | 1000 mL | 1000 mL |
| pH | 7.0 | 7.0 |

TABLE 16

Results of assessment of storability of the silver halide photosensitive materials using the noncoloring compounds represented by the general formula (a)

| Sample No. | Kinds of noncoloring compounds | Change of sensitivity (*1) | Sensory inspection (*2) | Remarks |
|---|---|---|---|---|
| 501 | Comparative compound b | −0.15 | 0 | Comparative Example |
| 502a | Comparative compound a | −0.10 | 1 | Comparative Example |
| 503a | Comparative compound c | −0.06 | 1 | Comparative Example |
| 504a | Comparative compound d | −0.07 | 1 | Comparative Example |
| 505a | Comparative compound e | −0.08 | 1 | Comparative Example |
| 506a | Comparative compound d | −0.07 | 1 | Comparative Example |
| 507a | Exemplary compound a-1 | −0.03 | 7 | Example |
| 508a | Exemplary compound a-2 | −0.04 | 8 | Example |
| 509a | Exemplary compound a-3 | −0.03 | 7 | Example |
| 510a | Exemplary compound a-4 | −0.03 | 8 | Example |
| 511a | Exemplary compound a-9 | −0.03 | 8 | Example |
| 512a | Exemplary compound a-16 | −0.02 | 8 | Example |
| 513a | Exemplary compound a-18 | −0.03 | 7 | Example |
| 514a | Exemplary compound a-21 | −0.02 | 8 | Example |
| 515a | Exemplary compound a-23 | −0.02 | 8 | Example |
| 516a | Exemplary compound a-24 | −0.02 | 8 | Example |
| 517a | Exemplary compound a-29 | −0.03 | 8 | Example |
| 518a | Exemplary compound a-30 | −0.02 | 8 | Example |

TABLE 16-continued

Results of assessment of storability of the silver halide photosensitive materials using the noncoloring compounds represented by the general formula (a)

| Sample No. | Kinds of noncoloring compounds | Change of sensitivity (*1) | Sensory inspection (*2) | Remarks |
|---|---|---|---|---|
| 519a | Exemplary compound a-31 | −0.02 | 8 | Example |
| 520a | Exemplary compound a-32 | −0.03 | 8 | Example |

(*1) Change of the exposure amount (Log E) that gives a magenta density of 1.0. The difference between the exposure amount in the case stored at 30° C. and 80% RH and the exposure amount in the case stored under a freezing condition.
(*2) The number of persons who gave the assessment: "○: acceptable".

In Table 16, the numbers attached to the exemplary compounds indicate the respective numbers attached to the exemplary noncoloring compounds represented by the general formula (a) previously described. The comparative compounds a to d are the same as the comparative compounds a to d shown in Table 2. The high-boiling-point organic solvent Oil-1 is the same as the comparative compound b in Table 2.

From the results shown in Table 16, it can be seen that the use of the noncoloring compounds represented by the general formula (a) improves the storability of the silver halide color photographic photosensitive materials. That is, decrease of the sensitivity due to the change of storing environments at the time when stored as raw photosensitive materials (i.e., in a state before exposure) is remarkably inhibited. Further, while the photosensitive materials have excellent color developing reactivity, the fogging density is decreased (i.e., alleviation of fogging and soft-toning problems) and images having a high contrast can be obtained in a stable manner.

TABLE 17

Results of assessment of storability of the silver halide photosensitive materials using the noncoloring compounds represented by the general formula (b)

| Samples | Compounds that replaced the high-boiling-point organic solvent Oil-1 | Change of sensitivity (*1) | Sensory inspection (*2) | Remarks |
|---|---|---|---|---|
| 501 | — | −0.15 | 0 | Comparative Example |
| 502b | Comparative compound a | −0.10 | 1 | Comparative Example |
| 503b | Comparative compound b | −0.11 | 1 | Comparative Example |
| 504b | Comparative compound c | −0.06 | 1 | Comparative Example |
| 505b | Comparative compound d | −0.07 | 1 | Comparative Example |
| 506b | Comparative compound e | −0.08 | 1 | Comparative Example |
| 507b | Comparative compound f | −0.09 | 1 | Comparative Example |
| 508b | Comparative compound g | −0.08 | 1 | Comparative Example |
| 509b | Comparative compound h | −0.09 | 1 | Comparative Example |
| 510b | Comparative compound l | −0.07 | 1 | Comparative Example |
| 511b | Comparative compound j | −0.09 | 1 | Comparative Example |
| 512b | Comparative compound k | −0.07 | 1 | Comparative Example |
| 513b | Comparative compound l | −0.06 | 1 | Comparative Example |

TABLE 17-continued

Results of assessment of storability of the silver halide photosensitive materials using the noncoloring compounds represented by the general formula (b)

| Samples | Compounds that replaced the high-boiling-point organic solvent Oil-1 | Change of sensitivity (*1) | Sensory inspection (*2) | Remarks |
|---|---|---|---|---|
| 514b | Comparative compound m | −0.07 | 1 | Comparative Example |
| 515b | Comparative compound n | −0.08 | 1 | Comparative Example |
| 516b | Comparative compound o | −0.13 | 1 | Comparative Example |
| 517b | Exemplary compound b-1 | −0.03 | 7 | Example |
| 518b | Exemplary compound b-2 | −0.04 | 8 | Example |
| 519b | Exemplary compound b-3 | −0.03 | 7 | Example |
| 520b | Exemplary compound b-4 | −0.03 | 8 | Example |
| 521b | Exemplary compound b-9 | −0.03 | 8 | Example |
| 514b | Exemplary compound b-10 | −0.02 | 8 | Example |
| 515b | Exemplary compound b-11 | −0.03 | 7 | Example |
| 516b | Exemplary compound b-12 | −0.03 | 8 | Example |
| 517b | Exemplary compound b-13 | −0.02 | 8 | Example |
| 518b | Exemplary compound b-15 | −0.02 | 8 | Example |
| 519b | Exemplary compound b-18 | −0.03 | 8 | Example |
| 520b | Exemplary compound b-21 | −0.02 | 8 | Example |
| 521b | Exemplary compound b-24 | −0.02 | 8 | Example |
| 522b | Exemplary compound b-25 | −0.03 | 8 | Example |

(*1) Change of the exposure amount (Log E) that gives a magenta density of 1.0. The difference between the exposure amount in the case stored at 30° C. and 80% RH and the exposure amount in the case stored under a freezing condition.
(*2) The number of persons who gave the assessment: "○: acceptable".

In Table 17, the numbers attached to the exemplary compounds indicate the respective numbers attached to the exemplary noncoloring compounds represented by the general formula (b) previously described. The comparative compounds a to o are the same as the comparative compounds a to o shown in Table 3. The high-boiling-point organic solvent Oil-1 is the same as the comparative compound o in Table 3.

From the results shown in Table 17, it can be seen that the use of the noncoloring compounds represented by the general formula (b) improves the storability of the silver halide color photographic photosensitive materials.

TABLE 18

Results of assessment of storability of the silver halide photosensitive materials using the noncoloring compounds represented by the general formula (c)

| Samples | Compounds that replaced the high-boiling-point organic solvent Oil-1 | Change of sensitivity (*1) | Remarks |
|---|---|---|---|
| 501c | — | −0.15 | Comparative Example |
| 502c | Comparative compound a | −0.15 | Comparative Example |
| 503c | Comparative compound c | −0.13 | Comparative Example |
| 504c | Comparative compound d | −0.15 | Comparative Example |
| 505c | Comparative compound e | −0.18 | Comparative Example |
| 506c | Exemplary compound c-1 | −0.07 | Example |
| 507c | Exemplary compound c-2 | −0.06 | Example |
| 508c | Exemplary compound c-3 | −0.07 | Example |
| 509c | Exemplary compound c-4 | −0.07 | Example |
| 510c | Exemplary compound c-9 | −0.07 | Example |
| 511c | Exemplary compound c-10 | −0.06 | Example |
| 512c | Exemplary compound c-12 | −0.06 | Example |
| 513c | Exemplary compound c-13 | −0.06 | Example |
| 514c | Exemplary compound c-19 | −0.06 | Example |

TABLE 18-continued

Results of assessment of storability of the silver halide photosensitive materials using the noncoloring compounds represented by the general formula (c)

| Samples | Compounds that replaced the high-boiling-point organic solvent Oil-1 | Change of sensitivity (*1) | Remarks |
|---|---|---|---|

(*1) Change of the exposure amount (Log E) that gives a magenta density of 1.0. The difference between the exposure amount in the case stored at 25° C. and 90% RH and the exposure amount in the case stored under a freezing condition.

In Table 18, the numbers attached to the exemplary compounds indicate the respective numbers attached to the exemplary noncoloring compounds represented by the general formula (c) previously described. The comparative compounds a to e are the same as the comparative compounds a to e shown in Table 4. The high-boiling-point organic solvent Oil-1 is the same as the comparative compound o in Table 4.

From the results shown in Table 18, it can be seen that the use of the noncoloring compounds represented by the general formula (c) improves the storability of the silver halide color photographic photosensitive materials.

TABLE 19

Results of assessment of storability of the silver halide photosensitive materials using the noncoloring compounds represented by the general formula (d)

| Samples | Compounds that replaced the high-boiling-point organic solvent Oil-1 | Change of sensitivity (*1) | Sensory inspection (*2) | Remarks |
|---|---|---|---|---|
| 501 | Comparative compound a* | −0.10 | 0 | Comparative Example |
| 502d | Comparative compound b | −0.06 | 1 | Comparative Example |
| 503d | Comparative compound c | −0.06 | 1 | Comparative Example |
| 504d | Comparative compound d | −0.06 | 1 | Comparative Example |
| 505d | Exemplary compound d-5 | −0.03 | 8 | Example |
| 506d | Exemplary compound d-12 | −0.04 | 7 | Example |
| 507d | Exemplary compound d-13 | −0.04 | 7 | Example |
| 508d | Exemplary compound d-21 | −0.03 | 8 | Example |
| 509d | Exemplary compound d-30 | −0.03 | 8 | Example |
| 510d | Exemplary compound d-31 | −0.03 | 8 | Example |

(*1) Change of the exposure amount (Log E) that gives a magenta density of 1.0. The difference between the exposure amount in the case stored at 25° C and 85% RH and the exposure amount in the case stored under a freezing condition.
(*2) The number of persons who gave the assessment: "○: acceptable".

In Table 19, the numbers attached to the exemplary compounds indicate the respective numbers attached to the exemplary noncoloring compounds represented by the general formula (d) previously described. The comparative compounds a to d are the same as the comparative compounds a to d shown in Table 5. The high-boiling-point organic solvent Oil-1 is the same as the comparative compound a in Table 5.

From the results shown in Table 19, it can be seen that the incorporation of the noncoloring compounds represented by the general formula (d) improves the storability of the silver halide color photographic photosensitive materials.

Example 5

A photosensitive material was prepared in the same way as in the preparation of Sample 101, which is a color negative film shown in Example 1 of JP-A No. 11-305396, except that HBS-2 in the 1st and 13th layers of Sample 101 was replaced with the same mass of the exemplary compound a-1 described previously. Further, a photosensitive material was prepared in the same way as in the preparation of Sample 101, except that HBS-2 in Sample 101 was replaced with the same mass of the exemplary compound a-16 described previously. Further, a photosensitive material was prepared in the same way as in the preparation of Sample 101, except that HBS-2 in Sample 101 was replaced with the same mass of the exemplary compound b-1 described previously. Further, a photosensitive material was prepared in the same way as in the preparation of Sample 101, except that HBS-2 in Sample 101 was replaced with the same mass of the exemplary compound b-16 described previously. Further, a photosensitive material was prepared in the same way as in the preparation of Sample 101, except that HBS-2 in Sample 101 was replaced with the same mass of the exemplary compound c-1 described previously. Further, a photosensitive material was prepared in the same way as in the preparation of Sample 101, except that HBS-2 in Sample 101 was replaced with the same mass of the exemplary compound c-16 described previously. Further, a photosensitive material was prepared in the same way as in the preparation of Sample 101, except that HBS-2 in Sample 101 was replaced with the same mass of the exemplary compound d-1 described previously. Still further, a photosensitive material was prepared in the same way as in the preparation of Sample 101, except that HBS-2 in Sample 101 was replaced with the same mass of the exemplary compound d-30 described previously.

The 8 photosensitive materials thus prepared were subjected to the exposure and development processing according to the methods described in Example 1 of JP-A No. 11-305396. As a result, the 8 photosensitive materials were all found to exhibit the effect of the present invention. That is, the storability of the photosensitive materials was improved without the problem to be caused by the migration of the high-boiling-point organic solvent.

Example 6

A silver halide color photographic photosensitive material for cinema was prepared in the same way as in the preparation of Sample 106, which is shown in Example 1 of JP-A No. 11-282106, except that the high-boiling-point organic solvent (Solv-5) in Sample 106 was replaced with the same mass of a 1:1 mixture (by mass) of the exemplary compound a-1 and the exemplary compound a-16 described previously. Further, a silver halide color photographic photosensitive material for cinema was prepared in the same way as in the preparation of Sample 106, except that the high-boiling-point organic solvent (Solv-5) in Sample 106 was replaced with the same mass of 1:1:1 mixture (by mass) of the exemplary compounds b-1, b-9, and b-25 of the noncoloring compounds represented by the general formula (b) described previously. Further, a silver halide color photographic photosensitive material for cinema was prepared in the same way as in the preparation of Sample 106, except that the high-boiling-point organic solvent (Solv-5) in Sample 106 was replaced with the same mass of a 1:1 mixture (by mass) of the exemplary compound c-1 and the exemplary compound c-21 of the present invention. Still further, a silver halide color photographic photosensitive material for cinema was prepared in the same way as in the preparation of Sample 106, except that the high-boiling-point organic solvent (Solv-5) in Sample 106 was replaced with the same mass of the exemplary compound d-30.

The 4 silver halide color photographic photosensitive materials thus prepared were subjected to the exposure and development processing according to the methods described in Example 1 of JP-A No. 11-282106. As a result, the 4 photosensitive materials were found to exhibit the effects (particularly the function to prevent color mixing in the processing and the improvement of the storability of a hydroquinone derivative that is a photographically useful component) of the present invention.

Example 7

Sample 201A was prepared in the same way as in the preparation of Sample 201 of Example 2, except that the following alterations were made.

By using Sample 201A, Samples 202A to 206A and Samples 301A to 326A, which corresponded to Samples 202 to 206 and Samples 301b to 326b, respectively, were prepared. These samples were subjected to the same assessments as those in Example 2. As a result, the samples of the present invention were all found to be excellent.

Alterations that were made to Sample 201 to prepare Sample 201A:

(Solv-2) was replaced with the same mass of (Solv-9)
(Solv-6) was replaced with the same mass of (Solv-10);
UV-A was replaced with the same mass of UV-D;
UV-B was replaced with the same mass of UV-D;
UV-C was replaced with the same mass of UV-E; and
(Cpd-13) was replaced with the same mass of (Cpd-21).

(solv-9)

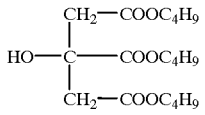

(solv-10)

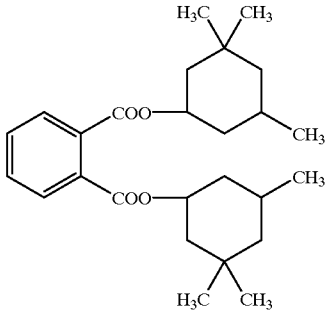

(UV-8) Ultraviolet Absorbing Agent (UV-8)

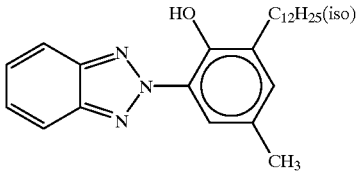

(UV-9) Ultraviolet Absorbing Agent

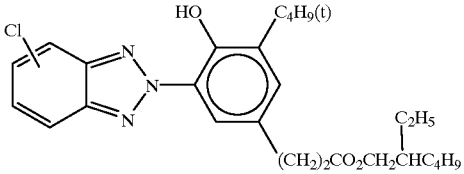

UV-D: The mixture of 1/1/7/1 (mass ratio) of UV-2/UV-3/UV-8/UV-9

UV-E: The mixture of 1/1/3/4/1 (mass ratio) of UV-2/UV-3/UV-7/UV-8/Uv-9

(cpd-21) Surfactant

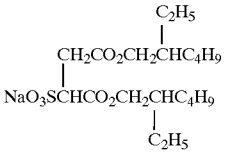

What is claimed is:

1. A silver halide photosensitive material comprising at least one noncoloring compound represented by any one of the following general formulae a to d, wherein:

the general formula a is as follows:

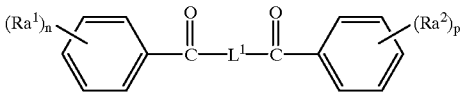

and in the general formula a, $Ra^1$ and $Ra^2$ each independently represents an unsubstituted alkyl group having 1 to 10 carbon atoms $L^1$ represents a group represented by one of the following general formulae a2 and a3, n and p each independently represents an integer from 1 to 5, if n is 2 to 5, the plural of $Ra^1$ may be the same as or different from each other, the general formula a2 is as follows:

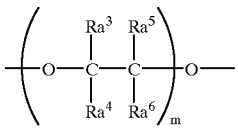

in which $Ra^3$, $Ra^4$, $Ra^5$ and $Ra^6$ each independently represents one of a hydrogen atom and an unsubstituted alkyl group having 1 to 10 carbon atoms, m represents an integer from 2 to 4, one of $Ra^3$, $Ra^4$, $Ra^5$ and $Ra^6$ may be the same as and may be different from another one thereof, and, if m is 2, the total number of carbon atoms in groups represented by $Ra^1$, $Ra^2$, $Ra^3$, $Ra^4$, $Ra^5$ and $Ra^6$ is at least 5, the general formula a3 is as follows:

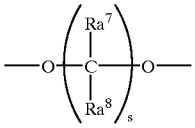

in which $Ra^7$ and $Ra^8$ each independently represents a hydrogen group or an unsubstituted alkyl group having 1 to 10 carbon atoms, s represents an integer from 2 to 8, and the two or more of $Ra^7$ may be the same as or different from each other, and the two or more of $Ra^8$ may be the same as or different from each other, and if $L^1$ is a group represented by the general formula a3, the total number of carbon atoms in groups represented by $Ra^1$, $Ra^2$, $Ra^7$ and $Ra^8$ is at least 5, the general formula b is as follows:

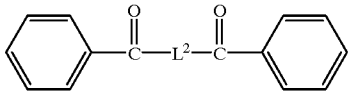

and in the general formula b, $L^2$ represents a group represented by one of the following general formula b2, b3 and b4, general formula b2 is as follows:

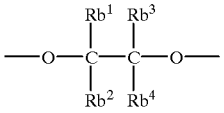

in which $Rb^1$, $Rb^2$, $Rb^3$ and $Rb^4$ each independently represents one of a hydrogen atom and an unsubstituted alkyl group having 1 to 10 carbon atoms, and the total number of carbon atoms in groups represented by $Rb^1$, $Rb^2$, $Rb^3$ and $Rb^4$ is at least 5, general formula b3 is as follows:

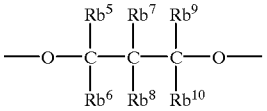

in which $Rb^5$, $Rb^6$, $Rb^7$, $Rb^8$, $Rb^9$ and $Rb^{10}$ each independently represents one of a hydrogen atom and an unsubstituted alkyl group having 1 to 10 carbon atoms, and the total number of carbon atoms in groups represented by $Rb^5$, $Rb^6$, $Rb^7$, $Rb^8$, $Rb^9$ and $Rb^{10}$ is at least 6, and general formula b4 is as follows:

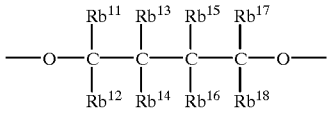

in which $Rb^{11}$, $Rb^{12}$, $Rb^{13}$, $Rb^{14}$, $Rb^{15}$, $Rb^{16}$, $Rb^{17}$ and $Rb^{18}$ each independently represents one of a hydrogen atom and an unsubstituted alkyl group having 1 to 10 carbon atoms, and the total number of carbon atoms in groups represented by $Rb^{11}$, $Rb^{12}$, $Rb^{13}$, $Rb^{14}$, $Rb^{15}$, $Rb^{16}$, $Rb^{17}$ and $Rb^{18}$ is at least 2, the general formula c is as follows:

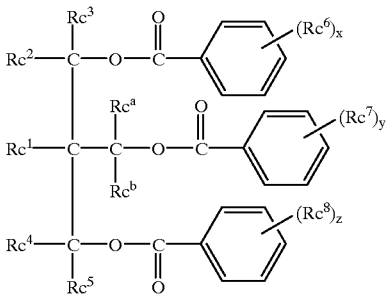

and in the general formula c, $Rc^1$ represents one of a hydrogen atom and an unsubstituted alkyl group having 1 to 10 carbon atoms, $Rc^a$, $Rc^b$, $Rc^2$, $Rc^3$, $Rc^4$, $Rc^5$, $Rc^6$, $Rc^7$ and $Rc^8$ each independently represents one of a hydrogen atom and an unsubstituted alkyl group having 1 to 10 carbon atoms, x, y and z each independently represents an integer from 0 to 5, if x is more than 1, the $Rc^6$s may be the same as and may be different from each other, if y is more than 1, the $Rc^7$s may be the same as and may be different from each other, if z is more than 1, the $Rc^8$s may be the same as and may be different from each other, the total number of carbon atoms in groups represented by $Rc^a$, $Rc^b$, $Rc^1$, $Rc^2$, $Rc^3$, $Rc^4$, $Rc^5$, $Rc^6$, $Rc^7$ and $Rc^8$ is at least 3;

and the general formula d is as follows:

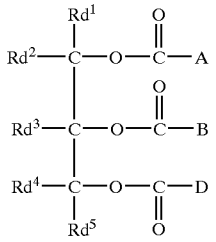

and in the general formula d,

A, B, and D each independently represents one of an unsubstituted alkyl group having 1 to 10 carbon atoms and a group represented by the following formula d2, at least two of A, B and D are each a group represented by the general formula d2, $Rd^1$, $Rd^2$, $Rd^3$, $Rd^4$ and $Rd^5$ each independently represents one of a hydrogen atom and an unsubstituted alkyl group having 1 to 10 carbon atoms, the general formula d2 is as follows:

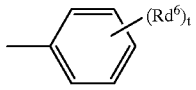

in which $Rd^6$ represents an unsubstituted alkyl group having 1 to 10 carbon atoms, t represents an integer from 0 to 5, and, if t is more than 1, the $Rd^6$s may be the same as and may be different from each other;

in the general formula d and d2, at least one of $Rd^1$, $Rd^2$, $Rd^3$, $Rd^4$, $Rd^5$ and $Rd^6$ is an unsubstituted alkyl group having 1 to 10 carbon atoms, and if A, B and D are each a group represented by the general formula d2 and respective values of t are all 0, the total number of carbon atoms in groups represented by $Rd^1$, $Rd^2$, $Rd^3$, $Rd^4$ and $Rd^5$ is at least 3.

2. A silver halide photosensitive material according to claim 1, wherein the silver halide photosensitive material contains a noncoloring compound represented by the general formula a.

3. A silver halide photosensitive material according to claim 2, wherein average molecular weight of the noncoloring compound is in the range 380 to 800.

4. A silver halide photosensitive material according to claim 2, wherein molecular weight of the noncoloring compound is 400 to 700.

5. A silver halide photosensitive material according to claim 2, wherein molecular weight of the noncoloring compound is 420 to 600.

6. A silver halide photosensitive material according to claim 1, wherein the silver halide photosensitive material contains a noncoloring compound represented by the general formula b.

7. A silver halide photosensitive material according to claim 6, wherein average molecular weight of the noncoloring compound is in the range 340 to 800.

8. A silver halide photosensitive material according to claim 6, wherein molecular weight of the noncoloring compound is 360 to 700.

9. A silver halide photosensitive material according to claim 6, wherein molecular weight of the noncoloring compound is 370 to 600.

10. A silver halide photosensitive material according to claim 1, wherein the silver halide photosensitive material contains a noncoloring compound represented by the general formula c.

11. A silver halide photosensitive material according to claim 1, wherein the silver halide photosensitive material contains a noncoloring compound represented by the general formula d.

12. A silver halide photosensitive material according to claim 1, wherein the silver halide photosensitive material has a hydrophilic colloid layer containing a hydrophilic polymer, and the noncoloring compound is contained in the hydrophilic colloid layer.

13. A silver halide photosensitive material according to claim 10, wherein average molecular weight of the noncoloring compound is in the range 450 to 800.

14. A silver halide photosensitive material according to claim 11, wherein average molecular weight of the noncoloring compound is in the range 400 to 800.

15. A silver halide photosensitive material according to claim 1, wherein, in the general formula a, the unsubstituted alkyl groups represented by $Ra^1$ and $Ra^2$ are the same as each other and each have 1 to 3 carbon atoms, and n and p are equal to each other and are each one of 1 and 2; in the general formula a2, $Ra^3$, $Ra^4$, $Ra^5$ and $Ra^6$ are each one of a hydrogen atom and an unsubstituted alkyl group having 1 to 4 carbon atoms, m is one of 2 and 3, and, if m is 2, the total number of carbon atoms in groups represented by $Ra^1$, $Ra^2$, $Ra^3$, $Ra^4$, $Ra^5$ and $Ra^6$ is at least 5; and in the general formula a3, $Ra^7$ and $Ra^8$ are each one of a hydrogen atom and an unsubstituted alkyl group having 1 to 4 carbon atoms, and s is one of 1, 2, 3 and 4.

16. A silver halide photosensitive material according to claim 1, wherein, in the general formula a, the unsubstituted alkyl groups represented by $Ra^1$ and $Ra^2$ are the same as each other and are each a group selected from a methyl group, and ethyl group, and isopropyl group and an n-propyl group, and n and p are each 1; in the general formula a2, $Ra^3$, $Ra^4$, $Ra^5$ and $Ra^6$ are each independently one of a hydrogen atom, a methyl group, an ethyl group, an isopropyl group and an n-propyl group, m is one of 2 and 3, and, if m is 2, the total number of carbon atoms in groups represented by $Ra^1$, $Ra^2$, $Ra^3$, $Ra^4$, $Ra^5$ and $Ra^6$ is at least 5; and in the general formula a3, $Ra^7$ and $Ra^8$ are each one of a hydrogen atom, a methyl group, an ethyl group, an isopropyl group and an n-propyl group, and s is one of 2 and 4.

17. A silver halide photosensitive material according to claim 1, wherein, in the general formula b2, $Rb^1$, $Rb^2$, $Rb^3$ and $Rb^4$ each independently represents one of a hydrogen atom and an unsubstituted alkyl group having 1 to 5 carbon atoms; in the general formula b3, $Rb^5$, $Rb^6$, $Rb^7$, $Rb^8$, $Rb^9$ and $Rb^{10}$ each independently represents one of a hydrogen atom and an unsubstituted alkyl group having 1 to 5 carbon atoms; in the general formula b4, and $Rb^{11}$, $Rb^{12}$, $Rb^{13}$, $Rb^{14}$, $Rb^{15}$, $Rb^{16}$, $Rb^{17}$ and $Rb^{18}$ each independently represents one of a hydrogen atom and an unsubstituted alkyl group having 1 to 5 carbon atoms.

18. A silver halide photosensitive material according to claim 1, wherein, in the general formula c, $Rc^a$, $Rc^b$, $Rc^2$, $Rc^3$, $Rc^4$, $Rc^5$, $Rc^6$, $Rc^7$ and $Rc^8$ each independently represents one of a hydrogen atom and an unsubstituted alkyl group having 1 to 5 carbon atoms, and x, y and z each represents an integer from 0 to 2.

19. A silver halide photosensitive material according to claim 1, wherein, in the general formula d, A, B and D are each a group represented by the general formula d2, $Rd^1$, $Rd^2$, $Rd^3$, $Rd^4$ and $Rd^5$ each independently represents a hydrogen atom and an unsubstituted alkyl group having 1 to 3 carbon atoms, t is one of 0 and 1; $Rd^6$ represents an unsubstituted alkyl group having 1 to 3 carbon atoms, and at least one of $Rd^1$, $Rd^2$, $Rd^3$, $Rd^4$, $Rd^5$ and $Rd^6$ represents an unsubstituted alkyl group having 1 to 3 carbon atoms.

20. A silver halide photosensitive material according to claim 1, wherein, in the general formula d, A, B and D are each a group represented by the general formula d2, $Rd^1$, $Rd^2$, $Rd^3$, $Rd^4$ and $Rd^5$ each independently represents one of a hydrogen atom, a methyl group, an ethyl group and an n-propyl group, t is one of 0 and 1, $Rd^6$ represents one of a methyl group, an ethyl group and an n-propyl group, and at least one of $Rd^1$, $Rd^2$, $Rd^3$, $Rd^4$, $Rd^5$ and $Rd^6$ represents one of a methyl group, an ethyl group and an n-propyl group.

21. A silver halide photosensitive material according to claim 1, wherein, in the general formula d, A, B and D are each a group represented by the general formula d2, $Rd^1$, $Rd^2$, $Rd^3$, $Rd^4$ and $Rd^5$ each independently represents one of a hydrogen atom and a methyl group; t is one of 0 and 1, $Rd^6$ represents a methyl group, and at least one of $Rd^1$, $Rd^2$, $Rd^3$, $Rd^4$, $Rd^5$ and $Rd^6$ represents a methyl group.

22. A silver halide photosensitive material according to claim 1, wherein, in the general formula d, A, B and D are each a group represented by the general formula d2, t is 0, $Rd^1$, $Rd^2$, $Rd^3$, $Rd^4$ and $Rd^5$ each independently represents one of a hydrogen atom and a methyl group, and at least one of $Rd^1$, $Rd^2$, $Rd^3$, $Rd^4$ and $Rd^5$ represents a methyl group.

23. A silver halide photosensitive material according to claim 1, wherein, in the general formula d, A, B and D are each a group represented by the general formula d2, t is 1; $Rd^1$, $Rd^2$, $Rd^3$, $Rd^4$ and $Rd^5$ each independently represents one of a hydrogen atom and a methyl group, and $Rd^6$ represents a methyl group.

24. A silver halide photosensitive material according to claim 1, wherein the noncoloring compound is represented by the general formula a and wherein L1 is represented by general formula a2.

25. A silver halide photosensitive material according to claim 1, wherein the noncoloring compound is represented by the general formula b and wherein L2 is represented by general formula b2 or b3.

* * * * *